US009171426B2

(12) United States Patent
DiMichele et al.

(10) Patent No.: US 9,171,426 B2
(45) Date of Patent: Oct. 27, 2015

(54) ADVERTISING SPACE FOR TOURNAMENTS

(71) Applicants: Carmen DiMichele, Norcross, GA (US); Kim Weldon, Atlanta, GA (US); Tamara Bailey, Roswell, GA (US)

(72) Inventors: Carmen DiMichele, Norcross, GA (US); Kim Weldon, Atlanta, GA (US); Tamara Bailey, Roswell, GA (US)

(73) Assignee: CADILLAC JACK, INC., Duluth, GA (US)

( * ) Notice: Subject to any disclaimer, the term of this patent is extended or adjusted under 35 U.S.C. 154(b) by 155 days.

(21) Appl. No.: 13/910,703

(22) Filed: Jun. 5, 2013

(65) Prior Publication Data

US 2014/0364190 A1 Dec. 11, 2014

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/323* (2013.01); *G07F 17/3276* (2013.01)

(58) Field of Classification Search

CPC ..... G07F 17/3276; G07F 17/323; G07F 17/3255; G07F 17/34; A63F 13/12

USPC ..... 463/42

See application file for complete search history.

(56) References Cited

U.S. PATENT DOCUMENTS

| | | | | |
|---|---|---|---|---|
| 2003/0130041 | A1* | 7/2003 | Pascal et al. | 463/42 |
| 2006/0063587 | A1* | 3/2006 | Manzo | 463/25 |
| 2006/0148565 | A1* | 7/2006 | Gauselmann et al. | 463/41 |
| 2011/0014964 | A1* | 1/2011 | Crowder et al. | 463/13 |
| 2012/0083908 | A1* | 4/2012 | Carpenter et al. | 700/91 |

* cited by examiner

*Primary Examiner* — Steve Rowland

(74) *Attorney, Agent, or Firm* — CF3; Stephen Eisenmann

(57) ABSTRACT

Examples disclosed herein relate to systems and methods for tournament game player. An electronic gaming device may include a memory, one or more processors, and a plurality of reels. One or more paylines may be formed on at least a portion of the plurality of reels. The memory may include one or more tournament game structures. The memory may also include one or more advertisement structures. The one or more processors may initiate one or more tournaments based on one or more tournament game structures. The one or more processors may initiate one or more advertisements based on at least one of the one or more advertisement structures and one or more triggering events.

16 Claims, 50 Drawing Sheets

960

| NAME | TOTAL | DATE PLAYED | PLAYERS LEFT TO PLAY | AVERAGE PLAY |
|---|---|---|---|---|
| Group 1 | 150,000 | Bob S. 1/9/14<br>Kim N. 1/7/14 | (2)<br>Katie V.<br>Lisa J. | 75,000 |
| Group 2 | 125,000 | Jim B. 1/6/14 | (3)<br>Emily A.<br>Mary L.<br>Lou B. | 125,000 |
| Zeta E. | 200,000 | Zeta E. 1/3/14 | N/A | 200,000 |
| ⋮ | ⋮ | ⋮ | ⋮ | ⋮ |
| Group N | 0 | N/A | (4)<br>Mike Z.<br>Dan L.<br>Rob C.<br>B. J. | 0 |

962

964

966

968

FIG. 9F

ADVERTISING SPACE FOR TOURNAMENTS

FIELD

The subject matter disclosed herein relates to an electronic gaming device. More specifically, the disclosure relates to an electronic gaming device, which provides advertising space before/during/in/around/after tournament game play. Further, the disclosure relates to utilizing advertising space in tournament game play to enhance the gaming experience.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successfully matches the predetermined winning symbols in one of the predetermined patterns. One or more combinations of symbols may generate a bonus game. A new way of delivering game play includes providing advertising space functionalities in a tournament game mode, a normal (e.g., base game) mode, and/or a bonus game mode.

BRIEF DESCRIPTION OF THE FIGURES

Non-limiting and non-exhaustive examples will be described with reference to the following figures, wherein like reference numerals refer to like parts throughout the various figures.

FIG. 9F is another illustration of displaying one or more tournament game play data, according to one embodiment.

DETAILED DESCRIPTION

Figure 1:
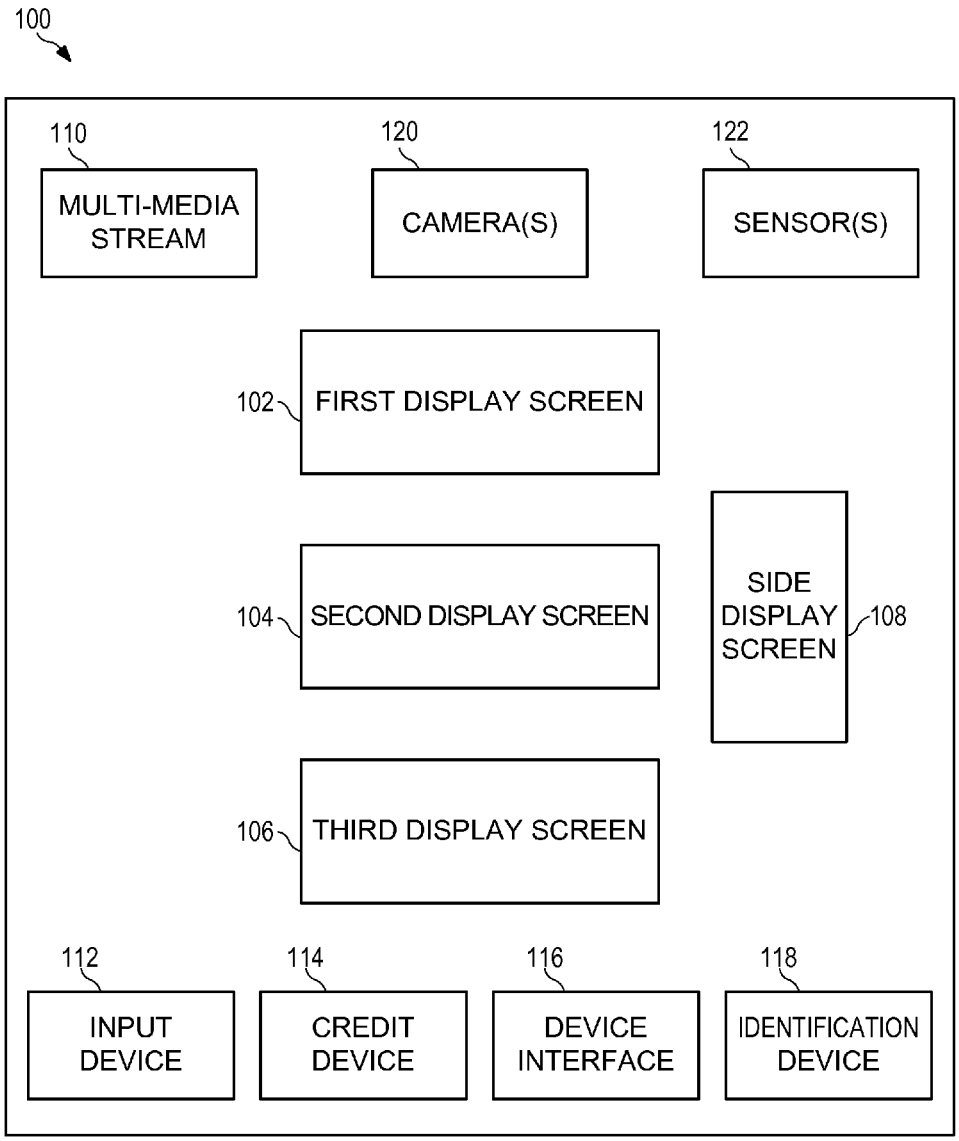
FIG. 1 is an illustration of the electronic gaming device, according to one embodiment.

FIG. 1 is an illustration of an electronic gaming device 100. Electronic gaming device 100 may include a multi-media stream 110, a first display screen 102, a second display screen 104, a third display screen 106, a side display screen 108, an input device 112, a credit device 114, a device interface 116, and an identification device 118. Electronic gaming device 100 may display one, two, a few, or a plurality of multi-media streams 110, which may be obtained from one or more gaming tables, one or more electronic gaming devices, a central server, a video server, a music server, an advertising server, another data source, and/or any combination thereof.

Multi-media streams may be obtained for an entertainment event, a wagering event, a promotional event, a promotional offering, an advertisement, a sporting event, any other event, and/or any combination thereof. For example, the entertainment event may be a concert, a show, a television program, a movie, an Internet event, and/or any combination thereof. In another example, the wagering event may be a poker tournament, a horse race, a car race, and/or any combination thereof. The advertisement may be an advertisement for a casino, a restaurant, a shop, any other entity, and/or any combination thereof. The sporting event may be a football game, a baseball game, a hockey game, a basketball game, any other sporting event, and/or any combination thereof. These multi-media streams may be utilized in combination with the gaming table video streams.

Input device 112 may be mechanical buttons, electronic buttons, mechanical switches, electronic switches, optical switches, a slot pull handle, a keyboard, a keypad, a touch screen, a gesture screen, a joystick, a pointing device (e.g., a mouse), a virtual (on-screen) keyboard, a virtual (on-screen) keypad, biometric sensor, or any combination thereof. Input device 112 may be utilized to make a wager, to control any object, to select one or more gaming options (e.g., a base game mode, a bonus game mode, a tournament game mode, etc.), to obtain data relating to historical payouts, to select a row and/or column to move, to select a row area to move, to select a column area to move, to select a symbol to move, to modify electronic gaming device 100 (e.g., change sound level, configuration, font, language, etc.), to select a movie or song, to select live multi-media streams, to request services (e.g., drinks, slot attendant, manager, etc.), to select two-dimensional ("2D") game play, to select three-dimensional ("3D") game play, to select both two-dimensional and three-dimensional game play, to change the orientation of games in a three-dimensional space, to move a symbol (e.g., wild, multiplier, etc.), and/or any combination thereof. These selections may occur via any other input device (e.g., a touch screen, voice commands, etc.).

Credit device 114 may be utilized to collect monies and distribute monies (e.g., cash, vouchers, etc.). Credit device 114 may interface with a mobile device to electronically transmit money and/or credits. Credit device 114 may interface with a player's card to exchange player points.

Device interface 116 may be utilized to interface electronic gaming device 100 to a bonus game device, a local area progressive controller, a wide area progressive controller, a progressive sign controller, a peripheral display device, signage, a promotional device, network components, a local network, a wide area network, remote access equipment, a slot monitoring system, a slot player tracking system, the Internet, a server, and/or any combination thereof.

Device interface 116 may be utilized to connect a player to electronic gaming device 100 through a mobile device, card, keypad, identification device 118, and/or any combination thereof. Device interface 116 may include a docking station by which a mobile device is plugged into electronic gaming device 100. Device interface 116 may include an over the air connection by which a mobile device is connected to electronic gaming device 100 (e.g., Bluetooth, Near Field technology, and/or Wi-Fi technology). Device interface 116 may include a connection to identification device 118.

Identification device 118 may be utilized to determine an identity of a player. Based on information obtained by identification device 118, electronic gaming device 100 may be reconfigured. For example, the language, sound level, music, placement of multi-media streams, one or more game based functionalities may be presented, one or more gaming options (e.g., a base game mode, a bonus game mode, a tournament game mode, etc.) may be presented, a repeat payline gaming option may be presented, a pattern gaming option may be presented, historical gaming data may be presented, a row rearrangement option may be presented, a column rearrangement option may be presented, a row area rearrangement option may be presented, a column area rearrangement option may be presented, a two-dimensional gaming option may be presented, a three-dimensional gaming option may be presented, and/or the placement of gaming options may be modified based on player preference data. For example, a player may want to have game play which has only a specific game functionality (or similar functionality). Therefore, no games without the specific game based functionality would be presented. In another example, the player may only want to play games that include pattern gaming options only. Therefore, only games which include pattern gaming options would be presented to the player. In another example, the player may only want to play games that include historical information relating to game play. Therefore, only games which include historical gaming data would be presented to the player.

Identification device 118 may utilize biometrics (e.g., thumb print, retinal scan, or other biometric). Identification device 118 may include a card entry slot into input device 112. Identification device 118 may include a keypad with an assigned pin number for verification. Identification device 118 may include multiple layers of identification for added security. For example, a player could be required to enter a player tracking card, and/or a pin number, and/or a thumb print, and/or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; electronic gaming device 100 will then automatically display the current baseball game onto side display screen 108 and/or an alternate display screen as set in the player's options.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games and/or secondary (bonus) games, advertising, player attractions, electronic gaming device 100 configuration parameters and settings, game history, accounting meters, events, alarms, and/or any combination thereof. Second display screen 104, third display screen 106, side display screen 108, and any other screens may utilize the same technology as first display screen 102 and/or any combination of technologies.

First display screen 102 may also be virtually combined with second display screen 104. Likewise second display screen 104 may also be virtually combined with third display screen 106. First display screen 102 may be virtually combined with both second display screen 104 and third display screen 106. Any combination thereof may be formed.

The presentations associated with a game play may be presented on one, a few, and/or a plurality of screens.

For example, a single large image could be partially displayed on second display screen 104 and partially displayed on third display screen 106, so that when both display screens are put together they complete one image. Electronic gaming device 100 may stream or play prerecorded multi-media data, which may be displayed on any display combination.

Figure 2:
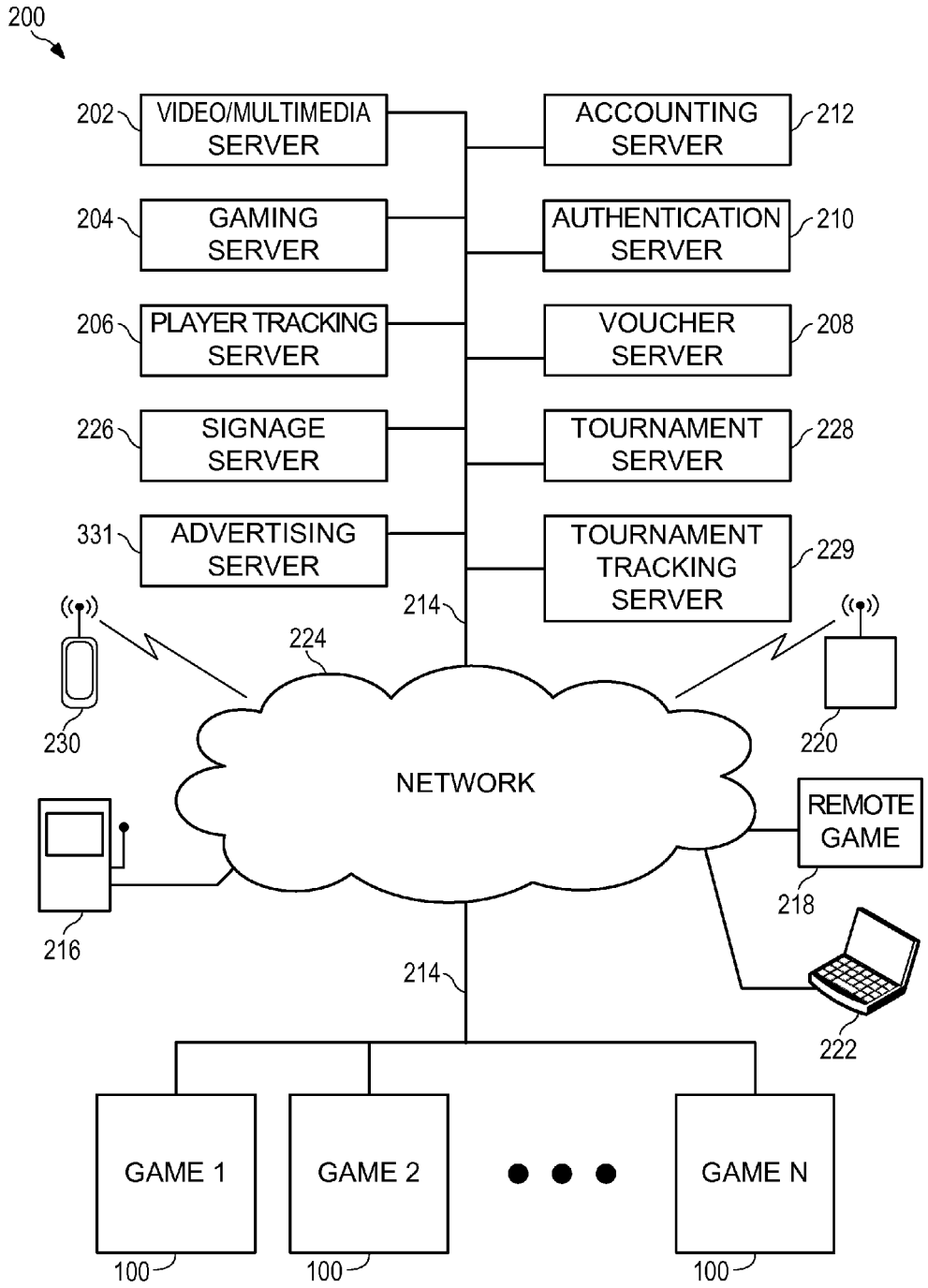
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the Internet, a private network, and/or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 220. Video/multimedia server 202 may transmit these video streams via network link 214 and/or network 224.

For example, a remote gaming device at the same location may be utilized at a casino with multiple casino floors, a casino that allows wagering activities to take place from the hotel room, a casino that may allow wagering activities to take place from the pool area, etc. In another example, the remote devices may be at another location via a progressive link to another casino, and/or a link within a casino corporation that owns numerous casinos (e.g., MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes. Gaming server 204 may provide one or more of a payout functionality, a tournament functionality, a tournament evaluation functionality, other physical game functionality, and/or any other virtual game functionality.

Player tracking server 206 may track a player's betting activity, a player's preferences (e.g., language, font, sound level, drinks, etc.). Based on data obtained by player tracking server 206, a player may be eligible for gaming rewards (e.g., free play), promotions, and/or other awards (e.g., complimentary food, drinks, lodging, concerts, etc.).

Voucher server 208 may generate a voucher, which may include data relating to gaming. Further, the voucher may include payline structure option selections. In addition, the voucher may include tournament game based game play data (or similar game play data), repeat payline data, pattern data, historical payout data, column data, row data, and/or symbols that were modified.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and/or the frequency of the wagers. Accounting server 212 may generate tax information relating to these wagers. Accounting server 212 may generate profit/loss reports for players' tracked outcomes.

Network connection 214 may be used for communication between dedicated servers, thin clients, thick clients, back-office accounting systems, etc.

Laptop computer 222 and/or any other electronic devices (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (e.g., cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components, such as network interface cards, repeaters and hubs, bridges, switches, routers, firewalls, or any combination thereof may also be part of network 224.

A statistics server may be used to maintain data relating to historical game play for one or more electronic gaming devices 100. This historical data may include winning amounts, winning data (e.g., person, sex, age, time on machine, amount of spins before winning event occurred, etc.), fastest winning event reoccurrence, longest winning event reoccurrence, average frequencies of winning events, average winning amounts, highest winning amount, lowest winning amount, locations for winning events, winning event dates, winning machines, winning game themes, and/or any other data relating to game play.

A statistics server may include data relating to one or more tournament game based game play (or similar game play). This data may include the number of time a specific item was selected. The frequency of any specific item being selected and the effectiveness of the specific item. For example, item 1 is effective 99.9% of the time. Whereas, item 2 is only effective 62% of the time.

Figure 3:
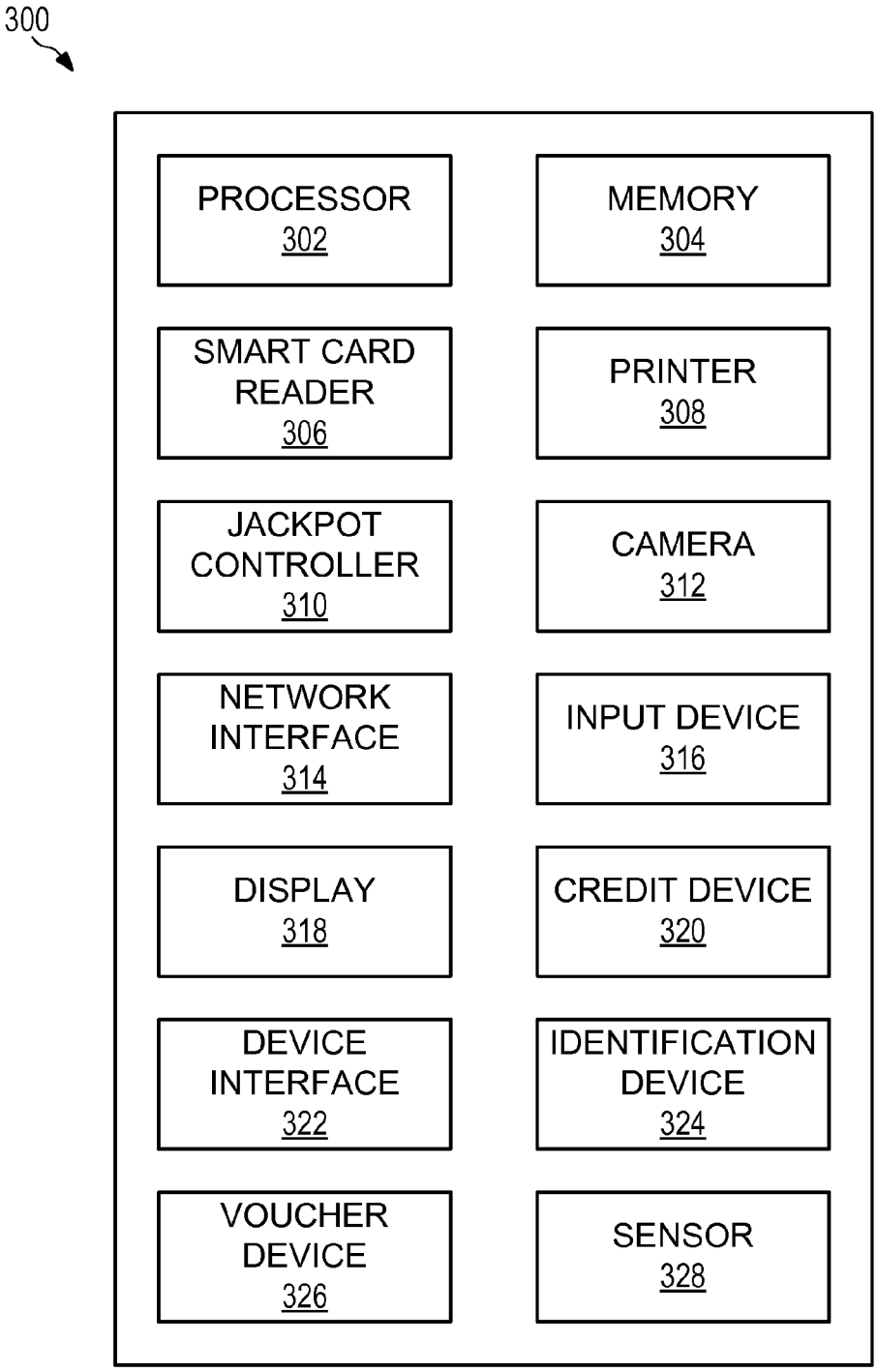
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and use memory 304 for data storage. Processor 302 may also include a numeric co-processor, or a graphics processing unit (or units) for accelerated video encoding and decoding, and/or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display contents onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308. Videos or pictures captured by camera 312 may be saved and stored on memory 304. Memory 304 may include a confirmation module, which may authenticate a value of a voucher and/or the validity of the voucher. Processor 302 may determine the value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory, such as read-only memory ("ROM"), erasable programmable read-only memory ("EPROM"), electrically erasable programmable read-only memory ("EEPROM"), flash memory ("NVRAM"), Nano-RAM (e.g., carbon nanotube random access memory), and/or any combination thereof.

Memory 304 may also be volatile semiconductor memory such as, dynamic random access memory ("DRAM"), static random access memory ("SRAM"), and/or any combination thereof.

Memory 304 may also be a data storage device, such as a hard disk drive, an optical disk drive such as, CD, DVD, Blu-ray, a solid state drive, a memory stick, a CompactFlash card, a USB flash drive, a Multi-media Card, an xD-Picture Card, and/or any combination thereof.

Memory 304 may be used to store read-only program instructions for execution by processor 302, for the read-write storage for global variables and static variables, read-write storage for uninitialized data, read-write storage for dynamically allocated memory, for the read-write storage of the data structure known as "the stack," and/or any combination thereof.

Memory 304 may be used to store the read-only paytable information for which symbol combinations on a given payline that result in a win (e.g., payout) which are established for games of chance, such as slot games and video poker.

Memory 304 may be used to store accounting information (e.g., cashable electronic promotion in, non-cashable electronic promotion out, coin in, coin out, bill in, voucher in, voucher out, electronic funds transfer in, etc.).

Memory 304 may be used to record error conditions on an electronic gaming device 100, such as door open, coin jam, ticket print failure, ticket (e.g., paper) jam, program error, reel tilt, etc., and/or any combination thereof.

Memory 304 may also be used to record the complete history for the most recent game played, plus some number of prior games as may be determined by the regulating authority.

Smart card reader 306 may allow electronic gaming device 100 to access and read information provided by the player or technician, which may be used for setting the player preferences and/or providing maintenance information. For example, smart card reader 306 may provide an interface between a smart card (inserted by the player) and identification device 324 to verify the identity of a player.

Printer 308 may be used for printing slot machine payout receipts, slot machine wagering vouchers, non-gaming coupons, slot machine coupons (e.g., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of a player or a player's surroundings. For example, when a player sits down at the machine their picture may be taken to include his or her image into the game play. A picture of a player may be an actual image as taken by camera 312. A picture of a player may be a computerized caricature of the image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Videos obtained by camera 312 may then be used as part of game play, or may be used for security purposes. For example, a camera located on electronic gaming device 100 may capture videos of a potential illegal activity (e.g., tampering with the machine, crime in the vicinity, underage players, etc.).

Network interface 314 may allow electronic gaming device 100 to communicate with video/multimedia server 202, gaming server 204, player tracking server 206, voucher server 208, authentication server 210, and/or accounting server 212.

Input device 316 may be mechanical buttons, electronic buttons, a touch screen, and/or any combination thereof. Input device 316 may be utilized to make a wager, to select one or more game elements, to control any object, to select one or more gaming options (e.g., a base game mode, a bonus game mode, a tournament game mode, etc.), to make an offer to buy, sell, and/or trade a voucher, to determine a vouchers worth, to cash in a voucher, to modify electronic gaming device 100 (e.g., change sound level, configuration, font, language, etc.), to select a movie or music, to select live video streams (e.g., sporting event 1, sporting event 2, sporting event 3), to request services (e.g., drinks, manager, etc.), and/or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor 302 to allow game play to take place. Processor 302 may determine any payouts, display configurations, animation, and/or any other functions associated with game play. Credit device 320 may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points. Credit device 320 may also interface with the tournament server and/or tournament tracking server to exchange promotional credit based on one or more advertisement incentives.

Electronic gaming device 100 may include a device interface 322 that a user may employ with his or her mobile device (e.g., smart phone) to receive information from and/or transmit information to electronic gaming device 100 (e.g., watch a movie, listen to music, obtain verbal betting options, verify identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and/or the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or an alternate display screen as set in the player's options.

A voucher device 326 may generate, print, transmit, or receive a voucher. The voucher may represent a wagering option, a wagering structure, a wagering timeline, a value of wager, a payout potential, a payout, and/or any other wagering data. A voucher may represent an award, which may be used at other locations inside of the gaming establishment. For example, the voucher may be a coupon for the local buffet or a concert ticket.

Figure 4:
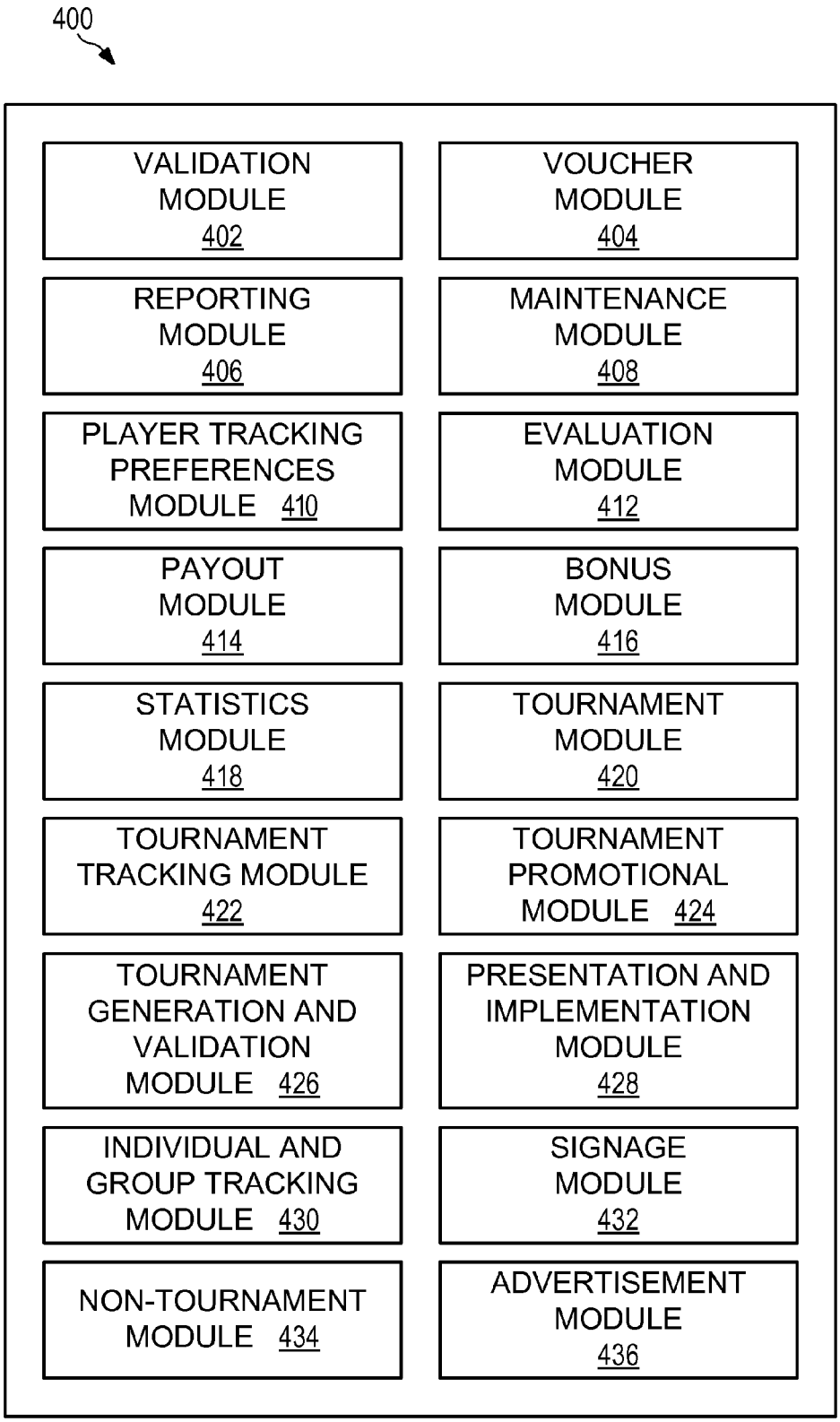
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, a player tracking preferences module 410, an evaluation module 412, a payout module 414, a bonus module 416, a statistics module 418, a tournament module 420, a tournament tracking module 422, a tournament promotional module 424, a tournament generation and validation module 426, a presentation and implementation module 428, an individual and group tracking module 430, a signage module 432, a non-tournament module 434, and an advertisement module 436.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance, request a service call based on a device error, and/or any other reason.

Player tracking preferences module 410 may compile and track data associated with a player's preferences.

Evaluation module 412 may evaluate one or more outcomes for one or more events (e.g., base game mode, bonus game mode, tournament mode, etc.) in one or more gaming options.

Payout module 414 may determine one or more payouts which may relate to one or more inputs received from the player, electronic gaming device 100, and/or electronic gaming system 200.

Bonus module 416 may generate a bonus game, evaluate the results of the bonus game, trigger bonus game presentations, generate bonus game payouts, and/or display any data relating to the bonus game.

Statistics module 418 may generate, compile, transmit, and/or store any statistical data relating to one or more gaming options (e.g., base game mode, bonus game mode, tournament mode, etc.) and/or advertising results. For example, game type 1 may generate a return of 125% during normal conditions (e.g., 90% of the time). Whereas, game type 2 may generate a return of 200% but only 75% of the time. In another example, a first advertisement may have generated a click thru rate of 20% and an acceptance rate (e.g., an actual purchase, an acceptance of the offer, etc.) of 15%. In this example, the first advertisement may have been of a first type. Whereas, a second advertisement may have generated a click thru rate of 30% and an acceptance rate of 10%. In this example, the second advertisement may have been of a second type. In addition, a third advertisement (e.g., an advertisement tied to player information) may have generated a click thru rate of 60% and an acceptance rate of 45%. This information may be utilized as a feedback loop to enhance future advertisements. The statistics module may also generate stats based on where in the game play/tournament cycle one or more advertisements are presented. For example, click-through rate ("CTR")/acceptance rate ("AR") for a particular advertisement shown before a tournament begins versus the advertisement being shown while players are waiting for the tournament final results versus the advertisement being shown directly after the tournament.

Tournament module 420 may generate, compile, transmit, and/or store one or more tournament structures. Tournament module 412 may generate, compile, transmit, and/or store data relating to one or more tournaments. Tournament module 412 may generate historical tournament reports. Tournament module 412 may generate new tournament structures based on historical tournament data (e.g., participation rate, prize pool, the level of players that played in the tournament, monies earned from related events, etc.). For example, one or more tournament structures may be targeted to high rollers. Whereas, other tournament structures may be targeted in middle level players. In another example, other tournament structures may be targeted to beginners.

Tournament tracking module 422 may generate, compile, transmit, and/or store data relating to one or more tournament structures. For example, this data may include the participants in one or more tournaments, the success (e.g., participation rate, profit/loss statement, etc.) of one or more tournaments, the individual scores for one or more players, the team scores for one or more teams, the length of time for completing game play for individuals and/or teams, one or more winning histories for individuals and/or teams, tax records for one or more tournaments, the number of game play suspensions (e.g., asynchronous game play mode) initiated by one or more players and/or one or more teams, and/or any other data relating to one or more tournaments.

Tournament promotional module 424 may generate, compile, transmit, and/or store promotional data (e.g., leaderboard, tournament structure, mailings, sponsor data, advertisements, etc.) for one or more tournaments.

Tournament generation and validation module 426 may generate, compile, transmit, and/or store validation data for one or more tournaments. For example, a first player's score may be validated by requesting information for the electronic gaming device, the electronic gaming system, and/or any other device to compare the first player's score to the data within the gaming machine.

Presentation and implementation module 428 may generate the presentation data (e.g., visual and audio) relating to one or more tournament game play options. A presentation module may display one or more of the generated presentations, one or more advertisements, and/or one or more sponsor data.

Individual and group tracking module 430 may generate, compile, transmit, and/or store data relating to tournament play for one or more individuals and/or teams. For example, Team Winner has won two out of the last five tournaments that Team Winner played in.

Signage module 432 may be used to generate any image for display on: electronic gaming device 100; an internal display device within a gaming entity; an external display device outside of a gaming entity; one or more devices at one or more satellite locations; one or more mobile devices; one or more Internet sites; and/or any combination thereof. Signage module 422 may utilize data from any module, any other server (e.g., statistics server 418 and/or signage server), and/or any other data source to generate images for display on: electronic gaming device 100; an internal display device within a gaming entity; an external display device outside of a gaming entity; one or more devices at one or more satellite locations; one or more mobile devices; one or more Internet sites; and/or any combination thereof.

Non-tournament module 434 may generate, compile, transmit, and/or store any data related to non-tournament game play (e.g., normal game play mode, bonus game play mode, etc.).

Advertisement module 436 may generate, compile, transmit, and/or store any data related to one or more advertisements, advertisement structures, sponsorship structures, sponsors, and/or any other advertising information.

It should be noted that one or more modules may be combined into one module. Further, there may be one evaluation module where the determined payout does not depend on whether there were any specific item utilized, any wild symbols, any scatter symbols, and/or any other specific symbols. Further, any module, device, and/or logic function in electronic gaming device 100 may be present in electronic gaming system 200. In addition, any module, device, and/or logic function in electronic gaming system 200 may be present in electronic gaming device 100.

Figure 5A:
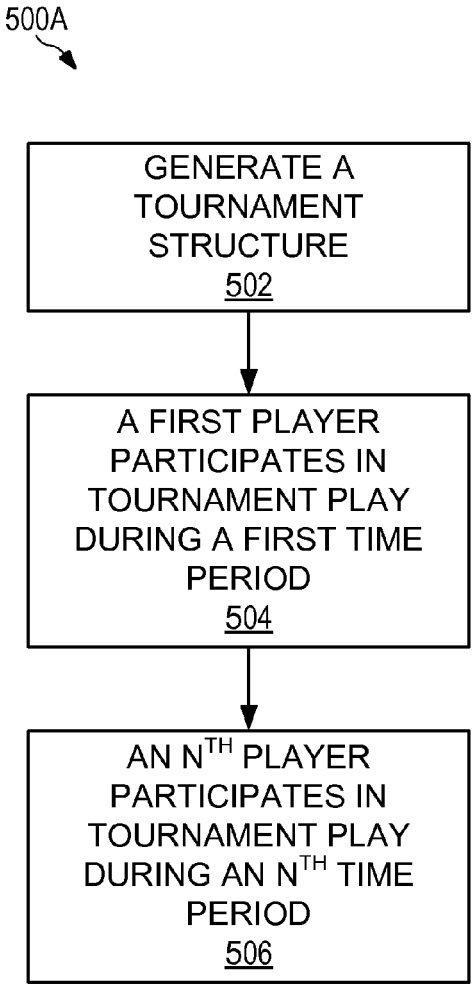
FIG. 5A is an illustration of tournament game play functionality, according to one embodiment.

In FIG. 5A, a flow diagram for asynchronous tournament play 500A is shown, according to one embodiment. The method may include generating one or more tournament structures (step 502). The method may include a first player participating in the one or more tournaments during a first time period (step 504). The method may include an Nth player participating in the one or more tournaments during an Nth time period (step 506). For example, a first player may enter the tournament at 8 am on a Monday where the tournament structure is based on the best score (e.g., most credits) won in 2 hours. The tournament structure allows tournament game play for 3 days (e.g., Monday-Wednesday). The first player starts at 8 am on Monday and ends at 10 am on Monday with a score of 100,000 credits. In this example, a second player may enter the tournament at 11 am on Monday and ends at 1 pm on Monday with a score of 95,000 credits. Further, in this example, a third player may enter the tournament at Noon on Tuesday and ends at 2 pm on Tuesday with a score of 10,000 credits. In addition, a fourth player may enter the tournament at 9 am on Wednesday, stop tournament game play at 10 am to play in a poker game, resume tournament play at 2 pm, and end tournament play at 3 pm on Wednesday with a score of 200,000 credits.

Figure 5B:
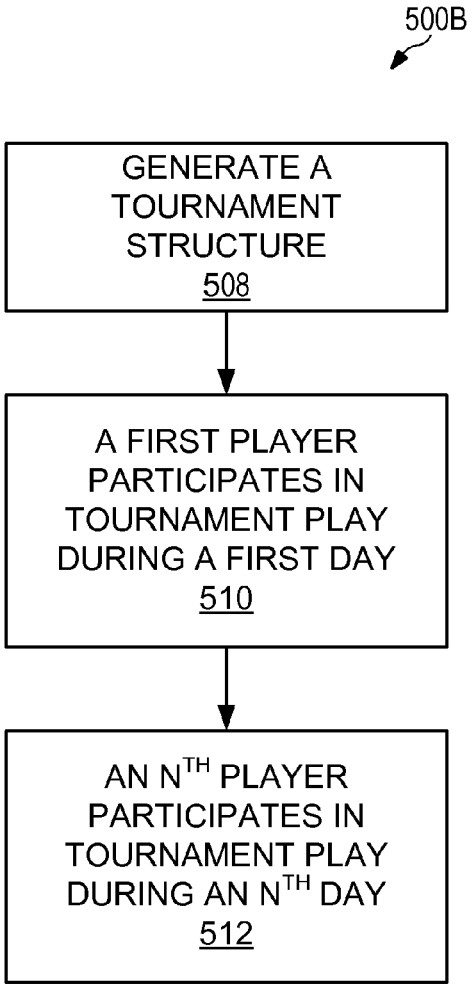
FIG. 5B is another illustration of tournament game play functionality, according to one embodiment.

In FIG. 5B, another flow diagram for asynchronous tournament play 500B is shown, according to one embodiment. The method may include generating one or more tournament structures (step 508). The method may include a first player participating in the one or more tournament structures during a first day (step 510). The method may include an Nth player participating in the one or more tournament structures during an Nth day (step 512). For example, a first player may enter a first tournament at 9 am, enter a second tournament at 9 am, and enter an Nth tournament at 10 am on the first tournament day for the first tournament, the second tournament day for the second tournament, and the last tournament day for the Nth tournament. In this example, the first player may suspend play in the first tournament right after entering the tournament, play in the second tournament from 9 am to 10 am, suspend play in the second tournament at 10 am, start playing in the Nth tournament at 10 am, finish the Nth tournament at 1 pm, resume tournament play in the second tournament at 1 pm, finish tournament play in the second tournament at 3 pm, resume tournament play in the first tournament at 8 am the next day, and/or finish tournament play in the first tournament at noon.

In one embodiment, all participants in a gaming tournament play structure do not need to participate simultaneously. By allowing the participants to play in the tournament over a time period window, the tournament becomes more exciting. In another example, a tournament might last a week and allow for thousands of participants whom play their scored game at any-time during that week. In various examples, this disclosure relates to system and/or method for a gaming tournament where participants play at their leisure during a much longer, i.e. multi-day, tournament period.

These methods may require a new architecture in the gaming tournament server. The features of the system may allow for participants to play their tournament game, at a slot on the casino floor, over the internet, on a mobile device, etc. The tournament management system may collect entries from players and publish leaderboard data to a variety of data consumers.

Figure 6:
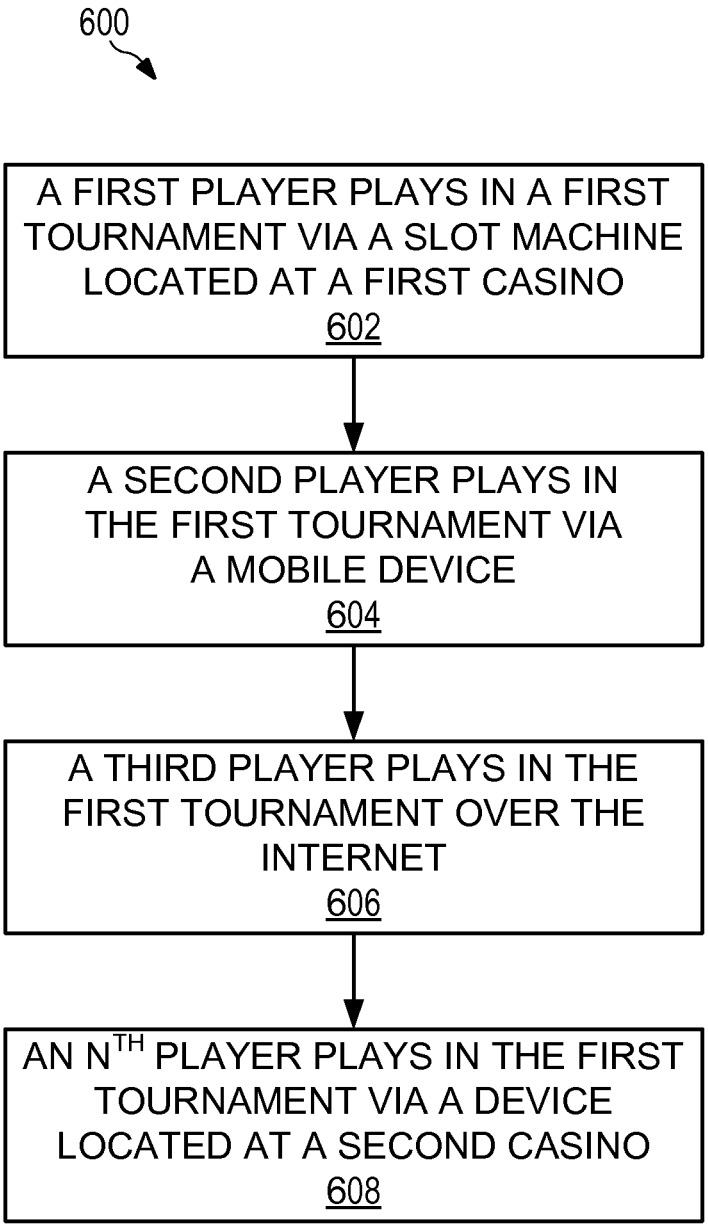
FIG. 6 is an illustration of tournament game play functionality, according to one embodiment.

In FIG. 6, another flow diagram for asynchronous tournament play 600 is shown, according to one embodiment. The method may include a first player playing in a first tournament via a slot machine located at a first casino (step 602). The method may include a second player playing in the first tournament via a mobile device (step 604). The method may include a third player playing in the first tournament over the internet (step 606). The method may include an Nth player playing in the first tournament via a device located at a second casino (step 608). For example, a first player may enter the first tournament at a first time (e.g., 9 am on Monday) by being physically present at the tournament host site. Further, the second player may enter the first tournament at a second time (e.g., 3 am on Tuesday) via a mobile device application. In addition, the third player may enter the first tournament at a third time (e.g., 8 am on Tuesday) via an internet connection to a server. In another example, a fourth player may enter the first tournament at a fourth time (e.g., 10 am on Friday) by being physically present at a non-host site (e.g., satellite site).

In another example, a first player may enter a first tournament at 9 am via a mobile device, enter a second tournament at 9 am in person at a host casino, and enter an Nth tournament at 10 am at a non-host site on the first tournament day for the first tournament, the second tournament day for the second tournament, and the last tournament day for the Nth tournament. In this example, the first player may suspend play in the first tournament right after entering the tournament via a pause button on the mobile device, play in the second tournament from 9 am to 10 am, suspend play in the second tournament at 10 am via a pause button on the gaming device, start playing in the Nth tournament at 10 am, finish the Nth tournament at 1 pm, resume tournament play in the second tournament at 1 pm via a resume button on the gaming device, finish tournament play in the second tournament at 3 pm, resume tournament play in the first tournament at 8 am the next day via a resume function on the mobile, and/or finish tournament play in the first tournament at noon.

It should be noted that this disclosure may also be utilized with one or more tournament structures where the tournament is held at one place during one time period and all of the participants play at the same time (e.g., synchronous).

Figure 7A:
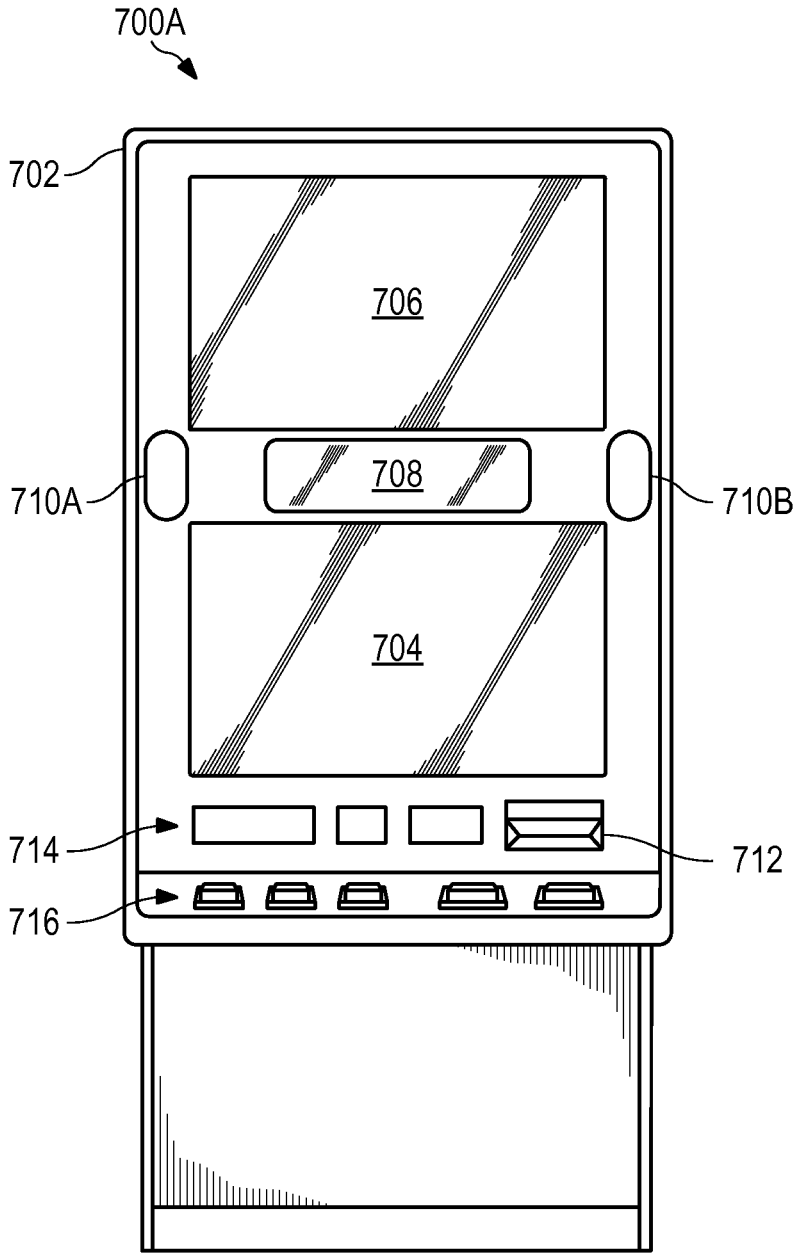
FIG. 7A is an illustration of advertising space utilized with tournament game play functionality, according to one embodiment.
Figure 7B:
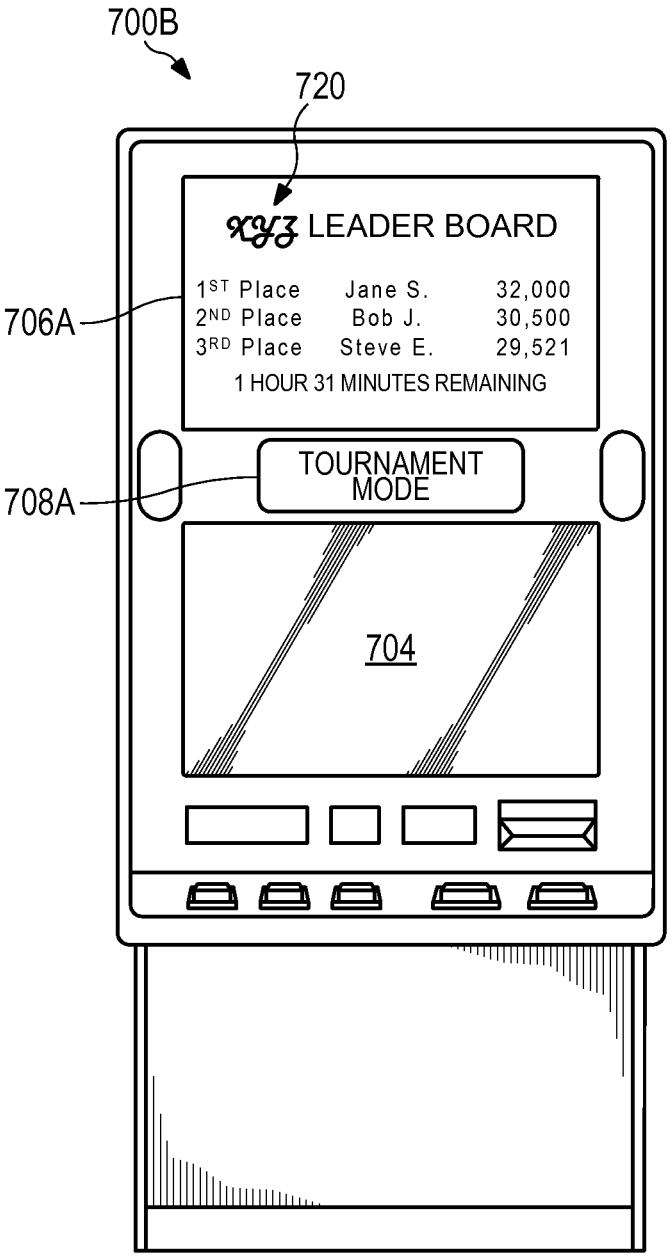
FIG. 7B is another illustration of advertising space utilized with tournament game play functionality, according to one embodiment.

In FIG. 7A, an illustration of advertising space utilized with tournament game play functionality 700A is shown, according to one embodiment. A gaming device 702 may include a leaderboard display 706, a side display 708, a main game display 704, a left speaker 710A, a right speaker 710B, one or more output devices (e.g., a ticket in/ticket out device 712), and/or one or more input devices 716 (e.g., buttons, etc.). In one example, leadership display 706 includes a leadership board sponsor 720 and a ranking of tournament players 706A (see FIG. 7B). In this example, the XYZ company has sponsored the leadership board and the leadership board states "XYZ LEADER BOARD." In another example, leadership display 706 may include data relating to one or more tournaments, such as, the time remaining (e.g., 1 HOUR 31 MINUTES REMAINING). In this example, side display 708 may display a current mode of operation 708A. For example, a current mode may be a tournament mode, a normal mode, a practice mode, a team mode, an individual mode, any combination thereof, etc.

Figure 7C:
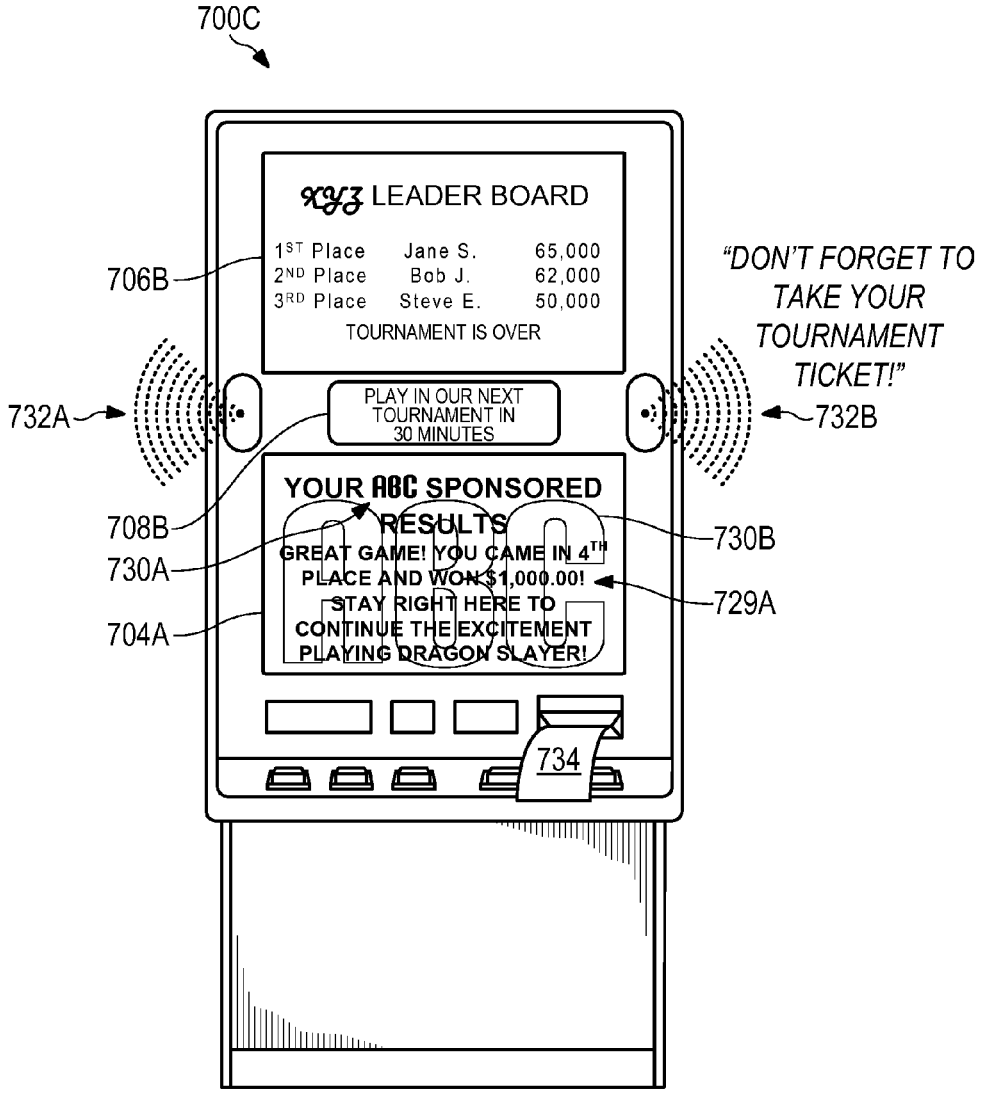
FIG. 7C is another illustration of advertising space utilized with tournament game play functionality, according to one embodiment.

In FIG. 7C, another illustration of advertising space utilized with tournament game play functionality 700C is shown, according to one embodiment. In this example, electronic gaming device 100 may utilize a ranking of tournament players 706B, a next tournament message area 708B, an individual results sponsor 730A (located in a main display area 704A), an individual game results message 729A, a background sponsor symbol 730B, and a tournament results voucher 734. Electronic gaming device 100 may communicate (e.g., audio communication and/or visual communication) with the player. In one example, electronic gaming device 100 may utilize one or more reminder messages. For example, to ensure that the player takes their tournament ticket, a message such as "DON'T FORGET TO TAKE YOUR TOURNAMENT TICKET!" may be transmitted via one or more speakers (e.g., reference numbers 732A, 732B, etc.). In another example, next tournament message area 708B may communicate information relating to one or more future tournaments. The message may state "PLAY IN OUR NEXT TOURNAMENT IN 30 MINUTES." The one or more future tournaments may occur later in the current day, tomorrow, and/or any other time period.

In one example, ranking of tournament players 706B may include data (e.g., top scores, number of players, name of top players, status of a tournament (e.g., beginning, time remaining, ended, etc.), asynchronous tournament data, synchronous tournament data, tournament structure data, etc.) relating to one or more tournament players.

In another example, next tournament message area 708B may include data relating to one or more future tournaments. The one or more future tournaments may be asynchronous tournaments, synchronous tournaments, high-limit tournaments, any other tournament structure, and these tournaments may occur at any time (e.g., today, tomorrow, five days from now, next month, etc.).

Figure 7D:
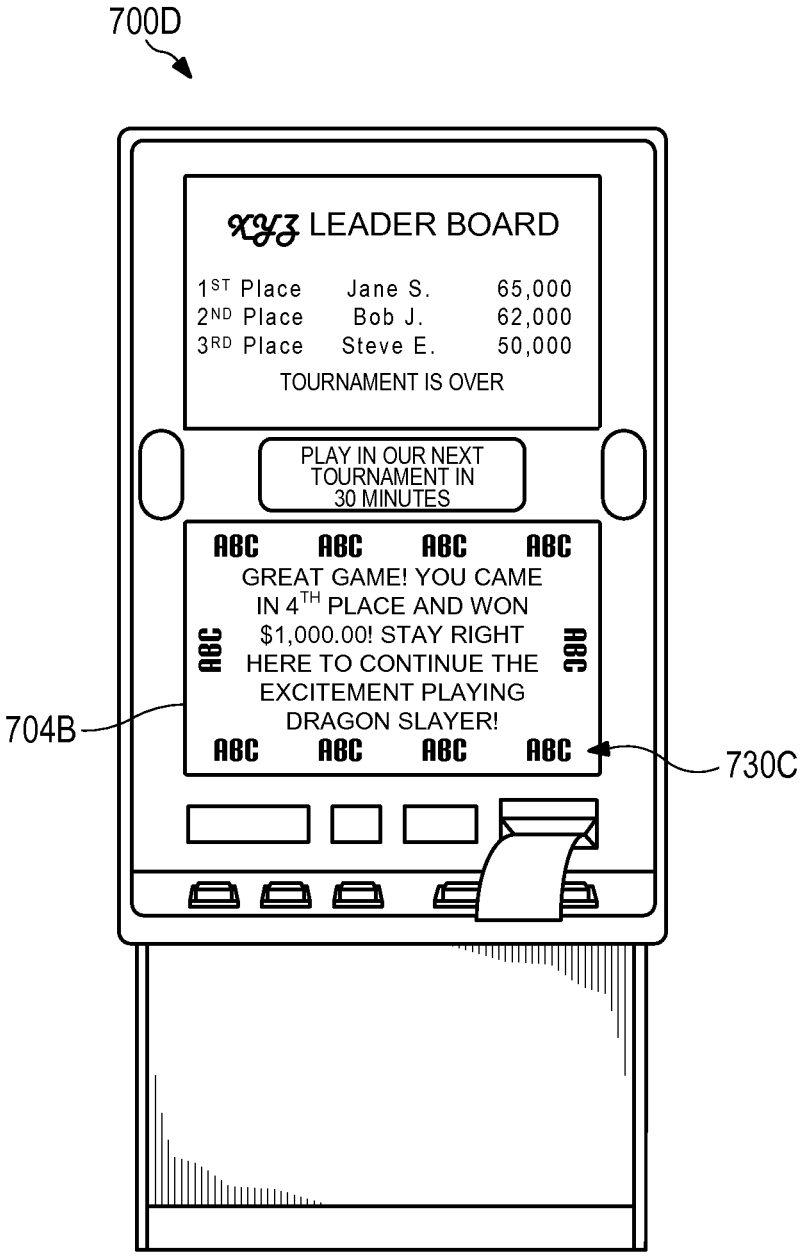
FIG. 7D is another illustration of advertising space utilized with tournament game play functionality, according to one embodiment.

In another example, individual results sponsor 730A located in a main display area 704A may include one or more individual sponsors where the one or more sponsor information may be displayed on the main display area, the next tournament message area, the leaderboard area, a side screen, and/or any other screen. In another example, the sponsor information may be background text, phantom text, board text (see FIG. 7D), and/or any other text. In one example, the one or more sponsors' information may also be displayed on one or more non-gaming devices, casino signage, external-casino signage, and/or any other display device.

In one example, individual game results message 729A may include data relating to the one or more of the individual's tournament results. For example, the message may state "YOUR ABC SPONSORED RESULTS GREAT GAME! YOU CAME IN $4^{TH}$ PLACE AND WON $1,000.00! STAY RIGHT HERE TO CONTINUE THE EXCITEMENT PLAYING DRAGON SLAYER!" In another example, the individual game results may include data relating to the player's winning percentage, the number of spins completed, the highest win, the average winning amount, etc.

In another example, background sponsor symbol 730B may include sponsor data which is placed in the background of one or more display screens.

Figure 8:
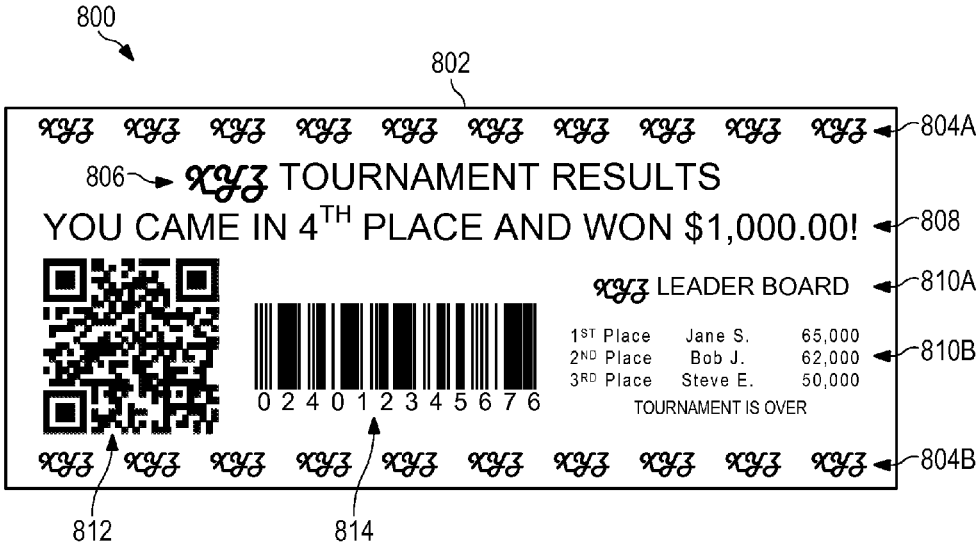
FIG. 8 is an illustration of an advertising space on a gaming voucher, according to one embodiment.

In another example, tournament results voucher 734 may include data relating to one or more tournament gaming results (see FIG. 8).

Figure 7E:
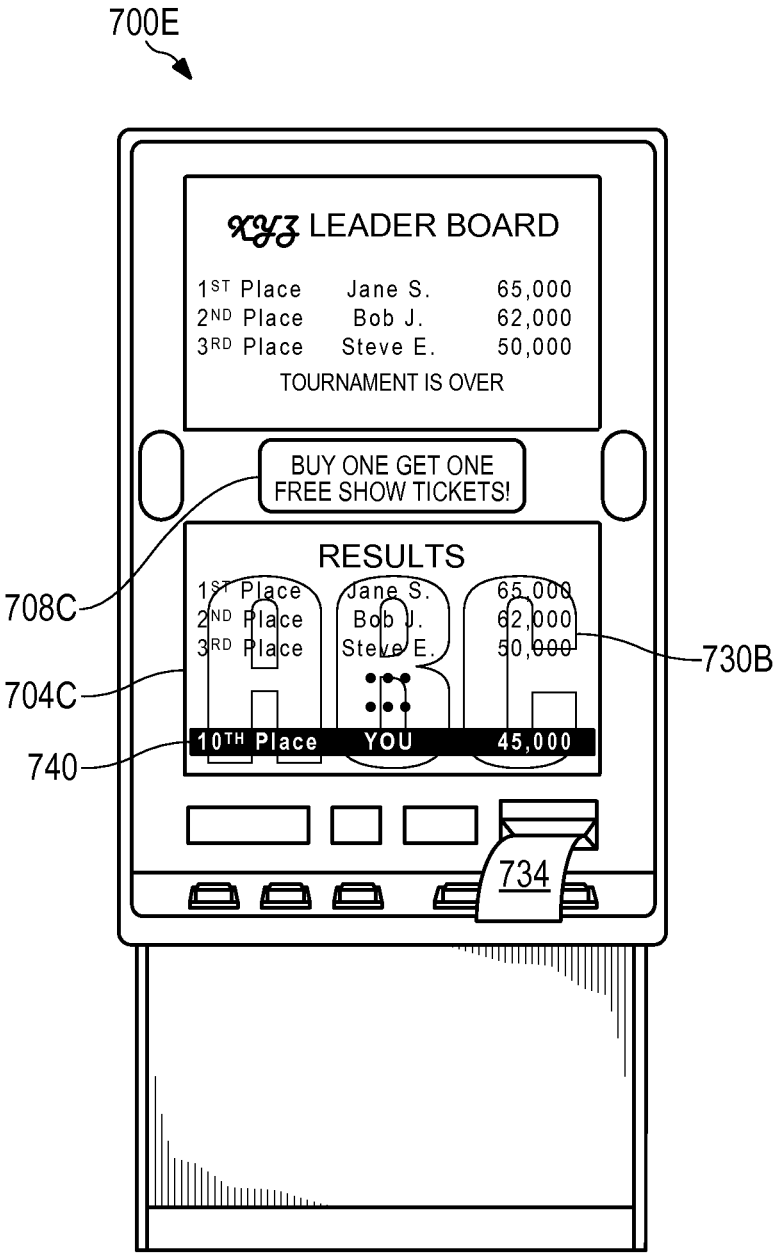
FIG. 7E is another illustration of advertising space utilized with tournament game play functionality, according to one embodiment.

In FIG. 7E, another illustration of advertising space utilized with tournament game play functionality 700E is shown, according to one embodiment. In this example, electronic gaming device 100 may utilize a message area 708C, a main gaming area 704C, a leader list 730B, and an individual place 740.

Message area 708C may include one or more advertisements. In one example, message area 708C may offer a buy one get one free advertisement (e.g., shows, food, entertainment, lodging, etc.). In another example, the advertisement may be a free offer, a percentage off offer, and/or any other advertisement offering.

Leader list 730B may include data (e.g., top scores, number of players, name of top players, status of tournament (e.g., beginning, time remaining, ended, etc.), asynchronous tournament data, synchronous tournament data, tournament structure data, etc.), and/or any other data relating to one or more tournament players.

Individual place 740 may include data relating to the individual's tournament placement, the individual's prize amount, the individual's time to complete the tournament, and/or any other data relating to the individual player. This area may be highlighted to enhance the player's ability to find their tournament placement.

Figure 7F:
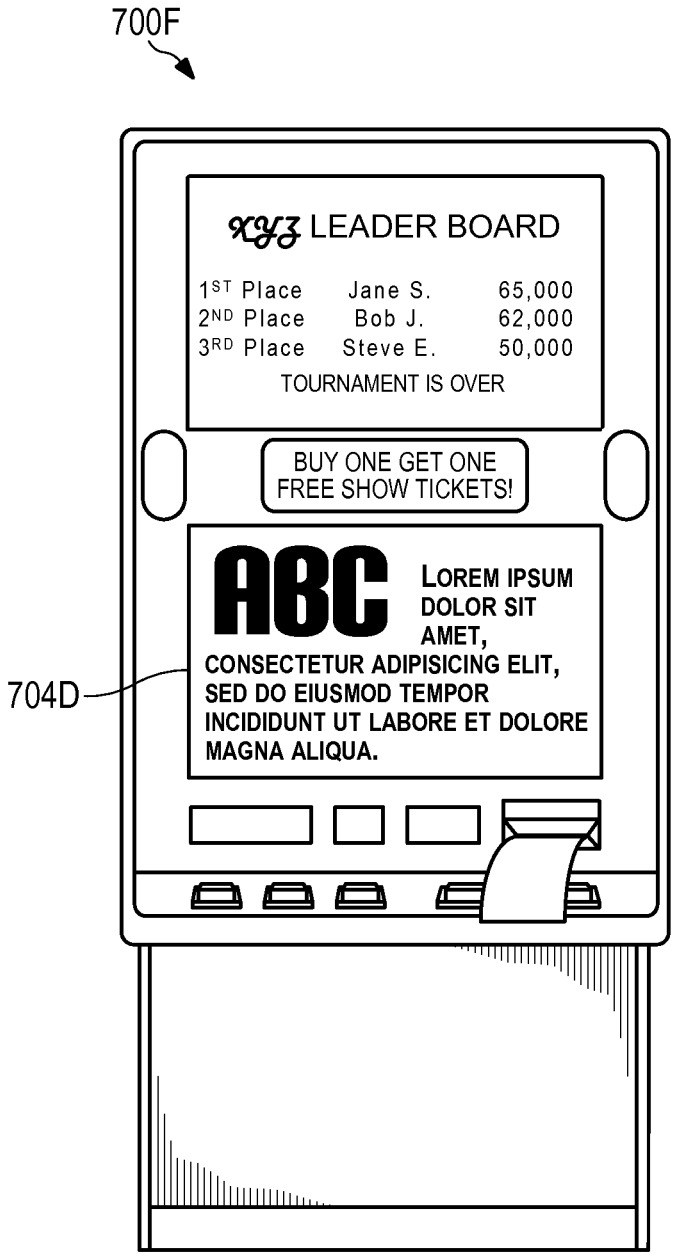
FIG. 7F is another illustration of advertising space utilized with tournament game play functionality, according to one embodiment.
Figure 7G:
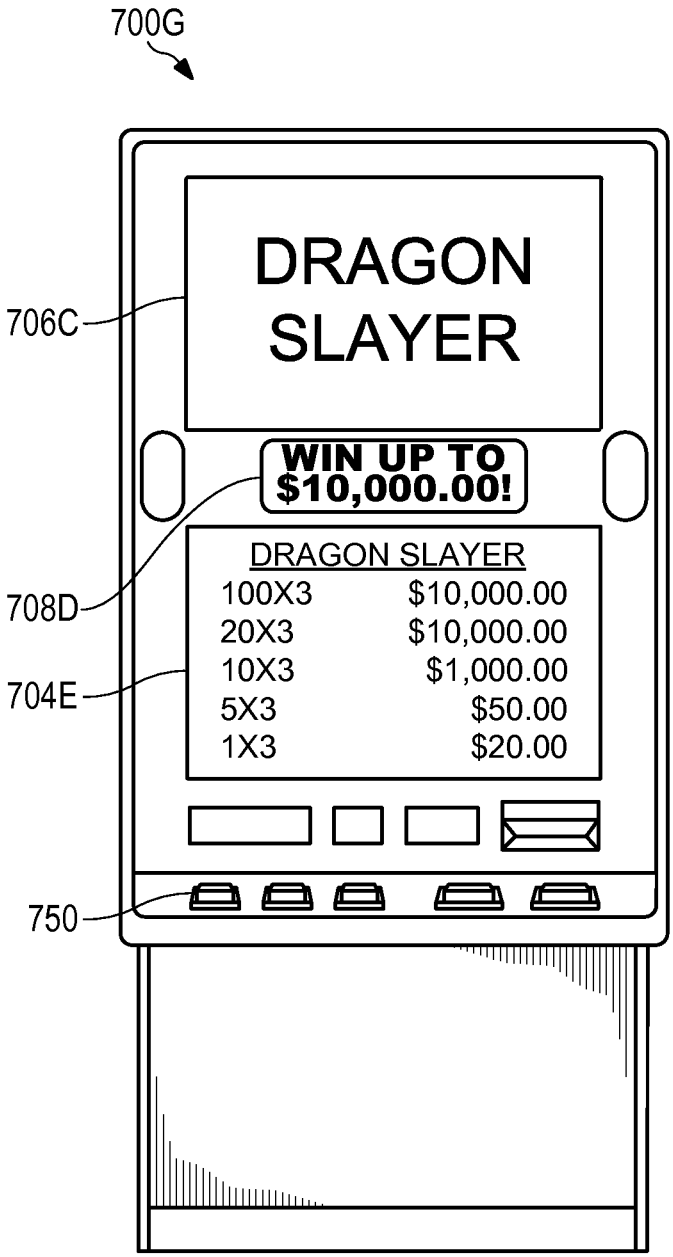
FIG. 7G is another illustration of advertising space utilized with tournament game play functionality, according to one embodiment.

In another example shown in FIG. 7F, one or more advertisements 704D may be displayed on any display screen of electronic gaming device 100 when transitioning from a tournament mode to a normal game operating mode. In this example, the one or more advertisements may occur before gaming system moves to a normal gaming mode (see FIG. 7G). In this example, a game title area 706C may include one or more game titles. Further, one or more gaming data (e.g., reference numbers 704E and 708D) may be displayed. In addition, one or more input devices 750 may be utilized by the player, the casino personnel, and/or any other individual to play the game and/or transition the game from a tournament mode to a normal game play mode. In another example, one or more advertisements may be displayed during tournament play, before tournament play, and/or after tournament play.

In FIG. 8, an illustration of an advertising space on a gaming voucher 800 is shown, according to one embodiment. A gaming voucher 802 may include a first sponsor title advertising area 806, one or more tournament results 808, a top boarder advertising area 804A, a bottom boarder advertising area 804B, a sponsor leaderboard area 810A, one or more leader board data 810B, a QR bar code area 812, and a bar code area 814.

First sponsor title advertising area 806 may include data relating to one or more main tournament sponsors. For example, a beverage company may sponsor one or more tournaments and be the main sponsor of this specific tournament. In another example, a golf equipment manufacturer may be the main sponsor. In various examples, any company (e.g., vacation rentals, casinos, online gaming companies, etc.) may be the main sponsor, a junior sponsor, item sponsor, prize sponsor, and/or a minor sponsor of a tournament.

One or more tournament results 808 may include data relating to the tournament placement, prize amount, time to complete the tournament, and/or any other data relating to the individual player. This area may be highlighted to enhance the player's ability to find their tournament placement.

Top boarder advertising area 804A may include data relating to one or more tournament sponsors. For example, a beverage company may sponsor one or more tournament and be a sponsor of this specific tournament. In another example, a golf equipment manufacturer may be a sponsor of this specific tournament. In various examples, any company (e.g., vacation rentals, casinos, online gaming companies, etc.) may be the main sponsor, a junior sponsor, item sponsor, prize sponsor, and/or a minor sponsor.

Bottom boarder advertising area 804B may include data relating to one or more tournament sponsors. For example, a beverage company may sponsor one or more tournament and be a sponsor of this specific tournament. In another example, a golf equipment manufacturer may be a sponsor of this specific tournament. In various examples, any company (e.g., vacation rentals, casinos, online gaming companies, etc.) may be the main sponsor, a junior sponsor, item sponsor, prize sponsor, and/or a minor sponsor.

Sponsor leaderboard area 810A may be sponsored by one or more sponsors and may display data (e.g., top scores, number of players, name of top players, status of tournament (e.g., beginning, time remaining, ended, etc.), asynchronous tournament data, synchronous tournament data, tournament structure data, etc.) relating to one or more tournament players (see one or more leader board data 810B).

QR bar code area 812 may be utilized by the player via a smartphone to obtain more tournament information, cash in their prize, sign-up for additional tournaments, schedule another tournament, book a hotel room, receive one or more advertisements and/or offers, obtain a credit line, book a restaurant reservation, and/or obtain any other service.

Bar code area 814 may be utilized by the player via one or more devices to obtain more tournament information, cash in their prize, sign-up for additional tournaments, schedule another tournament, book a hotel room, receive one or more advertisements and/or offers, obtain a credit line, book a restaurant reservation, and/or obtain any other service.

Figure 9A:
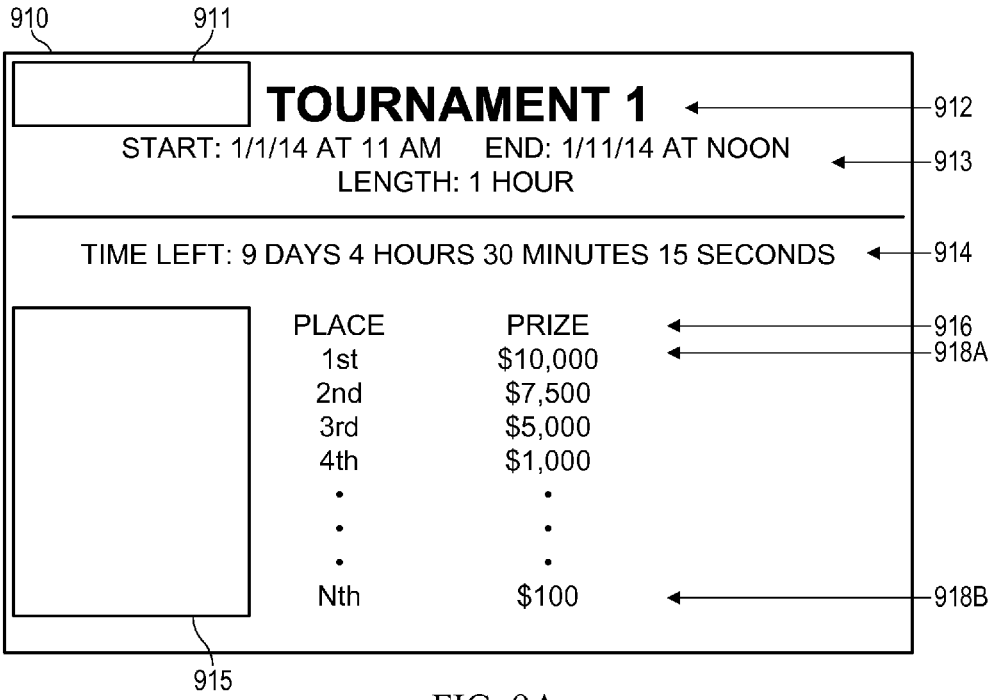
FIG. 9A is an illustration of displaying one or more tournament game play data, according to one embodiment.

In FIG. 9A, an illustration of a display utilized in asynchronous tournament play is shown, according to one embodiment. In one example, a first display image 910 may include a tournament title area 912, a tournament characteristics area 913, a tournament status area 914, a prize breakdown area 916, a first prize area 918A, an Nth prize area 918B, a first advertisement area 911, and a second advertisement area 915. In one example, tournament title area 912 may include the tournament name, one or more tournament locations, the number of tournament players, etc. In another example, tournament characteristic area 913 may include the start time of the tournament, the end time of the tournament, the length of the tournament, one or more tournament windows, the last entry time, the cost of the tournament, etc. In another example, tournament status area 914 may include the time left for the tournament, the time left to enter the tournament, the number of players registered for the tournament, the number of registered players that have completed the tournament, the number of registered players that still need to complete the tournament, the number of registered players that are currently participating in the tournament, etc. In another example, prize breakdown area 916 may include one or more places (e.g., 1-N) and one or more prizes (e.g., first prize area 918A to Nth prize area 918B).

First advertisement area 911 may include one or more advertisements and/or sponsor data. In one example, the one or more advertisements may offer a buy one get one free advertisement (e.g., shows, food, entertainment, lodging, etc.). In another example, the advertisement may be a free offer, a percentage off offer, and/or any other advertisement offering. In another example, the advertisements and/or sponsor data may be based on player preferences, player data, player demographics, and/or any other customizable data. In another example, the advertisements and/or sponsor data may be displayed at a first tournament time (e.g., beginning), at a second tournament time (e.g., a break period), at a third tournament time (e.g., 10 minutes into the tournament), at a fourth tournament time (e.g., at the end), and/or any other time period. Further, the advertisement and/or sponsor data may be related to any theme, promotion, a special event, and/or any other item.

Second advertisement area 915 may include one or more advertisements and/or sponsor data. In one example, the one or more advertisements may offer a buy one get one free advertisement (e.g., shows, food, entertainment, lodging, etc.). In another example, the advertisement may be a free offer, a percentage off offer, and/or any other advertisement offering. In another example, the advertisements and/or sponsor data may be based on player preferences, player data, player demographics, and/or any other customizable data. In another example, the advertisements and/or sponsor data may be displayed at a first tournament time (e.g., beginning), at a second tournament time (e.g., a break period), at a third tournament time (e.g., 10 minutes into the tournament), at a fourth tournament time (e.g., at the end), and/or any other time period. Further, the advertisement and/or sponsor data may be related to any theme, promotion, a special event, and/or any other item.

Signage module 422 may utilize data from any module, any other server (e.g., statistics server 418 and/or signage server), and/or any other data source to generate images for display on: electronic gaming device 100; an internal display device within a gaming entity; an external display device outside of a gaming entity; one or more devices at one or more satellite locations; one or more mobile devices; one or more Internet sites; and/or any combination thereof.

In another example, a method may include obtaining data from one or more gaming devices and/or tournament servers. The method may also include generating historical data for the one or more gaming devices and/or tournament servers. The method may include generating a message for the one or more gaming devices, outside signage, inside displays, and/or any other device based on the historical data. The method may include displaying an image based on the message.

Figure 9B:
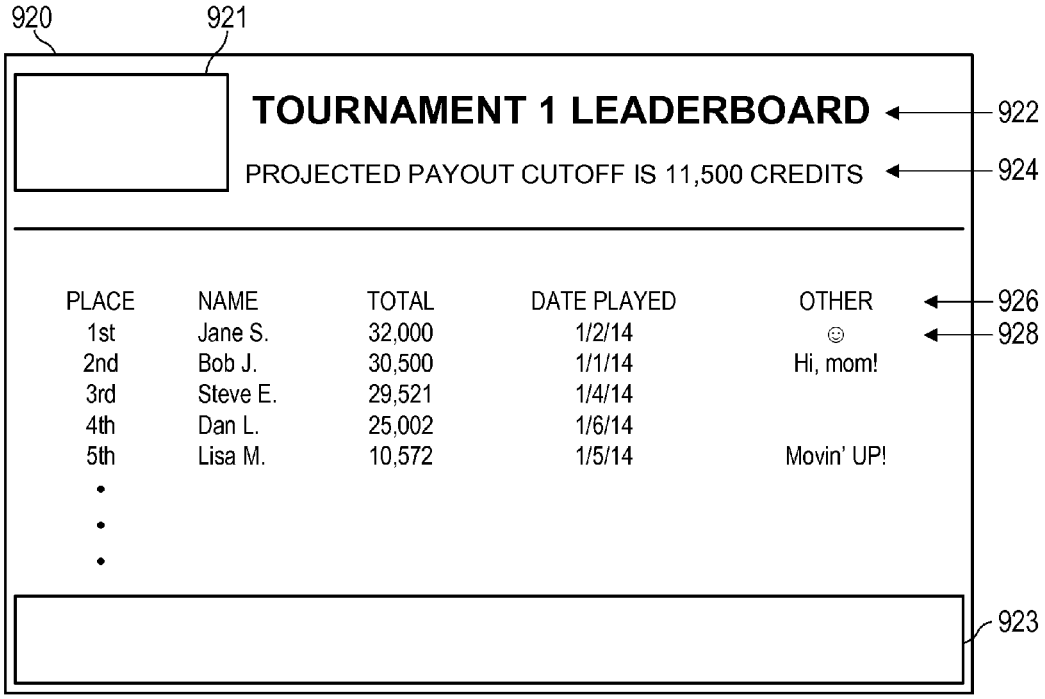
FIG. 9B is another illustration of displaying one or more tournament game play data, according to one embodiment.

In FIG. 9B, another illustration of a display utilized in asynchronous tournament play is shown, according to one embodiment. A second display 920 may include a tournament leaderboard title area 922, a player cutoff area 924, a category area 926, one or more data areas 928, and a third advertisement area 921. Tournament leaderboard title area 922 may include the tournament's title, the current leader's name, the current leader's score, the payout for winning the tournament, the entry fee, the deadline for entering, one or more locations to play in the tournament, etc. Player cutoff area 924 may include data relating to the estimated score needed to obtain one or more prizes. Category area 926 may include player placement data (e.g., ranking from first to last), one or more players names relating to the one or more rankings, one or more total scores relating to the one or more players and/or rankings, one or more play dates relating to the one or more players and/or rankings, and/or a remarks area. One or more data areas 928 may include the ranking numbers (e.g., $1^{st}$ to Nth), one or more player names, one or more scores, one or more dates played, and/or one or more other player comments (e.g., a smiley face, Hi Mom!, Moving Up!, Cannot Lose, etc.).

Third advertisement area 921 may include one or more advertisements and/or sponsor data. In one example, the one or more advertisements may offer a buy one get one free advertisement (e.g., shows, food, entertainment, lodging, etc.). In another example, the advertisement may be a free offer, a percentage off offer, and/or any other advertisement offering. In another example, the advertisements and/or sponsor data may be based on player preferences, player data, player demographics, and/or any other customizable data. In another example, the advertisements and/or sponsor data may be displayed at a first tournament time (e.g., beginning), at a second tournament time (e.g., a break period), at a third tournament time (e.g., 10 minutes into the tournament), at a fourth tournament time (e.g., at the end), and/or any other time period. Further, the advertisement and/or sponsor data may be related to any theme, promotion, a special event, and/or any other item.

In one example, the leaderboard data may be utilized by casino signage showing tournament standings during the tournament period at the casino. In another example, the leadership data may be utilized by a webpage showing the same information. Further, a billboard external to the casino might advertise the leaderboard standings, have a tournament countdown, entry information, etc. In another example, social media websites may utilize this data (see FIG. 9D).

Figure 9C:
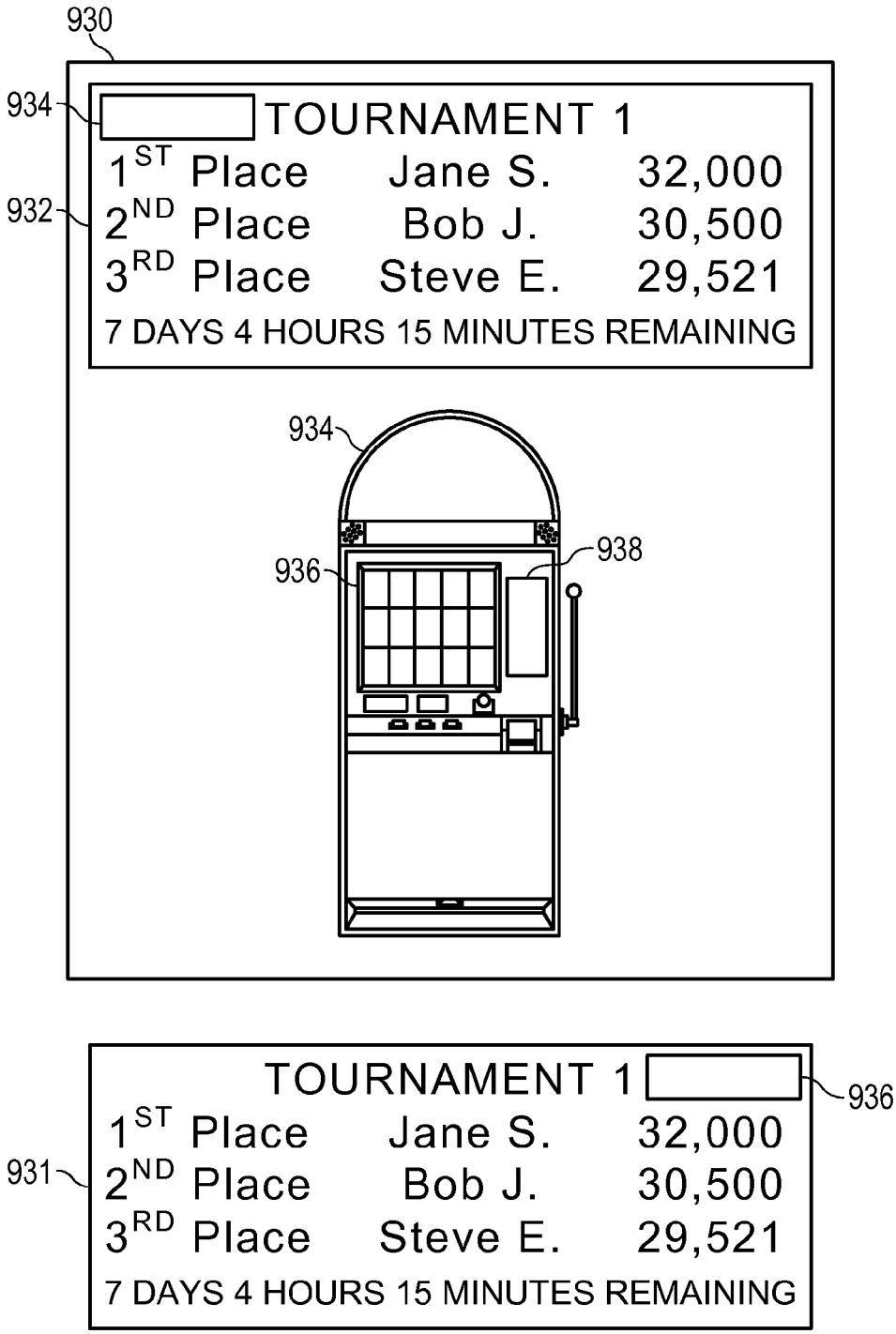
FIG. 9C is another illustration of displaying one or more tournament game play data, according to one embodiment.

In FIG. 9C, another illustration of a display utilized in asynchronous tournament play is shown, according to one embodiment. A third image 930 may include a gaming device tournament display area 932, a gaming device 934, gaming slot area 936, a gaming message area 938, a fourth advertisement area 934, and a fifth advertisement area 936. Gaming device tournament display area 932 may be located anywhere on gaming device (e.g., one or more displays, gaming message area 938, etc.). Gaming device tournament display are 932 may include data relating to the tournaments name, the current leaderboard, the ending time of the tournament, the number of players left, the amount of time left in the tournament, one or more prizes, the names and scores of one or more leaders, etc. In another example, a tournament display screen 931 may be located in one or more locations within the casino. Tournament display screen 931 may include data relating to the tournaments name, one or more locations to sign up for the tournament, the current leaderboard, the ending time of the tournament, the number of players left, the amount of time left in the tournament, one or more prizes, the names and scores of one or more leaders, etc.

Fourth advertisement area 934 may include one or more advertisements and/or sponsor data. In one example, the one or more advertisements may offer a buy one get one free advertisement (e.g., shows, food, entertainment, lodging, etc.). In another example, the advertisement may be a free offer, a percentage off offer, and/or any other advertisement offering. In another example, the advertisements and/or sponsor data may be based on player preferences, player data, player demographics, and/or any other customizable data. In another example, the advertisements and/or sponsor data may be displayed at a first tournament time (e.g., beginning), at a second tournament time (e.g., a break period), at a third tournament time (e.g., 10 minutes into the tournament), at a fourth tournament time (e.g., at the end), and/or any other time period. Further, the advertisement and/or sponsor data may be related to any theme, promotion, a special event, and/or any other item.

Fifth advertisement area 936 may include one or more advertisements and/or sponsor data. In one example, the one or more advertisements may offer a buy one get one free advertisement (e.g., shows, food, entertainment, lodging, etc.). In another example, the advertisement may be a free offer, a percentage off offer, and/or any other advertisement offering. In another example, the advertisements and/or sponsor data may be based on player preferences, player data, player demographics, and/or any other customizable data. In another example, the advertisements and/or sponsor data may be displayed at a first tournament time (e.g., beginning), at a second tournament time (e.g., a break period), at a third tournament time (e.g., 10 minutes into the tournament), at a fourth tournament time (e.g., at the end), and/or any other time period. Further, the advertisement and/or sponsor data may be related to any theme, promotion, a special event, and/or any other item.

Figure 9D:
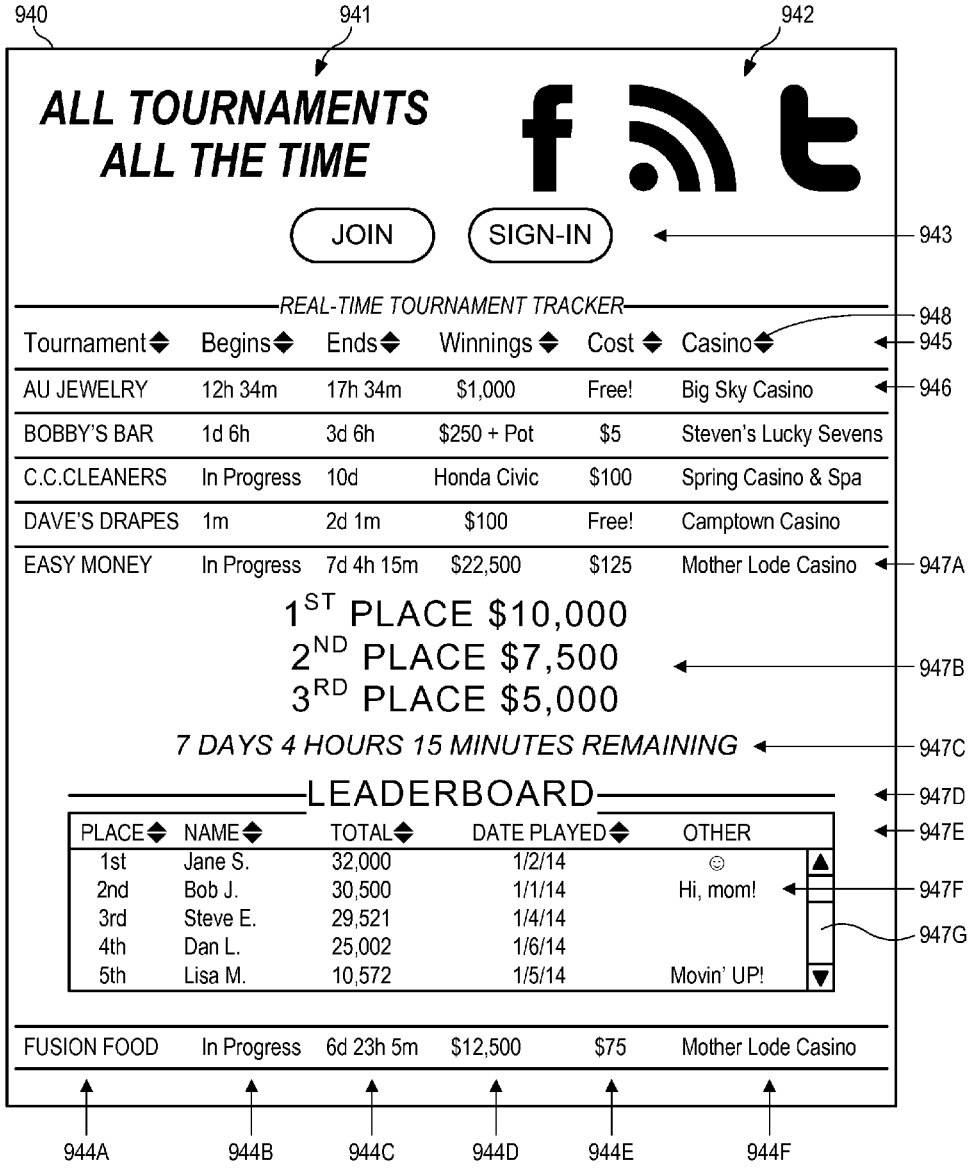
FIG. 9D is another illustration of displaying one or more tournament game play data, according to one embodiment.

In FIG. 9D, another illustration of a display utilized in asynchronous tournament play is shown, according to one embodiment. A fourth image 940 may include tournament areas 941, one or more links 942, one or more join areas 943, one or more tournament information scrolls 945, one or more scrollers 948, one or more tournaments details 946, a detailed tournament area 947A, a detailed payout structure 947B, a detailed tournament remaining period 947C, a detailed leaderboard 947D, one or more leaderboard data 947F, a leaderboard scroll 947G, a tournament name area 944A, a tournament status 944B, a tournament remaining period 944C, a tournament prize area 944D, a tournament entry fee 944E, and one or more tournament location 944F.

Tournament areas 941 may include data relating to one or more tournament titles, one or more tournament structures, and/or any other information relating to one or more tournaments.

One or more links 942 may include links to one or more general social sites (e.g., Facebook, Twitter, etc.), one or more sporting events (e.g. ESPN, etc.), one or more casino specific social sites, etc. One or more join areas 943 may include a join link, a sign-in button, a sign-off button, etc.

One or more tournament information scrolls 945 may show high-level information relating to one or more tournaments where a user can select one or more of these tournaments to obtain more detailed information relating to the one or more tournaments. One or more scrollers 948 may allow a user to scroll up and/or down a list of tournaments. One or more tournaments details 946 may include tournament data, such as, the tournament name, when the tournament begins, when the tournament ends, the prize structure, the tournament entry fee, the tournament location, one or more venues to enter (e.g., mobile device, mobile application, satellite locations, etc.), and/or any other tournament data.

Detailed tournament area 947A may include more tournament data, such as tournament name area 944A, the leaderboard (e.g., detailed leaderboard 947D), a detailed prize structure (e.g., tournament prize area 944D and/or detailed payout structure 947B), the tournament players, the tournament leaders (e.g., one or more leaderboard data 947F), one or more entry times, the last entry time, the entry fee (e.g., tournament entry fee 944E), the length of the tournament, the remaining tournament time (e.g., tournament remaining period 944C and/or detailed tournament remaining period 947C), tournament status 944B, one or more tournament venues (e.g., one or more tournament locations 944F), and/or any other tournament data, which may be accessed via leaderboard scroll 947G.

In one example, when groups participate, the performance of individual members might be awarded differently based on a variety of metrics such as, fastest member (most plays), luckiest member (best win ratio), first to enter score, etc. In various examples, the tournament structure may allow individuals to compete against individuals, teams to compete against individuals, and/or teams to compete against teams.

Figure 9E:
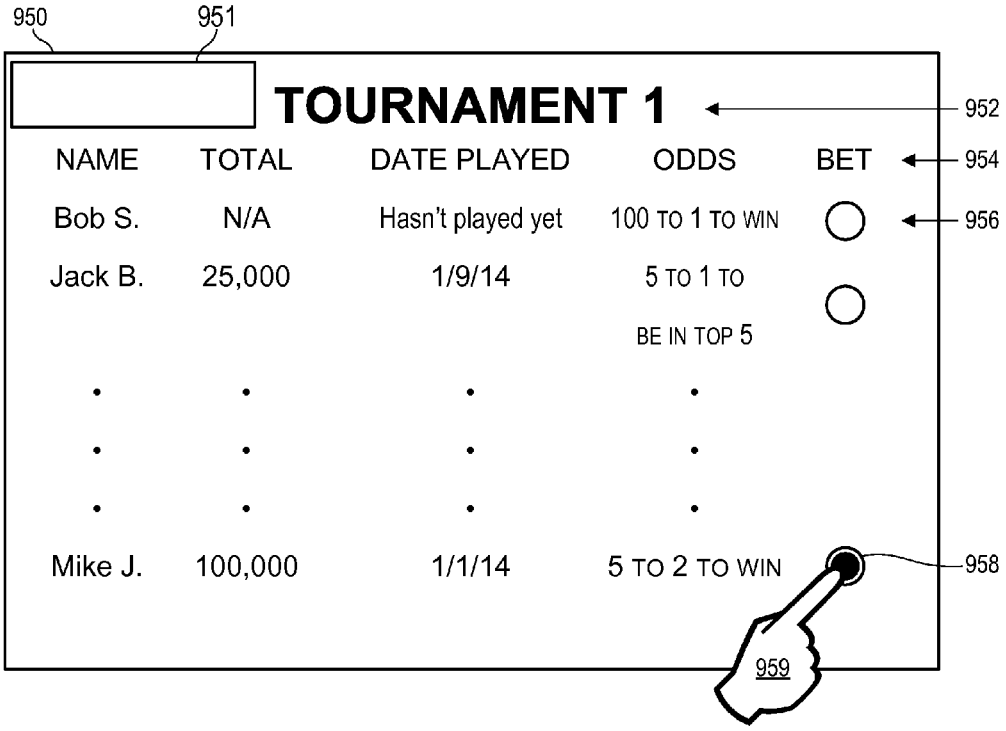
FIG. 9E is another illustration of displaying one or more tournament game play data, according to one embodiment.

In FIG. 9E, an illustration of one or more side-betting options utilized in asynchronous tournament play is shown, according to one embodiment. A fifth image 950 may include a tournament title area 952, one or more side-bet criteria 954, one or more side-bet options 956, a selected side-bet 958, and a sixth advertisement area 951.

Tournament title area 952 may include data relating to one or more tournament titles. One or more side-bet criteria 954 may include the name of the person and/or team relating to the side-bet, the scores for one or more players and/or teams, the status for one or more players and/or teams, the side-bet odds, and a side-bet button (e.g., one or more side-bet options 956) to indicate a side bet (e.g., selected side-bet 958).

In this example, the management system may allow for side-betting on the results of the tournament. Also, the management system may allow for tournament participants to be groups where an all-group tournament could be scored based on group total scores. Conversely, groups and individuals could participate in a tournament together where, groups compete with their collective average against individual scores (see FIG. 9F). The management system may award individual tournament participants and/or group participants for similar metrics. Further, individual tournament participants and/or group participants may compete against each other.

Sixth advertisement area 951 may include one or more advertisements and/or sponsor data. In one example, the one or more advertisements may offer a buy one get one free advertisement (e.g., shows, food, entertainment, lodging, etc.). In another example, the advertisement may be a free offer, a percentage off offer, and/or any other advertisement offering. In another example, the advertisements and/or sponsor data may be based on player preferences, player data, player demographics, and/or any other customizable data. In another example, the advertisements and/or sponsor data may be displayed at a first tournament time (e.g., beginning), at a second tournament time (e.g., a break period), at a third tournament time (e.g., 10 minutes into the tournament), at a fourth tournament time (e.g., at the end), and/or any other time period. Further, the advertisement and/or sponsor data may be related to any theme, promotion, a special event, and/or any other item.

In FIG. 9F, another illustration of a display utilized in asynchronous tournament play is shown, according to one embodiment. A sixth image 960 may include one or more team and/or individual criteria area 962, a first team data area 964, a first individual player area 966, and an Nth team data area 968.

One or more team and/or individual criteria area 962 may include a name category, a score category, a date category, a status category, and/or an average score category. First team data area 964 may include the first team's name, the first team's total score, the first team's playing history in this tournament, the first team's status, and/or the first team's average score. First individual player area 966 may include the individual's name, the individual's score, the individual's history in this tournament, the individual's status, and the individual average score. Nth team data area 968 may include the Nth team's name, the Nth team's total score, the Nth team's playing history in this tournament, the Nth team's status, and/or the Nth team's average score. In one example, an individual may compete against a team by comparing the average scores for both the individual and the team to determine a winner.

In another example, when one or more individuals and/or one or more groups compete against each other, a group's score may be determined by the team average. In another example, the group's score may be determined by averaging the players' scores, unless the player's score is zero, in which case the zero score may be excluded when determining the group's average score. For example, a group of four players where a first player's score is 100,000; a second player's score is 50,000; a third player's score is 150,000; and a fourth player's score is 0, then the group's average would be 100,000 (e.g., 100,000+50,000+150,000 divided by 3). In another example, the group's average may include one or more player scores that are zero. For example, a group of four players where a first player's score is 100,000; a second player's score is 50,000; a third player's score is 150,000; and a fourth player's score is 0, then the group's average would be 75,000 (e.g., 100,000+50,000+150,000 divided by 4).

Figure 10:
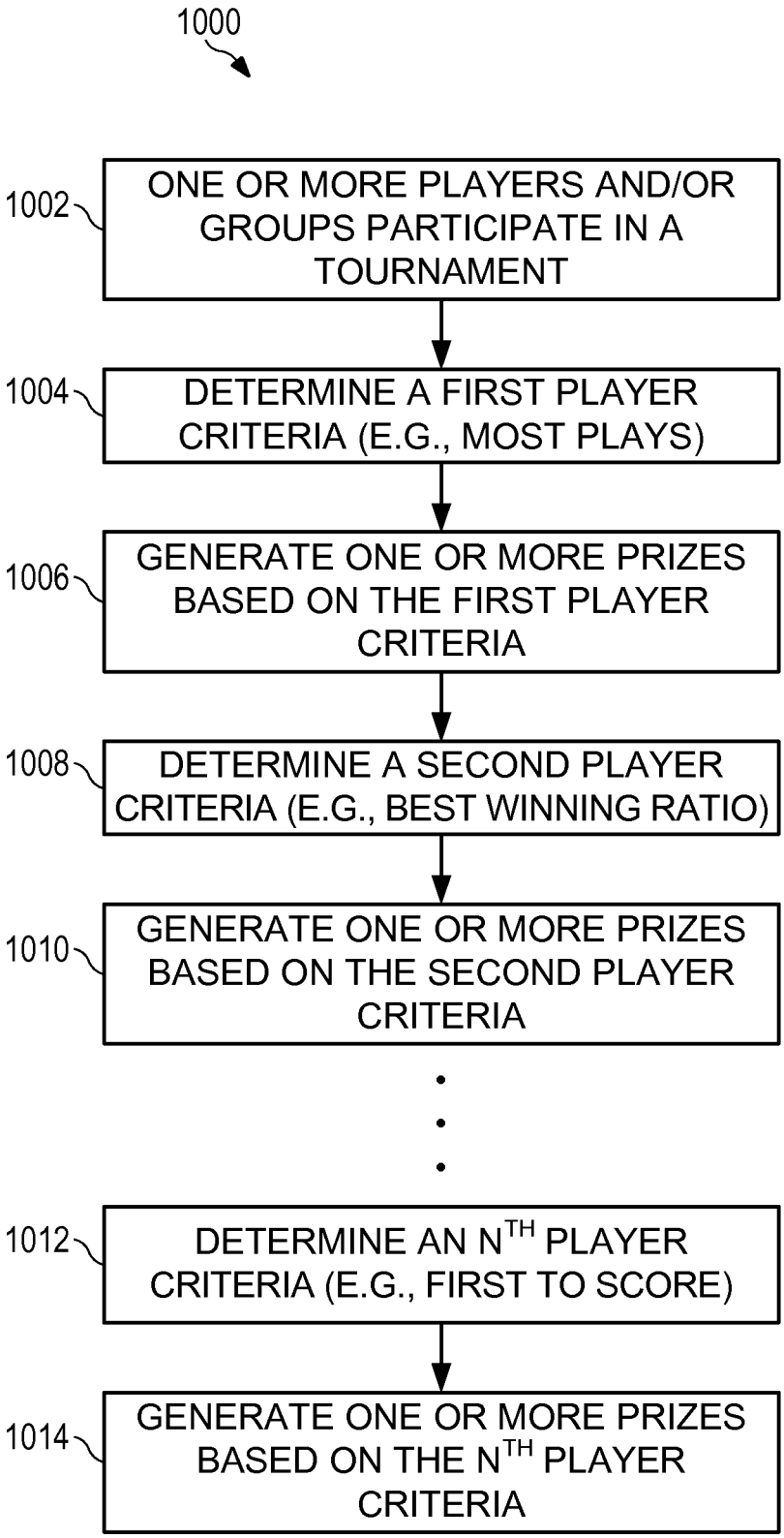
FIG. 10 is a flow diagram for tournament game play, according to one embodiment.

In FIG. 10, another flow diagram of asynchronous tournament play 10 is shown, according to one embodiment. The method may include one or more players and/or one or more groups (e.g., teams) participating in one or more tournaments (e.g., step 1002). The method may include determining a first player criteria and/or first tournament criteria (step 1004). In one example, the first player criteria and/or first tournament criteria may be the most plays (e.g., fastest player). In another example, the first player criteria and/or first tournament criteria may be least plays (e.g., slowest player). In another example, the first player criteria and/or first tournament criteria may be the first to win a specific prize on a spin—the first player to win 1,000 credits, the first player to win 100 credits twice, the first player to win 10 free spins, the first player to win 500 credits with a 2× multiplier, the first player to win 1,000 credits, 5 free spins, and a scatter bonus, etc. The method may include generating one or more prizes based on the first player criteria and/or the first tournament criteria (step 806). In various examples, any prize and/or item of value may be generated for achieving the first player criteria and/or the first tournament criteria. Various examples include money (e.g., $50, $100, etc.), free play, free future tournament entry, free current tournament entry, free hotel room, free food, free entertainment, any item of value (e.g., car, iPhone, iPad, etc.), and/or any combination thereof. The method may include determining second player criteria and/or second tournament criteria (step 1008). In one example, the second player criteria and/or the second tournament criteria may be a best winning ratio. The best winning ratio may be the ratio of winning spins versus completed spins. The method may include generating one or more prizes based on the second player criteria and/or the second tournament criteria (step 1010). The method may include determining an Nth player criteria and/or an Nth tournament criteria (step 1012). In one example, the Nth player criteria and/or the Nth tournament criteria may be a first to score criteria. The method may include generating one or more prizes based on the Nth player criteria and/or the Nth tournament criteria (step 1014). It should be noted that all of these player criteria may be utilized as team criteria. For example, the first team criteria and/or first tournament criteria may be the most plays by a team (e.g., fastest players). In another example, the first team criteria and/or first tournament criteria may be least plays by a team (e.g., slowest players). In another example, the first team criteria and/or first tournament criteria may be the first team to win a specific prize on a spin—the first team to win 1,000 credits, the first team to win 100 credits twice, the first team to win 10 free spins, the first team to win 500 credits with a 2× multiplier, the first team to win 1,000 credits, 5 free spins, and a scatter bonus, etc. In various examples, any prize and/or item of value may be generated for achieving the player criteria, the team criteria, and/or the tournament criteria. Various examples include money (e.g., $50, $100, etc.), free play, free future tournament entry, free current tournament entry, free hotel room, free food, free entertainment, any item of value (e.g., car, iPhone, iPad, etc.), and/or any combination thereof.

To manage such large tournaments, game bracketing, in various formats may be supported as well. For instance, a single and/or double elimination bracket format might be applied to the tournament to extend the competition, allow another chance to avoid the single unlucky game factor, and appropriately manage much larger groups of participants.

Figure 11:
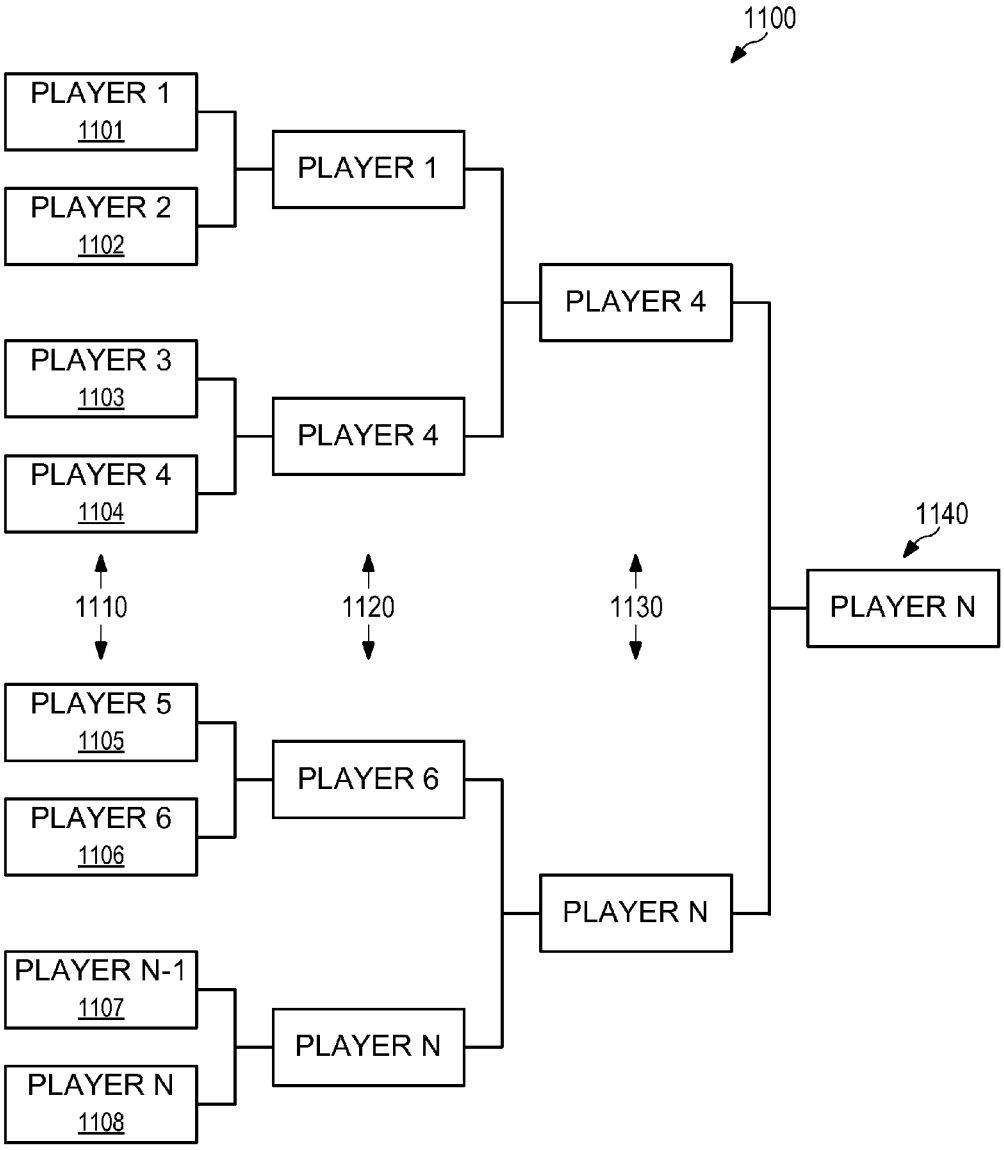
FIG. 11 is a flow diagram for tournament game play, according to one embodiment.

In FIG. 11, another flow diagram of asynchronous tournament play 1100 is shown, according to one embodiment. In this example, a tournament bracket is shown were a first player 1101, a second player 1102, a third player 1103, a fourth player 1104, a fifth player 1105, a sixth player 1106, an N−1 player 1107, and an N player 1108 compete in a first bracket 1110. In this example, the winner of each match (e.g., first player 1101 versus second player 1102, third player 1103 versus fourth player 1104, fifth player 1105 versus sixth player 1106, N−1 player 1107 versus N player 1108) moves onto a second bracket 1120. In this example, the winner of each match (e.g., first player 1101 versus fourth player 1104 and sixth player 1106 versus N player 1108) in second bracket moves onto a third bracket 1130 where the winner of this match is a tournament winner 1140 (e.g., N player 1108). In should be noted that any number (e.g., 1 to N) of players, any number (e.g., 1 to N) of matches, and/or any number (e.g., 1 to N) of brackets may be utilized. The above referenced examples may also be utilized with a first team, a second team, a third team, etc.

Figure 12:
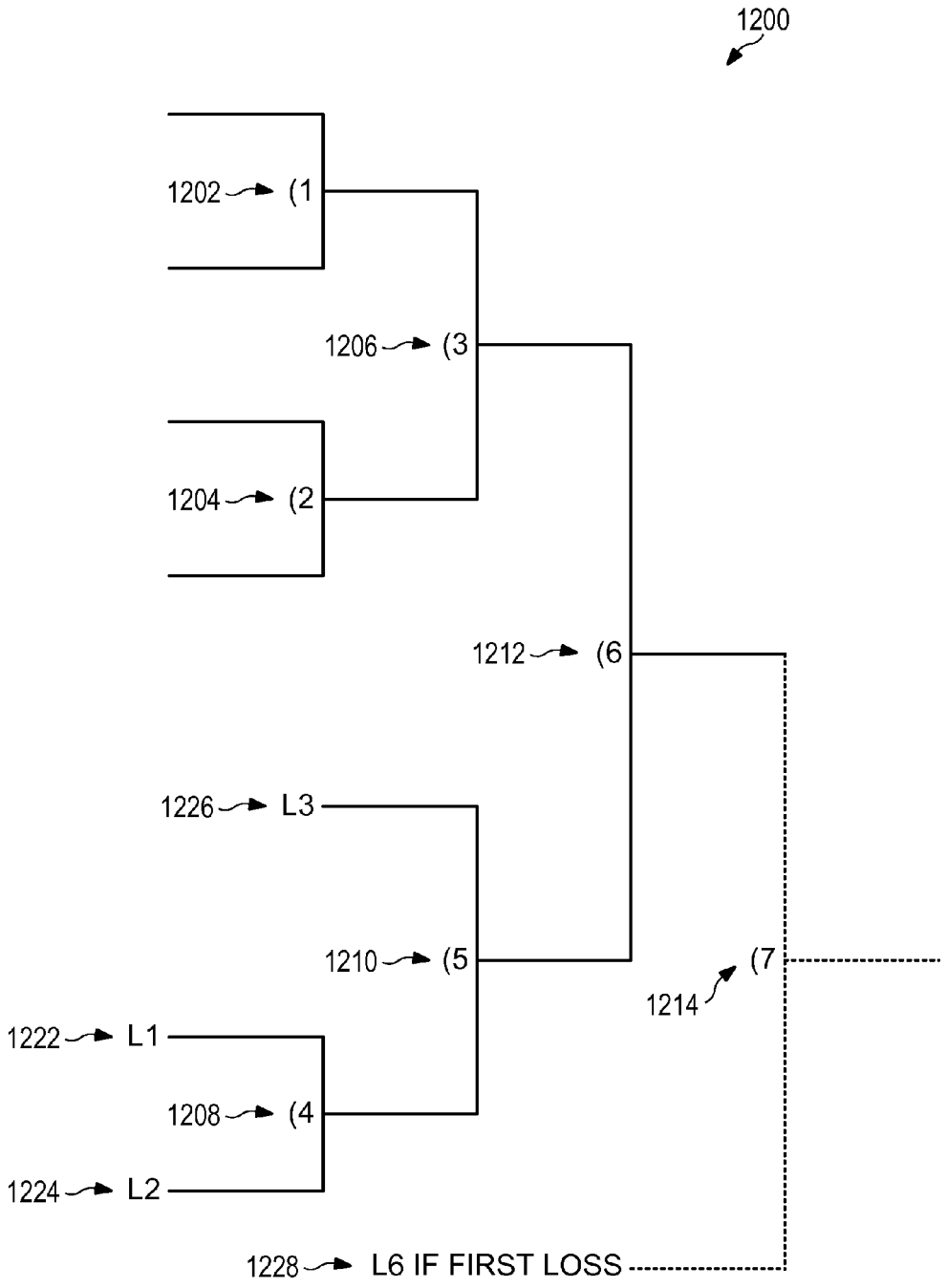
FIG. 12 is a flow diagram for tournament game play, according to one embodiment.

In FIG. 12, another flow diagram of asynchronous tournament play 1200 is shown, according to one embodiment. In this example, a double elimination bracket system is utilized. In this example, the tournament play is a double elimination style where a player is eliminated once the player loses two matches. This method may include a first player and a second player competing in a first match 1202. The winner of the first match 1202 moves onto a third match 1206. The loser of the first match 1202 moves onto a fourth match 1208. The method further includes a third player and a fourth player competing in a second match 1204. The winner of the second match 1204 moves onto third match 1206 while the loser of the second match 1204 moves onto fourth match 1208. The loser of the fourth match 1208 is eliminated from the tournament because this player has lost twice. In this case, the player has either lost in first match 1202 or second match 1204 and has now lost again in fourth match 1208. The winner of fourth match 1208 moves onto a fifth match 1210 to play the loser of third match 1206. The winner of fifth match 1210 will play the winner of third match 1206 in a sixth match 1212. This method continues (e.g., a seventh match 1214, etc.) until all of the players except one has two loses. The above referenced examples may also be utilized with a first team, a second team, a third team, etc.

Figure 13:
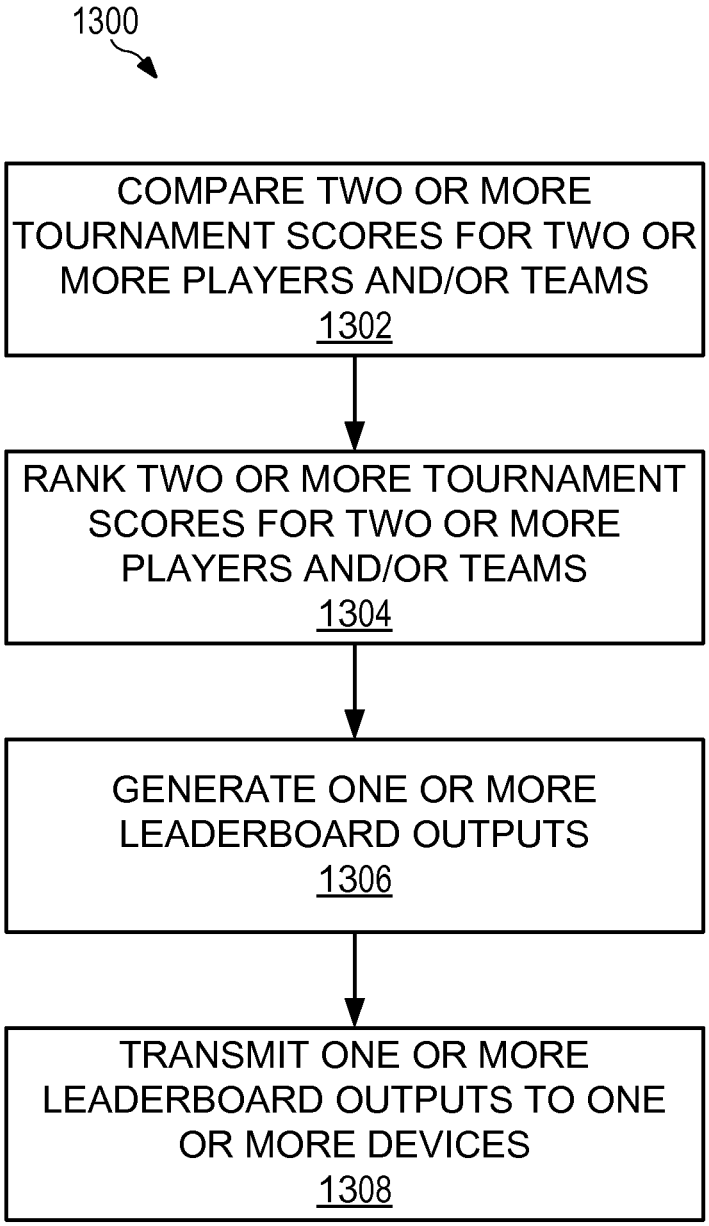
FIG. 13 is a flow diagram for tournament game play, according to one embodiment.

In FIG. 13, another flow diagram of asynchronous tournament play 1300 is shown, according to one embodiment. The method may include comparing two or more tournament scores for two or more players and/or two or more teams (step 1302). The method may include ranking two or more tournament scores for two or more players and/or two or more teams (step 1304). The method may include generating one or more leaderboard outputs (step 1306). The method may include transmitting one or more leaderboard outputs to one or more devices (step 1308). The method may include displaying one or more leaderboard outputs. For example, the leaderboard information may be displayed on an exterior display to promote one or more tournaments to the public. In another example, the leaderboard information may be displayed on an interior display to promote one or more tournaments to casino players. In another example, the leaderboard information may be displayed on an Internet site to promote one or more tournaments. In another example, the leaderboard information may be displayed on one or more gaming devices to promote the one or more tournaments and/or to update tournament participants on the tournament status.

Figure 14:
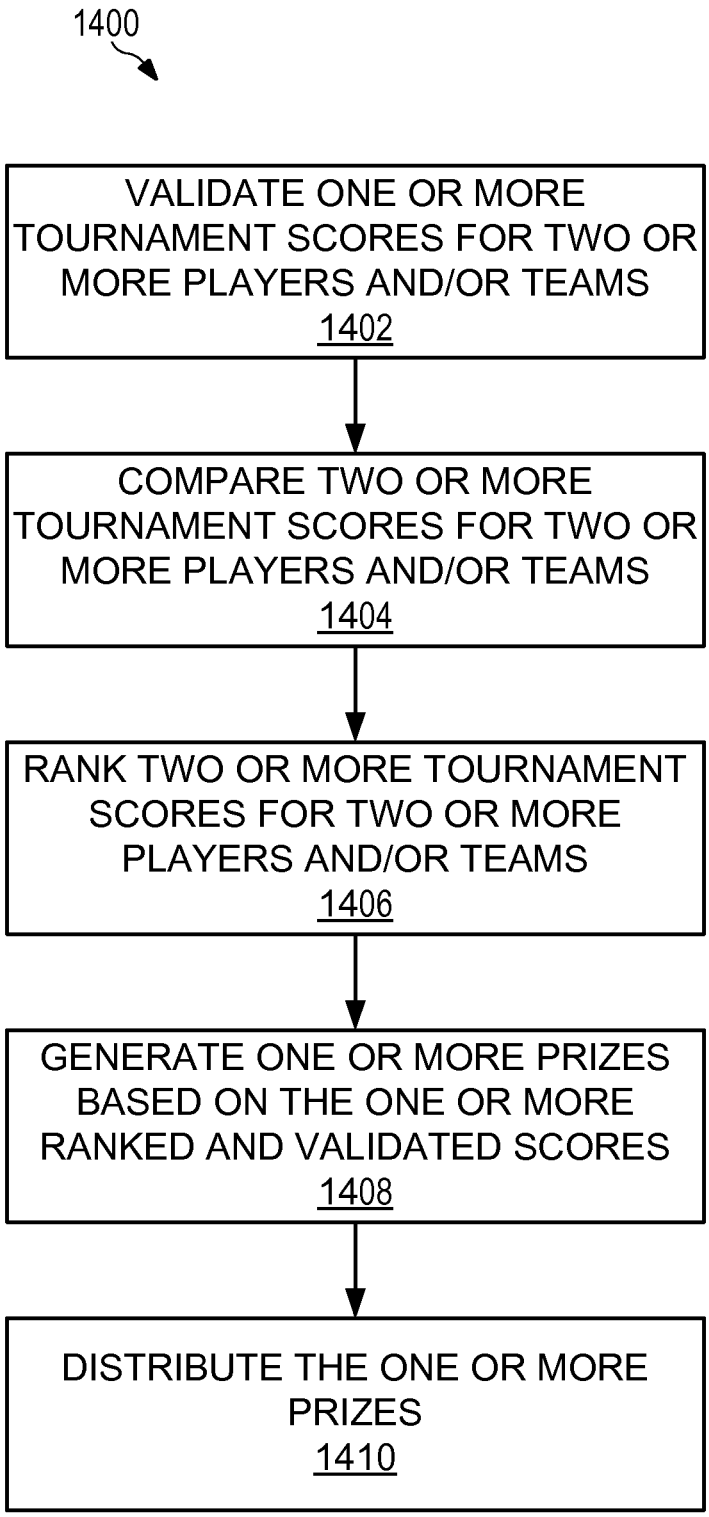
FIG. 14 is a flow diagram for tournament game play, according to one embodiment.

In FIG. 14, another flow diagram of asynchronous tournament play 1400 is shown, according to one embodiment. The method may include validating (e.g., compare tournament data to a secure source to valid the tournament data) one or more tournament scores for two or more players and/or two or more teams (step 1402). The method may include comparing two or more tournament scores for two or more players and/or two or more teams (step 1404). The method may include ranking two or more tournament scores for two or more players and/or two or more teams (step 1406). The method may include generating one or more prizes based on the one or more ranked and validated scores (step 1408). The method may include distributing the one or more prizes (step 1410).

In another example, the system and/or method may include enabling one or more multi-site tournament aspects. In one example, one or more tournaments may be held across multiple casinos either at the same time or asynchronously. In the asynchronous case, the system and/or method may add multiple casino tournament management servers in the event. In the simultaneous case, tournament management servers from different, participating, sites may connect and await for either: a predetermined start time; a pre-designated 'master' casino of the group to press the start button; and/or each participating casino may each have to press their own start buttons to begin the tournament. In various examples, group playing and side-betting enhancement options may be applied to the simultaneous tournament play. In addition, some additional forms of winner can happen here, i.e., winning casino of the group by average score, total score for a fixed-size tournament such as 20 players per casino required, etc. There may also be a local winner for each casino in addition to an overall winner across all casinos.

In another example, the system and/or method may print leaderboard information on a ticket. The Tournament system may print a 'receipt' using the voucher printer for each participant with their results. In another example, a leaderboard playback, showing the last 10 seconds, for example, of the leaderboard in motion may be utilized by the system and/or method. In addition, the winner's facial expressions obtained via camera 120 or 312 may be utilized by the leaderboard functionality and/or any other functionality.

In another example, a player registration process may be utilized. In one example, the system and/or method may utilize a player self-register. For instance, the game is in a non-tournament mode (e.g. revenue mode), the player comes up to it, is identified, and can either, validate their previously attained registration when they are ready to play in the tourney, or, they could register right at the game and begin. Once the player is finished, the game may go right back to revenue mode. Thus, reducing the 'down' time of the game and reducing the operations effort of the casino registering players and linking them with games.

One or more tournament presentations may be based on a first theme (e.g., pirates), a second theme (e.g., cars), a third theme (e.g., horses), a fourth theme (e.g., perceived skill), a fifth theme (e.g., a specific movie), a sixth theme (e.g., a sporting event), a seventh theme (e.g., outer space), an eight theme (e.g., flowers), a ninth theme (e.g., food), a tenth theme (e.g., a skill based presentation), an eleventh theme (e.g., trivia), a twelve theme (e.g., pick a bonus), a thirteenth theme (e.g., ghost), a fourteenth theme (e.g., natural events), on a fifteenth theme (e.g., a mineral—gold, silver, etc.), and/or a sixteenth theme (e.g., mythology). One, a few, a plurality, and/or all of these presentations may be themed based.

Figure 15:
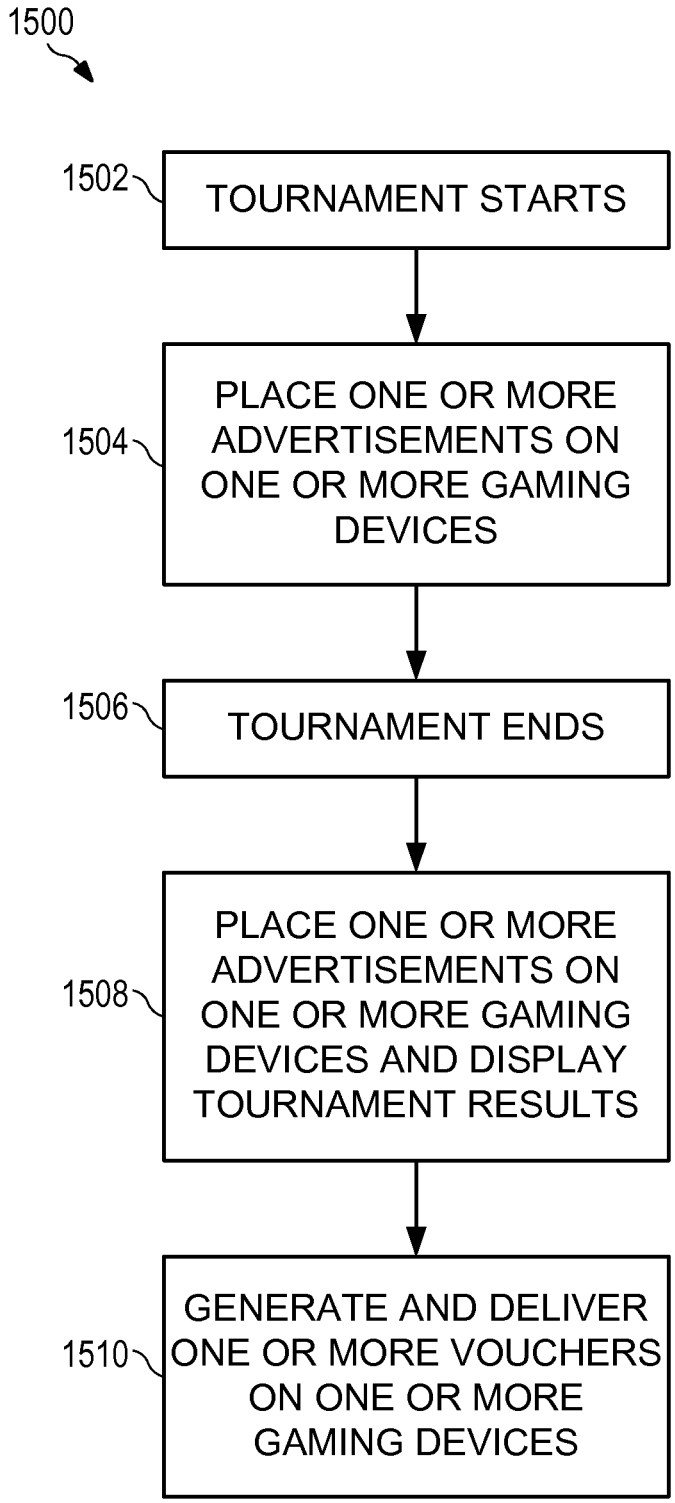
FIG. 15 is a flow diagram for tournament game play, according to one embodiment.

In FIG. 15, a flow diagram for tournament game play 1500 is shown, according to one embodiment. The method may include starting one or more tournaments (step 1502). The method may include placing one or more advertisements on one or more gaming devices (step 1504). The method may include ending one or more tournaments (step 1506). The method may include placing one or more advertisements on one or more gaming devices and displaying one or more tournament results (step 1508). The method may include generating and delivering one or more vouchers on one or more gaming devices (step 1510).

Figure 16:
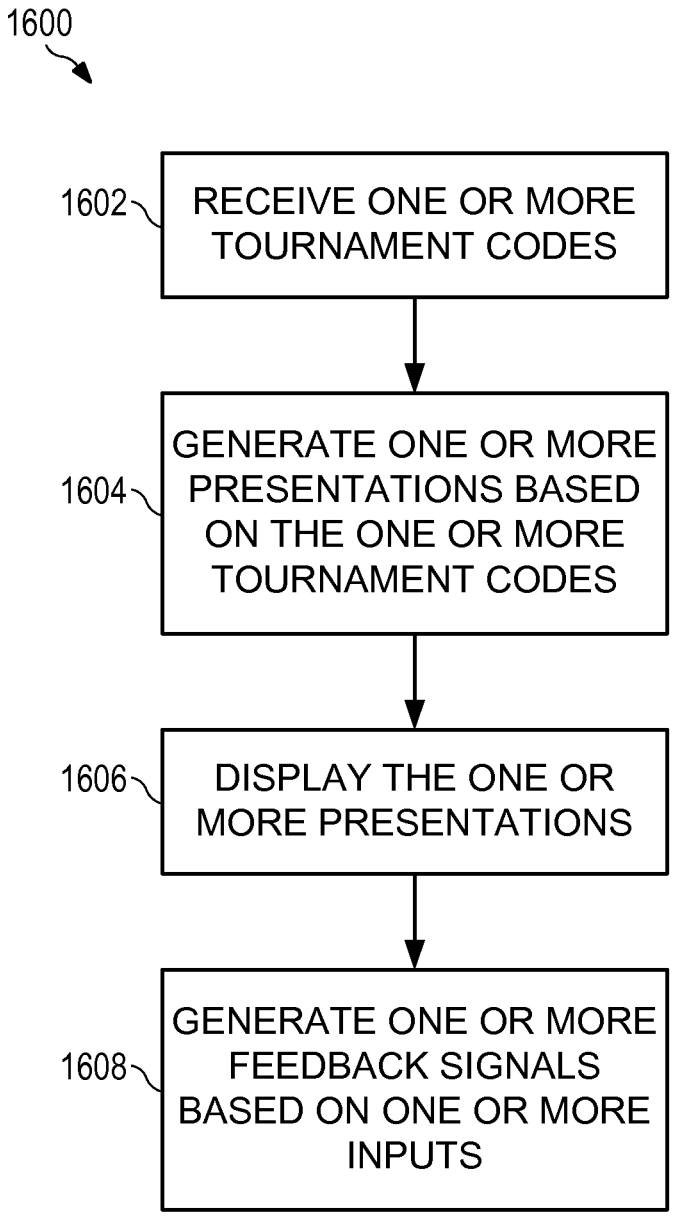
FIG. 16 is a flow diagram for tournament game play, according to one embodiment.

In FIG. 16, a flow diagram for tournament game play 1600 is shown, according to one embodiment. The method may include receiving one or more tournament codes (step 1602). The method may include generating one or more presentations based on the one or more tournament codes (step 1604). The method may include displaying the one or more presentations (step 1606). The method may include generating one or more feedback signals based on one or more inputs (step 1608). The one or more presentation may include one or more advertisements and/or sponsor data. In one example, the one or more advertisements may offer a buy one get one free advertisement (e.g., shows, food, entertainment, lodging, etc.). In another example, the advertisement may be a free offer, a percentage off offer, and/or any other advertisement offering. In another example, the advertisements and/or sponsor data may be based on player preferences, player data, player demographics, and/or any other customizable data. In another example, the advertisements and/or sponsor data may be displayed at a first tournament time (e.g., beginning), at a second tournament time (e.g., a break period), at a third tournament time (e.g., 10 minutes into the tournament), at a fourth tournament time (e.g., at the end), and/or any other time period. Further, the advertisement and/or sponsor data may be related to any theme, promotion, a special event, and/or any other item. In one example, the player may provide feedback on the one or more advertisements and the system and/or method may modify the offering based on this feedback and present the new modified offering. For example, the offering may be a top of the line room at $200 a night. However, based on feedback received from the player, an average room at $100 a night might be the new offering.

Figure 17:
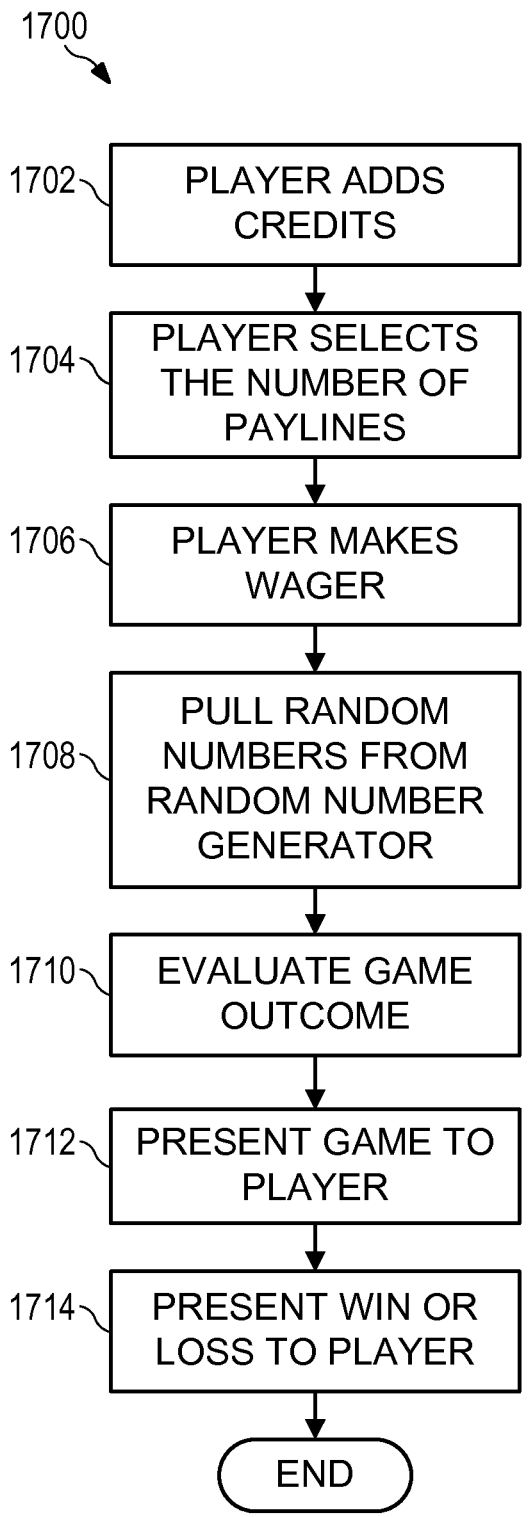
FIG. 17 is a flow diagram for tournament game play, according to one embodiment.

FIG. 17 is a process flowchart of one example of a primary game play 1700 on an electronic gaming system, according to one embodiment. The method may include the step of a player adding credit to the electronic gaming system (step 1702). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1704, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1706, the player makes a wager on the game. In one embodiment, the wager may be a multiple of the number of paylines selected at step 1704. In another embodiment, the wager may not be a multiple of the number of paylines selected at step 1704. In a further embodiment, the wager may include a side-wager (e.g., ante bet), which may, in one example of such an embodiment, be used to make the player eligible to be awarded the extra functionality discussed above. It should be appreciated that in some embodiments, the order of steps 1704 and 1706 may be not critical, and so for example, a player can select the wager they wish to place, and then select the number of paylines they want it applied to, and that these embodiments are expressly contemplated as being within the scope of the present disclosure.

Continuing to step 1708, the gaming system pulls random numbers from a random number generator ("RNG"). In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At steps 1710 and 1712, the gaming system utilizes the random numbers pulled at step 1708 to determine the primary game symbols to display in the play of the primary game, which in turn both determines the presentation of the game to the player and evaluates the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1714, the win or loss outcome may be identified for the player. In one embodiment, this step can include additional messaging, which provides information related to the win or loss, such as why the player won or lost. In another embodiment, this step can include identification of the amount of any award earned by the player.

Figure 18:
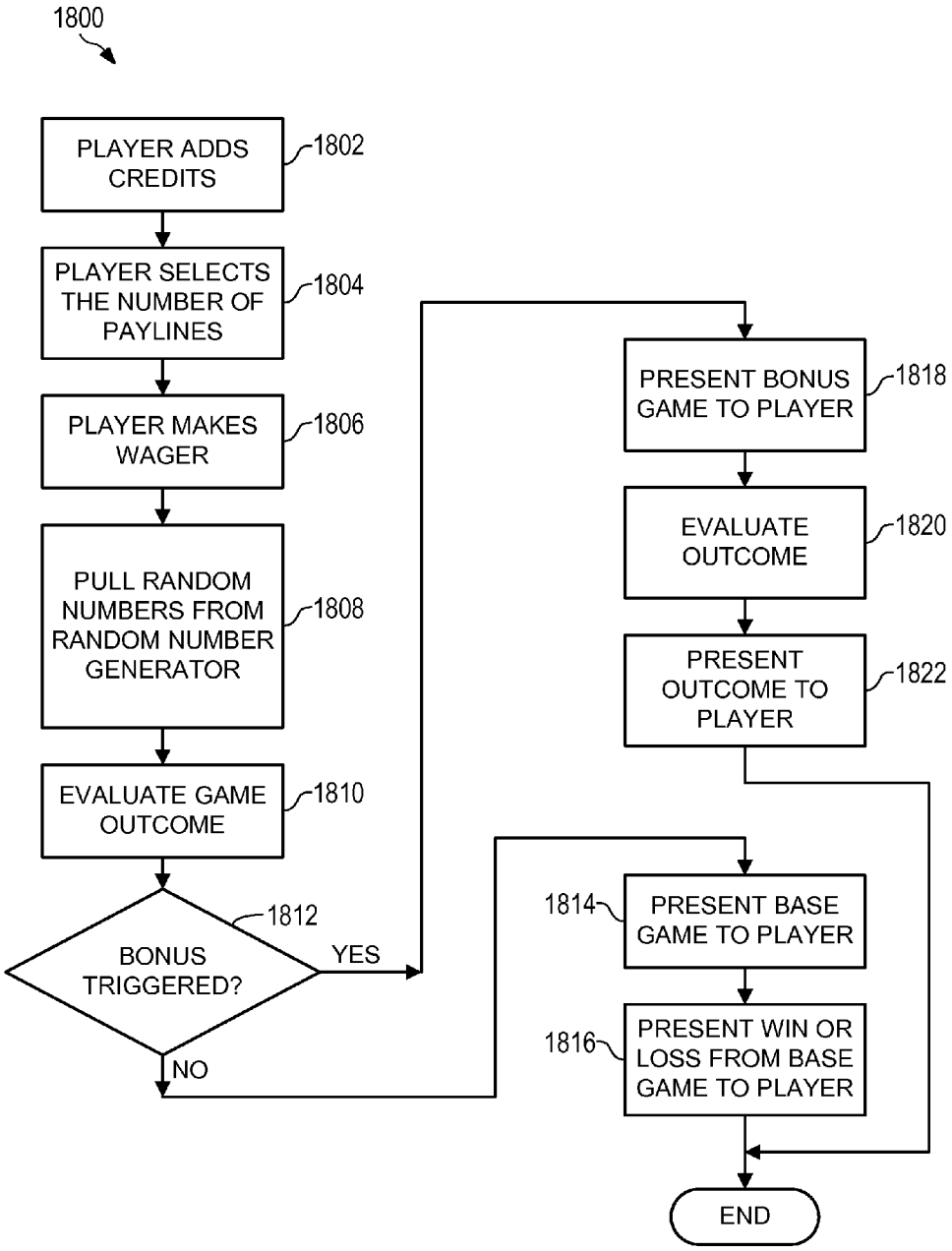
FIG. 18 is a flow diagram for tournament game play, according to one embodiment.

FIG. 18 is a process flowchart of one example of a combined primary and secondary game play 1800 on an electronic gaming system, according to one embodiment. The method may include the step of a player adding credit to the electronic gaming system (step 1802). It is contemplated that a player can do this by inserting cash, coins, a ticket representative of a cash value, a credit card, a player card, requesting an electronic funds transfer ("EFT"), otherwise requesting access to an account having monetary funds, and/or any combination thereof.

At step 1804, the player selects the number of paylines to play. In one embodiment, the player can select from a plurality of different paylines to play. In a further embodiment, the player can only play a predetermined number of paylines. An example of this embodiment may be the instance where the gaming system only allows a player to play forty paylines, and cannot select to play more or less paylines. In another embodiment, the gaming system does not offer paylines, but rather offers a different way to evaluate the game play. One example of a different way may be sometime referred to as a 243-ways evaluation, where symbols may be evaluated based on the existence of like-symbol clusters on adjacent reels, starting with the left-most reel and continuing right, instead of how many paylines run through the like-symbol clusters.

At step 1806, the player makes a wager on the game. In one embodiment, the wager may be a multiple of the number of paylines selected at step 1804. In another embodiment, the wager may not be a multiple of the number of paylines selected at step 1804. In a further embodiment, the wager may include a side-wager, which may, in one example of such an embodiment, be used to make the player eligible to be awarded the extra functionality discussed above. It should be appreciated that in some embodiments, the order of steps 1804 and 1806 may be not critical, and so for example, a player can select the wager they wish to place, and then select the number of paylines they want it applied to, and that these embodiments may be expressly contemplated as being within the scope of the present disclosure.

Continuing to step 1808, the gaming system pulls random numbers from a random number generator "RNG". In one embodiment, the system pulls one random number for each reel. In another embodiment, the system pulls one random number which may be utilized to determine the stop positions for each reel. In another embodiment, the random numbers determined by the RNG may be based on the time that the numbers may be pulled. In another embodiment, the random numbers determined by the RNG may be based on the prior numbers pulled.

At step 1810, the gaming system utilizes the random numbers pulled at step 1808 to evaluate the game outcome. In one embodiment, the random numbers pulled determine the stopping positions for the reels, which may be then caused to stop at those associated positions, and then the gaming system evaluates the displayed primary game symbols to determine the game outcome. In another embodiment, the gaming system determines the game outcome based on the pulled random numbers, and then causes the game to present an associated outcome to the player.

At step 1812, the gaming system determines if a secondary or bonus game may be triggered. In one embodiment, the bonus game is triggered by the display of a plurality of matching symbols at a plurality of predetermined symbol positions within a play of the primary game. In one example, the bonus game may be triggered if a plurality of matching symbols is displayed on the $2^{nd}$, $3^{rd}$ and $4^{th}$ reel. In another example, the bonus game may be triggered if matching symbols are displayed on the $1^{st}$, $2^{nd}$ and $3^{rd}$ reels. In a further example, the bonus game may be triggered if matching symbols occur at predetermined symbol positions that include consecutive and non-consecutive reels. In another example, a bonus game (e.g., secondary game) may be triggered in any way (e.g., one special symbols in any locations, one special symbol in one or more predetermined locations, two special symbols in any locations, two special symbols in one or more predetermined locations, three special symbols in any locations, three special symbols in one or more predetermined locations, etc.).

If it is determined that a bonus or secondary game was not triggered, the process continues to step 1814, where the base game may be fully presented to the player. As discussed above, the orders of step 1810, 1812, and 1814 can be changed without affecting the novel concepts disclosed herein.

At step 1816, the win or loss outcome of the primary game may be identified for the player. In one embodiment, this step can include additional messaging, which provides information related to the win or loss, such as why the player won or lost. In another embodiment, this step can include identification of the amount of any award earned by the player.

If it is determined at step 1812 that a bonus or secondary game was triggered, then process 1800 continues to step 1818, where the secondary game may be presented to the player. As discussed above, there are numerous ways to present the secondary or bonus game to the player.

At steps 1820 and 1822, the outcome of the secondary game may be evaluated and presented to the player. In one embodiment, the outcome of the bonus game will always be a winning outcome. In another embodiment, the outcome of the secondary game will cause a significant award to be provided to the player. In one example of such an embodiment, the award may not be provided by the gaming system, as a casino operator may need to verify tax information before allowing such an award to be provided to the player. In one embodiment, instead of the process 1800 ending after step 1822, the process continues to step 1814 so as to finalize the primary game outcome presentation to the player.

Figure 19:
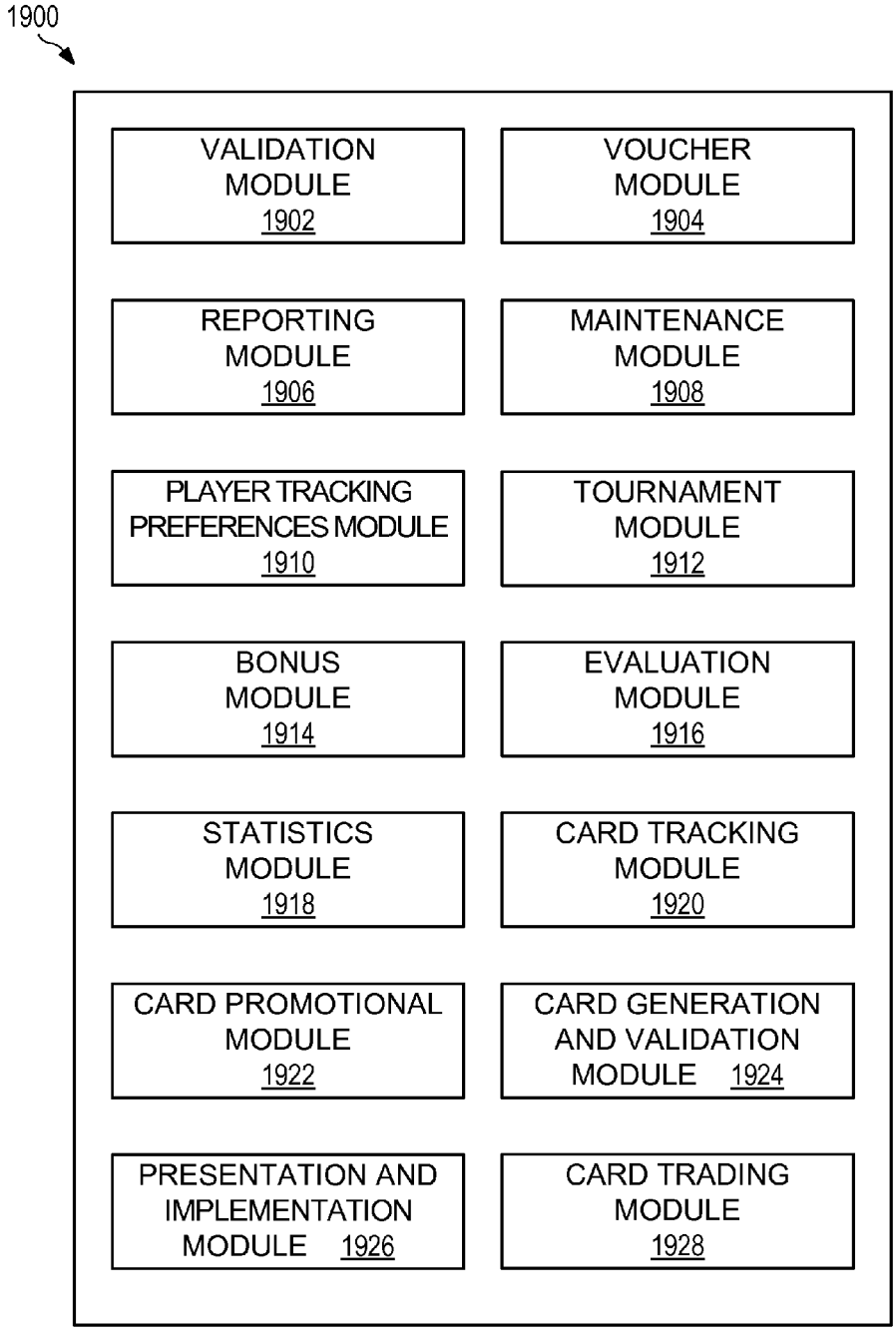
FIG. 19 is another block diagram of the electronic gaming device, according to one embodiment.

FIG. 19 shows a block diagram of memory 1904, which includes various modules. Memory 1904 may include a validation module 1902, a voucher module 1904, a reporting module 1906, a maintenance module 1908, a player tracking preferences module 1910, a tournament module 1912, a bonus module 1914, an evaluation module 1916, a statistics module 1918, a card tracking module 1920, a card promotional module 1922, a card generation and validation module 1924, a presentation generation and implementation module 1926, and/or a card trading module 1928.

Statistics module 1918 may generate, compile, transmit, and/or store any statistical data relating to one or more gaming options (e.g., base game mode, bonus game mode, tournament mode, etc.). For example, Special card type 1 (e.g., steal 100 credits from all players) is effective 99.9% of the time. Whereas, Defense card type 1 (e.g., block spin stealing) is only effective 62% of the time. In one example, Special card type 1 may be move valuable (and/or rare), then Defense card type 2. This data may also include data relating to any interrelationship of elements. For example, when an Attack card type 1 is utilized, a Defense card type 3 is utilized 28% of the time.

Card tracking module 1920 may track one or more power-up cards, which are available to the player, a few players, a plurality of players, and/or all of the players. Card tracking module 1920 may track power-up cards that have been utilized by the player, are in a player's card bank, are at a vendor's location, are assigned to a vendor, are in circulation, are on the trading block, have traded multiple times, are currently being utilized in a tournament, and/or any other ownership and/or movement of one or more power-up cards. Card tracking module 1920 may generate historical movement patterns of one or more power-up cards. Card tracking module 1920 may generate any other report relating to one or more power-up cards.

Card promotional module 1922 may provide power-up cards as part of a promotional activity (e.g., card promotional module 1922 may be used at gaming machines, local retail stores, internet sites, and/or anywhere the casino wants to market to current and potential players). For example, the player may be playing electronic gaming device 100 and based on earning a predetermined outcome one or more power-up cards may be earned. In another example, the player may be shopping at a retail store and once a predetermined dollar amount (e.g., $25, $50, $100, etc.) is spent, the player will receive one or more power-up cards. In another example, the player may be shopping at a retail store and purchase a specified item (e.g., TV, computer, tablet, etc.). Based on this specific purchase, the player may receive one or more power-up cards.

Card generation and validation module 1924 may generate new power-up cards for the player, validate power-up cards being added by the player, validate cards being traded by players, validate cards being utilized in a tournament, and/or validate power-up cards being deployed by the player in any fashion.

Presentation generation and implementation module 1926 may generate the presentation data (e.g., visual and audio) relating to one or more power-up game play options. A presentation module may display one or more of the generated presentations.

Card trading module 1928 may provide a place (e.g., virtual room) and/or function for players to trade their power-up cards with other players. Card trading module 428 may utilize card generation and validation module 1924 to validate cards being traded at a trading site.

Figure 20:
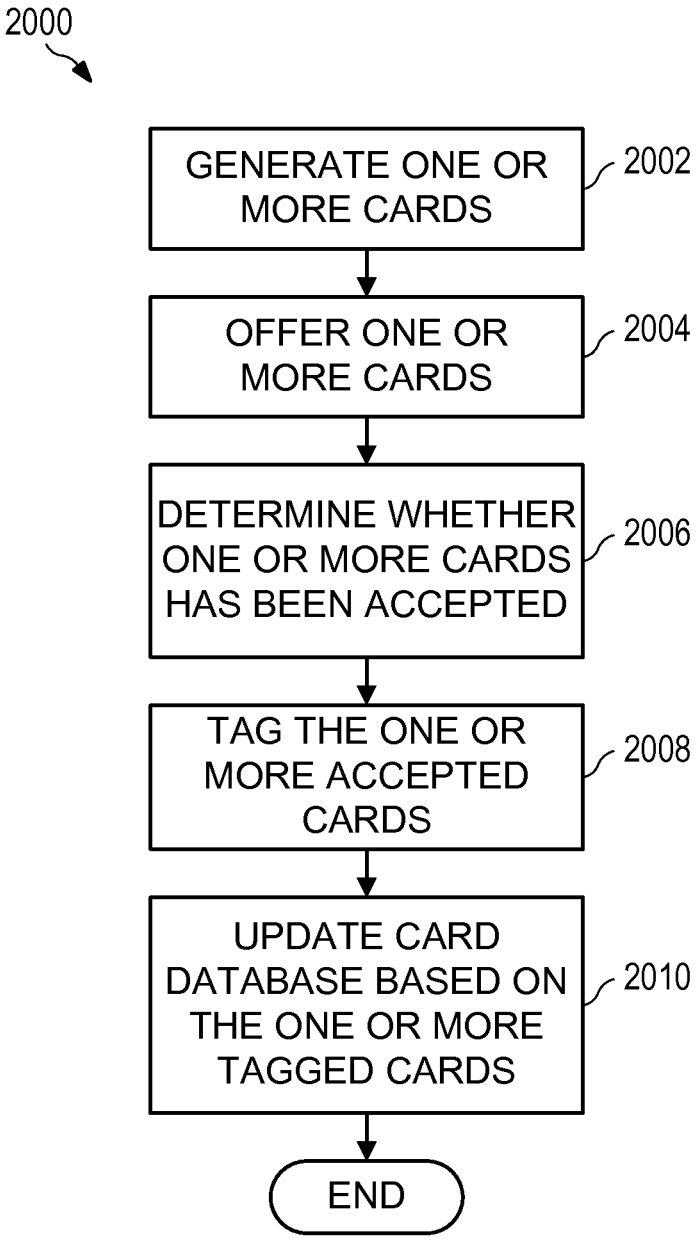
FIG. 20 is a flow diagram for generating and distributing one or more gaming cards, according to one embodiment.

FIG. 20 is a flow diagram for generating and distributing power-up cards, according to one embodiment. The method may include card generation and validation module 1924 generating one or more cards (step 2002). The method may include offering one or more cards to the player (step 2004). The method may include electronic gaming device 100, electronic gaming system 200, and/or any other processing device determining whether one or more cards have been accepted (step 2006). The method may include tagging one or more accepted cards (step 2008). The method may include the updating of the card database based on the one or more tagged cards (step 2010). Once done, the method may end. In one example, the tagging procedure is utilized to validate one or more power-up cards.

In one example, the player may be playing electronic gaming device 100 and/or electronic gaming system 200 within an affiliated casino property where the electronic gaming device displays (e.g., offers) one or more power-up cards (e.g., one or more special skill cards, one or more attack cards, one or more defense cards, etc.) for the player to select from based on a random event. Power-up cards may be earned and/or offered based on performance, randomly, a predetermined pattern, a player level, player card data, and/or in any other distribution method.

In another example, the player may be playing an electronic gaming device, based on earning a predetermined outcome electronic gaming device 100 and/or electronic gaming system 200 may display one or more power-up cards (e.g., Special card type 1, Special card type 2, Attack card type 1, Attack card type 2, Defense card type 1, Defense card type 2, etc.) for the player to select from. For example, three power-up card symbols may be displayed on one or more reels, which may generate one power-up card. In another example, five power-up card symbols may be displayed on one or more reels, which may generate three power-up cards and/or one rare power-up card. In one example, a power-up card may be rare (e.g., limited) because of the functionality of the card (e.g., powerful, special, effectiveness, rubber and glue functionality—reverses an attack back onto the attacker, etc.). In another example, a power-up card may be common (e.g., large supply) because of the functionality of the card (e.g., hit or miss effectiveness, limited power, etc.).

In another example, the player may be shopping at a retail store, which the casino has formed a relationship, where when the player spends a predetermined dollar amount (e.g., $25, $50, $100, etc.) the player will receive one or more power-up cards (e.g., one or more special skill cards, one or more attack cards, one or more defense cards, etc.). In one example, the higher the total spent by the player, the better the one or more power-up cards are valued and/or the more cards are offered.

In another example, the player may be shopping at a retail store, which the casino has formed a relationship, where when the player purchases a specified item (e.g., TV, computer, tablet, etc.) the player will receive one or more power-up cards (e.g., Special card type 1, Special card type 2, Attack card type 1, Attack card type 2, Defense card type 1, Defense card type 2, etc.). In one example, depending on the item purchased changes which power-up cards are offered and/or earned by the player. For example, the purchase of a computer may entail one or more first level power-up cards. Whereas, the purchase of a computer may entail one or more second level power-up cards. In one example, the first level power-up cards may be less valuable then the second level power-up cards.

In another example, the player may eat at a restaurant, which the casino has formed a relationship, where when the player spends a predetermined dollar amount (e.g., $25, $50, $100, etc.) the player will receive one or more power-up cards (e.g., one or more special skill cards, one or more attack cards, one or more defense cards, etc.).

In another example, the player may eat at a restaurant, which the casino has formed a relationship, where when the player purchases a specified item (e.g., an appetizer, special drink, certain entre, etc.) the player will receive a power-up card. As a further example, if you purchase a Big Mac Value Meal at McDonalds you may receive one or more power-up cards (e.g., one or more special skill cards, one or more attack cards, one or more defense cards, etc.).

In another example, the player may do business with any business (e.g., cable company, car repair facility, car dealership, car wash, landscape service, bank, etc.), which the casino has formed a relationship, where when the player makes a purchase and/or completes some other specified activity (e.g., test drives a new car), they receive a power-up card.

In another example, the casino may provide power-up cards based on a player utilizing other facilities at the casino (e.g., booking hotel rooms, using the spa, eating at on-site restaurants, comps for playing table games, etc.).

Receipt of the power-up card could be in the form of a scratch and revel ticket, an actual card (e.g., Baseball type trading card), a ticket with a bar code, an internet website with a redemption code, applied to their player club card, stored in a card bank, stored in a tournament bank, and/or any method for providing cards.

Figure 21:
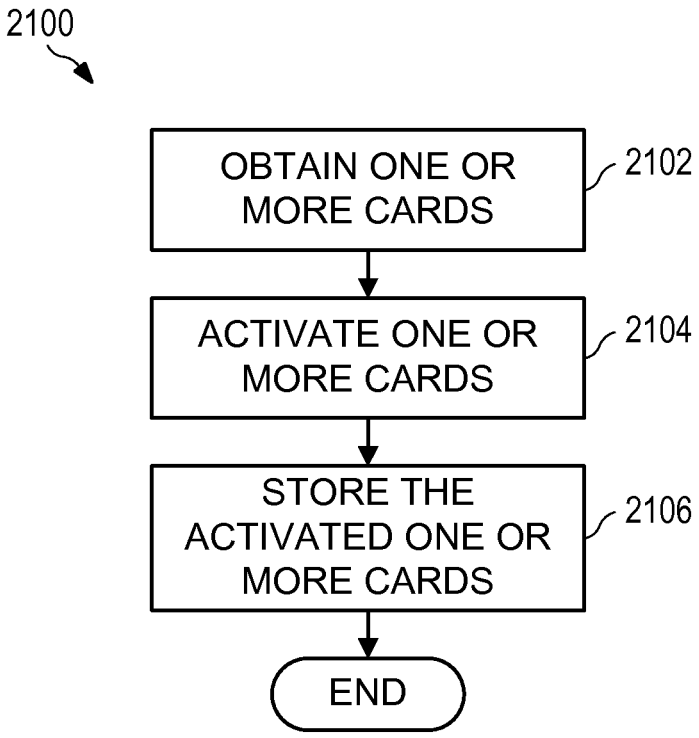
FIG. 21 is a flow diagram for activating one or more power-up gaming cards, according to one embodiment.

FIG. 21 is a flow diagram for activating one or more power-up game cards, according to one embodiment. The method may include obtaining one or more cards (step 2102). The method may include the activation of one or more cards (step 2104). The method may include the storing of the activated card(s) (step 2106). The method may then end.

In one example, the player may obtain a scratch and reveal ticket, which once scratched may reveal multiple cards for the player to select one or more of the power-up cards. To activate one or more power-up cards, the player may enter in a redemption code associated with the power-up card selected by the player via internet, gaming device, and/or any other computing device. In one example, the player may have to login to their account to activate the one or more power-up cards.

In another example, the player may be playing electronic gaming device 100 and/or electronic gaming system 200. Based on earning a predetermined outcome electronic gaming device 100 and/or electronic gaming system 200 may display one or more power-up cards for the player to have the option to select one or more power-up cards from the one or more presented power-up cards. Once the player selects the one or more power-up cards, electronic gaming device 100, electronic gaming system 200, and/or any other processing device may then activate the one or more power-up cards.

In another example, electronic gaming device 100 and/or electronic gaming system 200, based on betting a certain amount, may display power-up cards for the player to select from. Once the player selects the power-up card(s), electronic gaming device 100, electronic gaming system 200, and/or any other processing device may then activate the card.

In another example, the player may obtain one or more power-up cards through one or more trades with one or more different players. Once the player selects a power-up card to trade, electronic gaming device 100, electronic gaming system 200, and/or any other processing device may then remove the traded power-up card from one player's card bank and activate the card in the other player's card bank. The trade may take place via card trading module 1928. The trade may be tracked through card tracking module 1920 and/or card trading module 1928.

In another example, electronic gaming device 100, electronic gaming system 200, and/or any other device may distribute a ticket for the player to take to an activation terminal to activate one or more power-up cards.

In another example, electronic gaming device 100 and/or electronic gaming system 200 may distribute a ticket with a redemption code and a website for activation via the Internet of the one or more power-up cards. Any of these examples may be utilized in combination and/or any other way to activate the card may be used.

Figure 22:
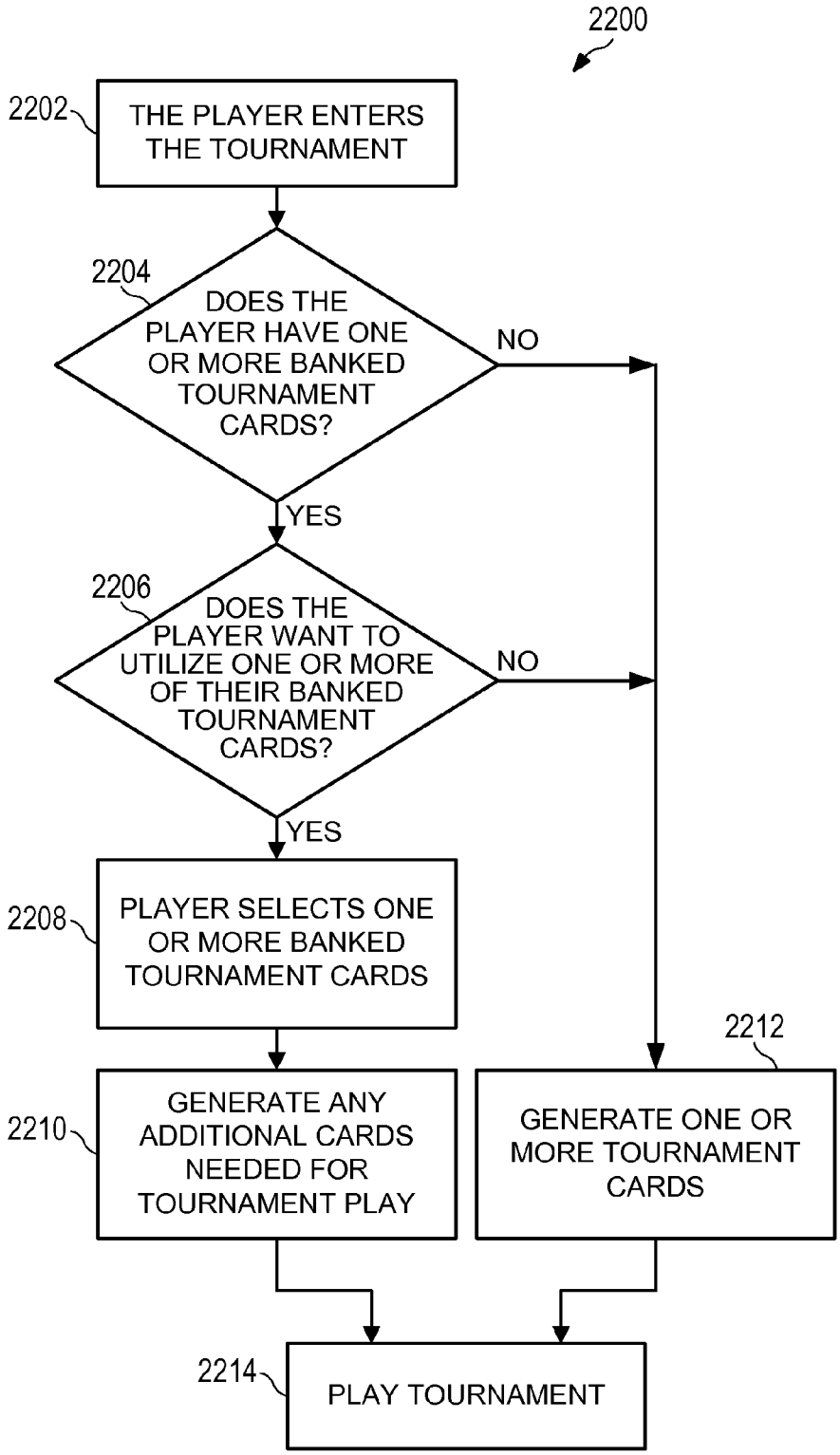
FIG. 22 is a flow diagram of tournament play, according to one embodiment.

FIG. 22 is a flow diagram of tournament play, according to one embodiment. The method may include the player entering the tournament (step 2202). The method may include a determination if the player's account has power-up cards banked or not (step 2204). If the player has power-up cards, the method may include allowing the player to elect to use banked power-up cards (step 2206). If the player has no power-up cards, and/or elects not to use the banked power-up cards, the method may include generating one or more power-up cards for use in the tournament (Step 2212). In the event the player elects to use banked power-up cards, the method may include the player selecting one or more banked power-up cards (step 2208). The method may include generating additional power-up cards, if needed for tournament play (step 2210). Once the player has the necessary power-up cards, the method may include playing in the tournament (step 2214).

For example, in the event the tournament allows for the use of up to five power-up cards and a player only has three power-up cards in their bank of cards, then the player may be presented with a list of power-up cards from which they may select two additional power-up cards. In one example, the generated power-up cards may be generated randomly. In another example, the generated power-up cards may be generated in a predetermined pattern. In another example, the generated power-up cards may be generated based on a player level. In this example, a higher ranked player (e.g., gold card holder) may receive better cards than a lower ranked player (e.g., silver card holder). The better cards may be based on an average, be every time, and/or any other distribution method. In another example, if a player has banked cards that are good but decides not to utilize these good power-up cards for this tournament, the generated power-up cards may be below average cards.

In another example, if the player, in the above example, chooses to only utilize one of their banked power-up cards, they may be presented with a list of power-up cards from which they may select four additional power-up cards.

Any number (e.g., 1, 2, 5, 10, etc.) of additional power-up cards may be offered to the player. In one example, at the end of tournament play, any unused power-up cards may be banked. In another example, at the end of tournament play, any unused power-up cards may not be banked. In one example, any unused power-up cards at the end of tournament play may be banked if the player utilized all of their previously banked power-up cards. In another example, any unused rare power-up cards may be banked at the end of tournament play. In another example, only non-rare power-up cards may be banked at the end of tournament play. Any of these examples may be combined and/or reversed. For example, any unused power-up cards may be banked if the player did not utilize all of their previously banked power-up cards.

Figure 23:
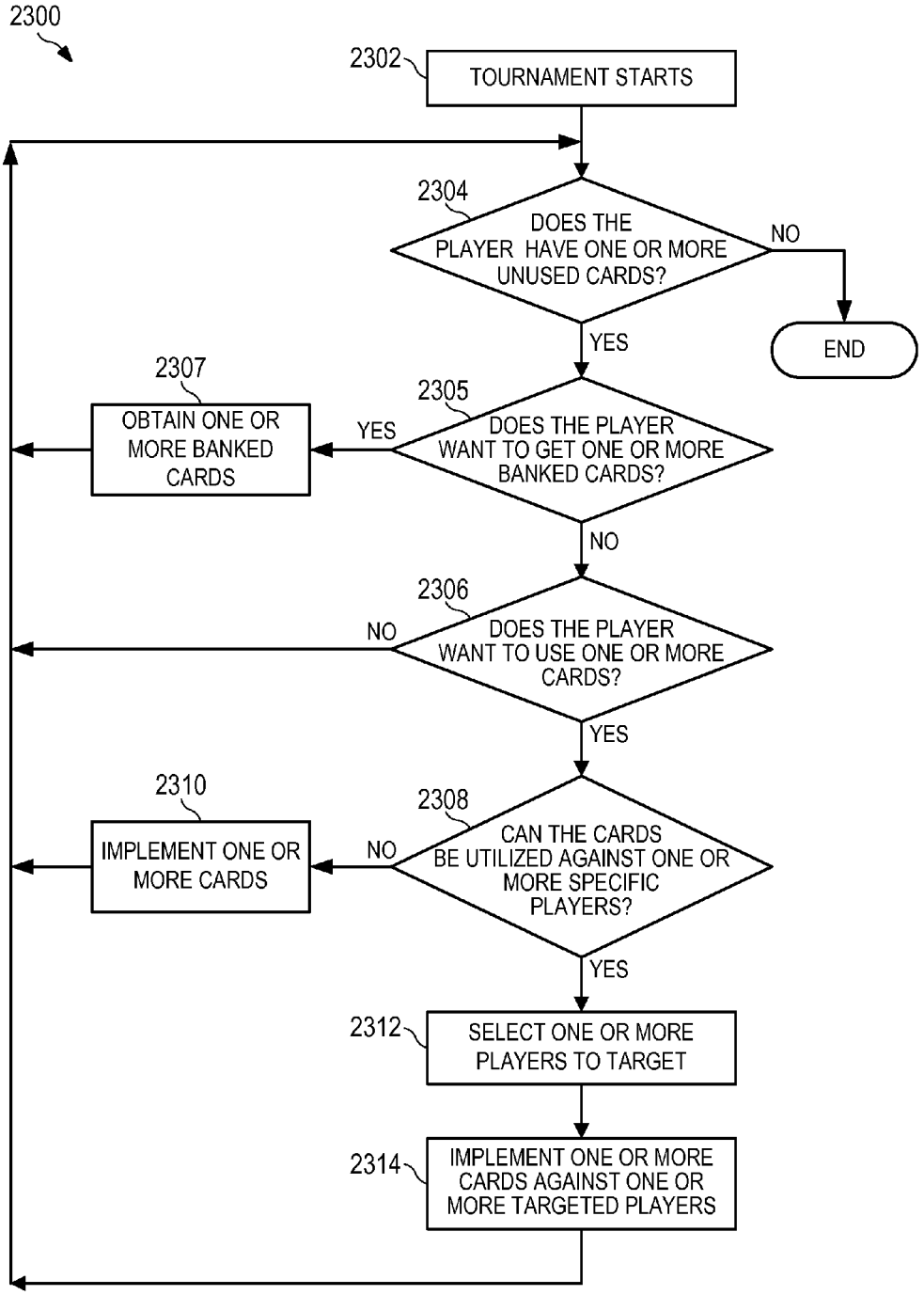
FIG. 23 is another flow diagram of tournament play, according to one embodiment.

FIG. 23 is a flow diagram of tournament play, according to one embodiment. The method may include the tournament starting (step 2302). The method may include determining if the player has one or more unused power-up cards (step 2304). If the player does not have one or more unused power-up cards, the player may be asked to get one or more power-up cards (step 2305). If the player does have available power-up cards, the method may include asking the player if they want to use one or more of their power-up cards (step 2306). If the player chooses to use one or more of their power-up cards, the method may include determining if the power-up card can be utilized against one or more specific players (step 2308). If the power-up card cannot be used against specific players, it may be applied to all the players (step 2310). If the player has a power-up card that can be used against one or more specific players, the player may be asked to select a player or players to target (step 2312). The method may then include implementing one or more power-up cards against one or more targeted players (step 2314). The game may then return to determining if the player has one or more unused power-up cards (step 2304).

For example, if the player does not have one or more unused power-up cards the player may be directed by electronic gaming device 100 and/or electronic gaming system 200, and/or any other source of direction, to where they may obtain power-up cards for use in the tournament. The player may be directed to any source for obtaining power-up cards, such as a bartender, tournament host/hostess, a location within the casino, and/or any other location where a power-up card could be distributed to players. In another example, electronic gaming device 100, electronic gaming system 200, and/or any other device may provide one or more power-up cards.

In another example, when the player does have a power-up card available for use, the tournament structure may allow the player to utilize one or more power-up cards. In one example, the player may elect to use a "steal 10 credits from all players" power-up card. The player would then receive 10 credits from each player who has not utilized a shield power-up card (e.g., credit shield card, total shield card, etc.). Therefore, any player that utilizes a credit shield defensive card (and/or similar card) would not have their credits stolen. In another example, a special power-up card may be a super steal power-up card, which may allow the player utilizing the power-up card to steal an item (e.g., credits, spins, etc.) regardless of whether that player utilizes a credit shield card, a total shield power-up card, and/or any similar power-up card. In another example, a super defense power-up card may stop any power-up card including a super attack power-up card. For example, a super credit steal card would be stopped by a super credit defense card (and/or a super defense card).

In another example, when the player does not have a power-up card available for use, the tournament structure may allow the player to elect a default card which may be a "shield from other player attack" power-up card. The shield from other player attack power-up card would keep the player from losing any item (e.g., credits, spins, etc.) if attacked by another player based on being in a vulnerable position. In another example, one or more tournament leaders (and/or any other player for any other reason (e.g., a penalty)) may have power-up cards frozen (e.g., temporary, for the tournament period, etc.), made inactive, removed, and/or taken away based on their position in the tournament, their activities, their conduct, randomly, and/or on a predetermined pattern.

In another example, the players may be given names. In this example two players, CARMEN and SCOTT are playing against each other. If CARMEN does have a power-up card available for use, CARMEN may elect to use a "stop a specific player from playing next 5-spins" power-up card. Then CARMEN may be asked which player to use the power-up card against (e.g., attack). If CARMEN elected to use it against SCOTT, SCOTT may then receive a notification that he was attacked by a power-up card from CARMEN. CARMEN may receive notification of the success of his attack against SCOTT. In a further example, SCOTT may be notified of the pending attack in advance and given an amount of time (e.g., 1 second, 5 seconds, 10 seconds, etc.) to shield himself. If SCOTT has a shield power-up card available, he may use this in the allotted time. In a further example, SCOTT may have implemented a "shield for next 10 plays" card, which would shield SCOTT from any other players' attack. Both SCOTT and CARMEN may then receive notification of the attack, the shielding, and/or the outcomes. The shield power-up cards may last for any amount of duration (e.g., 1 second, 5 minutes, three player's turns, three players' turns, etc.). In another example, one or more players may be able to see live video streams (and/or any other video representation of the other players—avatar) of the other players.

In another example, the tournament may have teams. For example, rather than the power-up card being used against just one individual, the player may elect to use the "stop a specific player from playing next 5 spins" card, against an entire team. By doing so, the entire team would have to halt play, allowing the team which implemented the power-up card to potentially move ahead.

In another example, rather than the shield power-up card being used to defend just one individual, the player may elect to use the "shield for next 10 plays" card for the benefit of the player's entire team. By doing so, the entire team may be protected from the opposing teams' power-up card attacks. In various example, the defense power-up cards (and/or the attack power-up cards) may be specific type of cards (e.g., defend against credit attack for 5 spins, defend against credit attack for 1 minute, defend against credit attack from one or more specific players for a time period ((e.g., 1 minute, five minutes, the entire tournament, etc.) and/or a turn number (e.g., 1 turn, 3 turns, all turns, etc.)), defend against spin attack for 10 spins, defend against spin attack for 5 minutes, defend against spin attack for next 3 spins and against credit attack for the next 5 minutes). The attack power-up cards may be specific type of cards (e.g., obtain credits and spins for next 5 spins, obtain credits for 1 minute from one or more players, obtain credits and multipliers from one or more specific players for a time period (e.g., 1 minute, five minutes, the entire tournament, etc.) and/or a turn number (e.g., 1 turn, 3 turns, all turns, etc.), obtain spins, credits, and multiplier for the next 10 spins, obtain spins for 5 minutes, obtain spins for the next 3 spins and credits for the next 5 minutes.

Figure 24A:
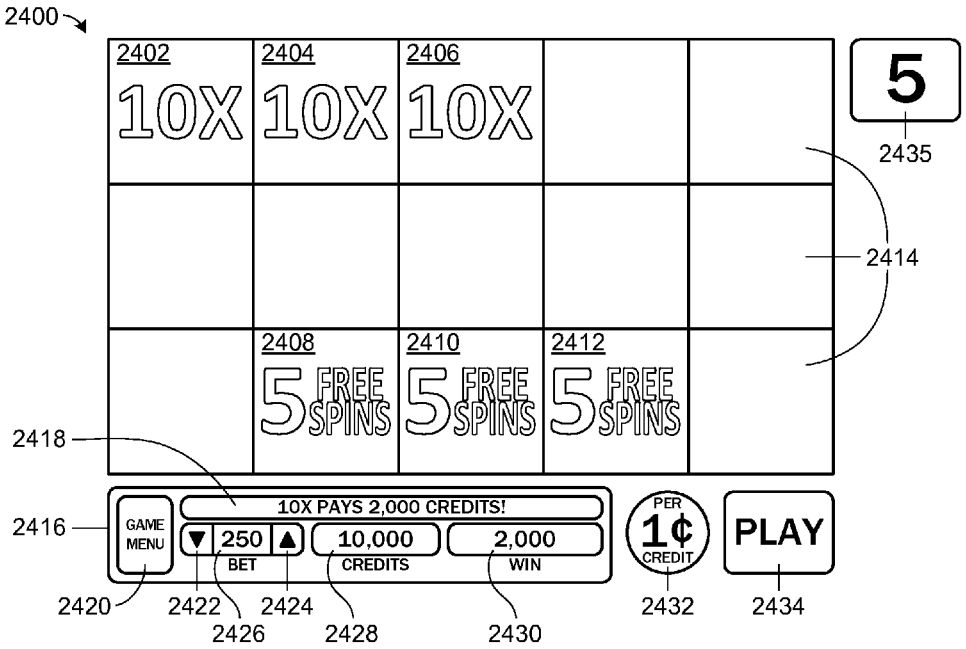
FIG. 24A is an illustration of tournament game play, according to one embodiment.

FIG. 24A is another illustration of tournament game play, according to one embodiment. A first screen image 2400 may include a first image 2402, a second image 2404, a third image 2406, a fourth image 2408, a fifth image 2410, a sixth image 2412, a payline display area 2414, a game data area 2416, a game communication area 2418, a game menu button 2420, a bet reducer button 2422, a bet increaser button 2424, a bet amount image 2426, a credit amount image 2428, a win amount area 2430, a credit value image 2432, and a play button 2434.

First screen image 2400 may include a predetermined number of columns and a predetermined number of rows. First screen image 2400 may include any number of rows and/or any number of columns. For example, first screen image 900 may have five rows and ten columns; first screen image 2400 may have eight rows and thirteen columns, and/or any other combinations of rows and columns. The player may initiate a wagering event through input device 316. Images in each cell may scroll up and/or down and/or side-to-side. Positioning of the images displayed in the reels on first screen image 2400 may display the outcome of a wagering event (e.g., a win or a loss for the player).

For example, it may be that if all columns in a first row have the same image (e.g., cherries, bars, pictures of the player as captured by camera 312, etc.) then a winning event has occurred. Lining up of the images may happen in many ways. For example, if all images in the various cells, which are touching by a shared side or by a corner, have the same image, this may represent that a winning event has occurred. If all of the images in a single row have the same image, this may represent a winning event. If all of the images in a single column have the same image, this may represent a winning event. If all of the images on a diagonal column have the same image, this may represent a winning event. The diagonal column could include any number of cells (e.g., 1, 2, 4, etc.).

First image 2402, second image 2404, third image 2406, fourth image 2408, fifth image 2410, and sixth image 2412 may be any image (e.g., card, letter, bar, cherry, blank, etc.). On first screen image 2400, first image 2402, second image 2404, and third image 2406 are shown as "10×", which according to game communication area 918, represent a win of 2,000 credits (e.g., 200 credits×10× multiplier). On first screen image 2400, fourth image 2408, fifth image 2410, and sixth image 2412 are show as a win of "5 Free Spins".

Game data area 2416 may include additional data relating to the game. For example, game data area may include game communication area 2418, game menu button 2420, bet reducer button 2422, bet increaser button 2424, bet amount image 2426, credit amount image 2428, and win amount area 2430, and/or any other information.

Game communication area 2418 may display message(s) to the player. In first screen image 2400, the message states, "10× PAYS 2,000 CREDITS!". Game communication area 2418 may display any message.

Game menu button 2420 may include data relating to the game. For example, the payout structures, payout odds, the amount won over a predetermined number of game plays, the amount won over a specific time frame, and/or any other game play data may be accessed via game menu button 2420. In another example, game menu button 2420 may access instructions on how to play the game, access to other games, and/or access to other versions of the same game.

Bet reducer button 2422 may decrease the amount of credits wagered on game play. Bet increaser button 2424 may increase the amount of credits wagered on game play. Bet amount image 2426 may show the amount of credits wagered on game play. Credit amount image 2428 may show the amount of credits available to the player for game play. Win amount area 2430 may show the payout amount of the last event. Credit value image 2432 may show the value of a single credit. Play button 2434 may start the next game. A banked free spins area 2435 may show the amount of banked spins. The banked free spins may be utilized at end time including at the end of regulation tournament play.

Figure 24B:
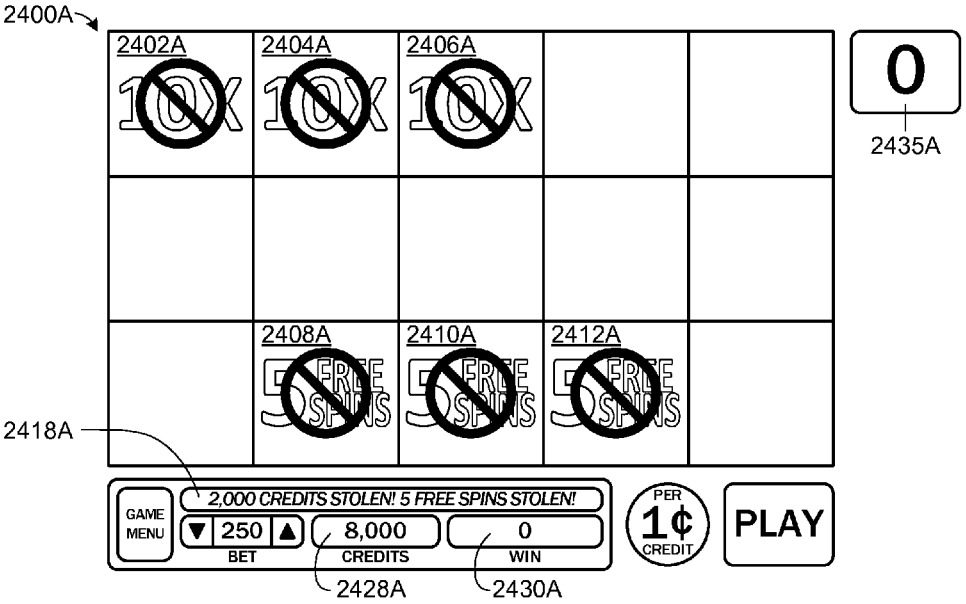
FIG. 24B is another illustration of tournament game play, according to one embodiment.

FIG. 24B is another illustration of tournament game play, according to one embodiment. FIG. 24B shows a second screen image 2400A for electronic gaming device 100 and/or electronic gaming device 200 on display 318. Second screen image 2400A may include a first modified image 2402A, a second modified image 2404A, a third modified image 2406A, a fourth modified image 2408A, a fifth modified image 2410A, a sixth modified image 2412A, a modified game communication area 2418A, a modified credit amount image 2428A, and a modified win amount area 2430A.

First modified image 2402A may be a modification of first image 2402, second modified image 2404A may be a modification of second image 2404, third modified image 2406A may be a modification of third image 2406, fourth modified image 2408A may be a modification of fourth image 2408, fifth modified image 2410A may be a modification of fifth image 2410, and sixth modified image 2412A may be a modification of sixth image 2412 as a result of the use of a power-up card. Modified game communication area 2418A may tell the player in words what the modified images are displaying graphically (e.g., "2,000 Credits Stolen! 5 Free Spins Stolen!") as a result of the use of a power-up card. Modified credit amount image 2428A may show the adjusted amount of credits after the use of a power-up card. Modified win amount area 2430A may show the adjusted amount of win after the use of a power-up card. A modified banked free spins 2435A may show a balance of zero based on 5 free spins being stolen (e.g., 5−5=0). Each modified image may show the effects of one or more power-up cards on the player's results.

In one example, a first player (e.g., "CARMEN") may use a "steal all wins" power-up card to steal any wins which a second player (e.g., "SCOTT") may earn on the next spin. First screen image 2400 may represent the next spin for SCOTT, with a win of 2,000 credits (e.g., "10×") and the win of five free spins (e.g., "5 Free Spins"). Second screen image 2400A may then represent the results of CARMEN's attack on SCOTT. First modified image 2402A, second modified image 2404A, third modified image 2406A, fourth modified image 2408A, fifth modified image 2410A, and sixth modified image 2412A may be showing SCOTT the theft of his win (and/or "the amount he won that will now go to CARMEN"). Game communication area 2418A may then tell SCOTT in words what has occurred, "2,000 Credits Stolen! 5 Free Spins Stolen!", and/or any other words. Modified credit amount image 2428A may show the reduction in number of credits based on the power-up card (e.g., In this example, the player had 10,000, lost 2,000, and now has 8,000). Modified win amount area 2430A may show the change in the win of the last spin based on the effects of the power-up card (e.g., 0 vs. 2,000). It should be noted that in these examples, the first player may be one or more players and the second player may be one or more players.

Figure 25A:
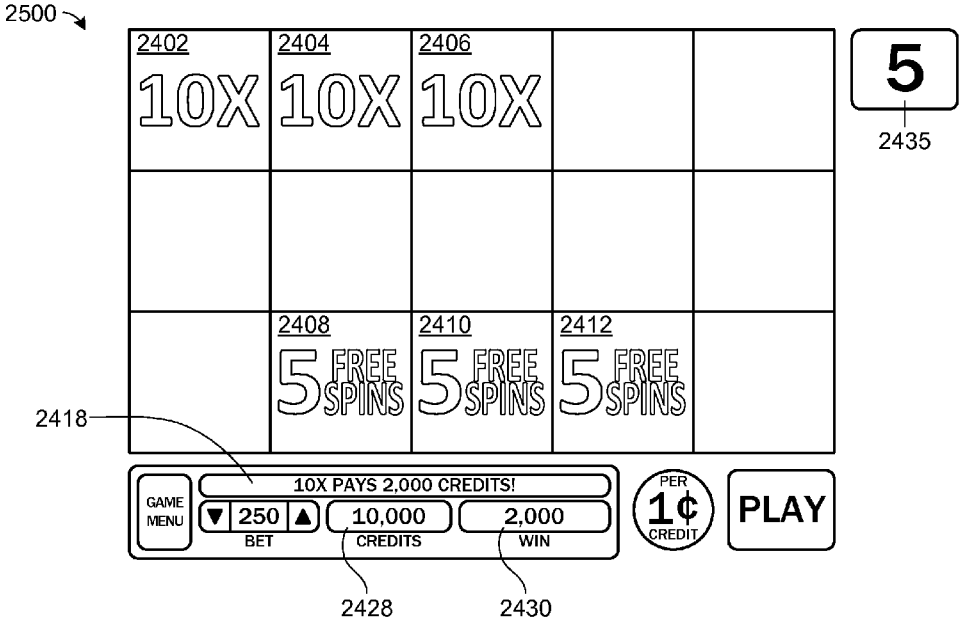
FIG. 25A is another illustration of tournament game play, according to one embodiment.

FIG. 25A is an illustration of tournament game play, according to one embodiment. FIG. 25A may show a third screen image 1000 for electronic gaming device 100 and/or electronic gaming system 200 on display 318. Third screen image 2500 may include first image 2502, second image 2504, third image 2506, fourth image 2508, fifth image 2510, sixth image 2512, game communication area 2518, credit amount image 2528, and win amount area 2530.

First image 2502, second image 2504, third image 2506, fourth image 2508, fifth image 2510, and sixth image 2512 may be any image (e.g., card, letter, bar, cherry, blank, etc.). In this example, on third screen image 2500, first image 2502, second image 2504, and third image 2506 are shown as "10× ", which according to game communication area 2518 represent a win of 2,000 credits. Game communication area 2518 may say, "10× pays 2,000 credits," and/or any other words. In this example, on third screen image 2500, fourth image 2508, fifth image 2510, and sixth image 2512 are show as a win of "5 Free Spins". Credit amount image 2528 may show the amount of credits available to the player for game play. Win amount area 2530 may show the payout amount of the last event. All of the cells may show any image.

Figure 25B:
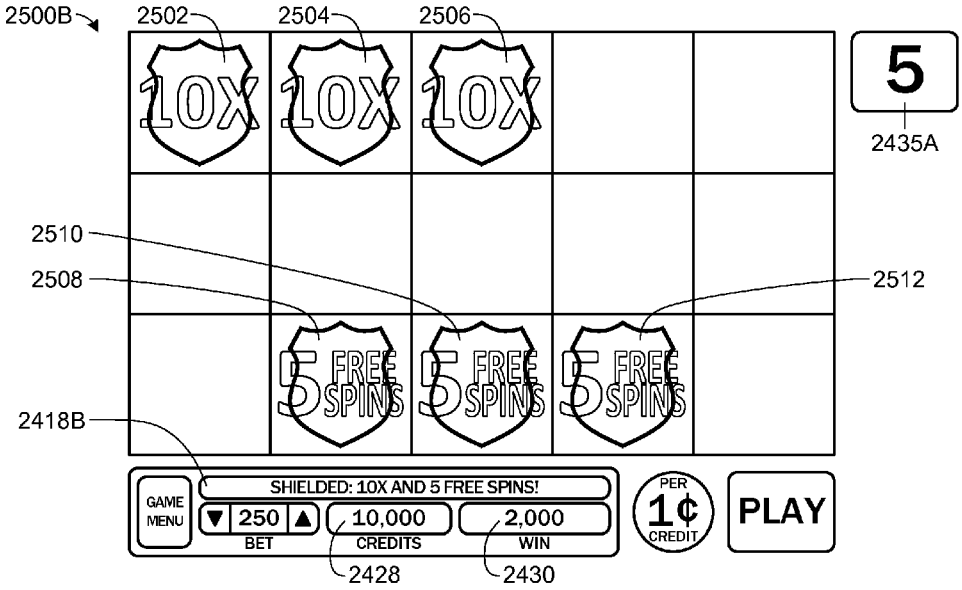
FIG. 25B is another illustration of tournament game play, according to one embodiment.

FIG. 25B is an illustration of tournament game play, according to one embodiment. FIG. 25B may show a fourth screen image 2500B for electronic gaming device 100 and/or electronic gaming system 200 on display 318. Fourth screen image 2500B may include a first shielded image 2502, a second shielded image 2504, a third shielded image 2506, a fourth shielded image 2508, a fifth shielded image 2510, a sixth shielded image 2512, a game communication area 2518A, a credit amount image 2528A, and a win amount area 2530A.

First shielded image 2502 may be a modification of first image 2502 on third screen image 2500, second shielded image 2504 may be a modification of second image 2504 on third screen image 2500, third shielded image 2506 may be a modification of third image 2506 on third screen image 2500, fourth shielded image 2508 may be a modification of fourth image 2508 on third screen image 2500, fifth shielded image 2510 may be a modification of fifth image 2510 on third screen image 2500, and sixth shielded image 2512 may be a modification of sixth image 2512 on third screen image 2500, as a result of the use of a power-up card. Modified game communication area 2518A may tell the player in words what the modified images are displaying graphically (e.g., "Shielded: 10× and 5 Free Spins!") as a result of the use of a power-up card. Modified credit amount image 2528A may show the adjusted amount of credits after the effect of the use of a power-up card. Modified win amount area 2530A may show the adjusted amount of win after the effect of the use of a power-up card. Each modified image may show the effects of a power-up card for the player.

In one example, player "CARMEN" may use a "steal all wins" power-up card to steal any wins which "SCOTT" earns on the next spin. Third screen image 1000 may represent the next spin for SCOTT, with a win of 2,000 credits (e.g., "10×") and the win of five free spins (e.g., "5 Free Spins"). In this example, SCOTT played a "shield" power-up card, enabling him to protect himself from the attack of CARMEN. Fourth screen image 2500B may then represent the results of CARMEN's attack on SCOTT, as shielded. First shielded image 2502, second shielded image 2504, third shielded image 2506, fourth shielded image 2508, fifth shielded image 2510, and sixth shielded image 2512 may be showing SCOTT shielding the theft of his wins. Game communication area 2518B may then tell SCOTT in words what occurred, "Shielded: 10× and 5 Free Spins". Modified credit amount image 2528B may show the protection in number of credits based on the shield power-up card (e.g., SCOTT had 10,000, and with the shield protection, he lost no points, leaving him with 10,000). Modified win amount area 2530B may show that there was no change in the win of the last spin based on the effects of the power-up card (e.g., stays 2,000). In another example, if SCOTT utilized a credit shield power-up card, then SCOTT would have saved the credits but lost the 5 free spins. In another example, if SCOTT utilized a spin shield power-up card, then SCOTT would have saved the 5 free spins, but would have lost the credits. In another example, if SCOTT utilized a multiplier shield power-up card, then SCOTT would have lost both the credits and the spins.

In another example, SCOTT may utilize a "rubber and glue" defense card, which may actually cause the attack to be reversed and used against CARMEN. The "rubber and glue" defense card in this example would give SCOTT the benefit of stealing any wins CARMEN may have had.

Figure 26A:
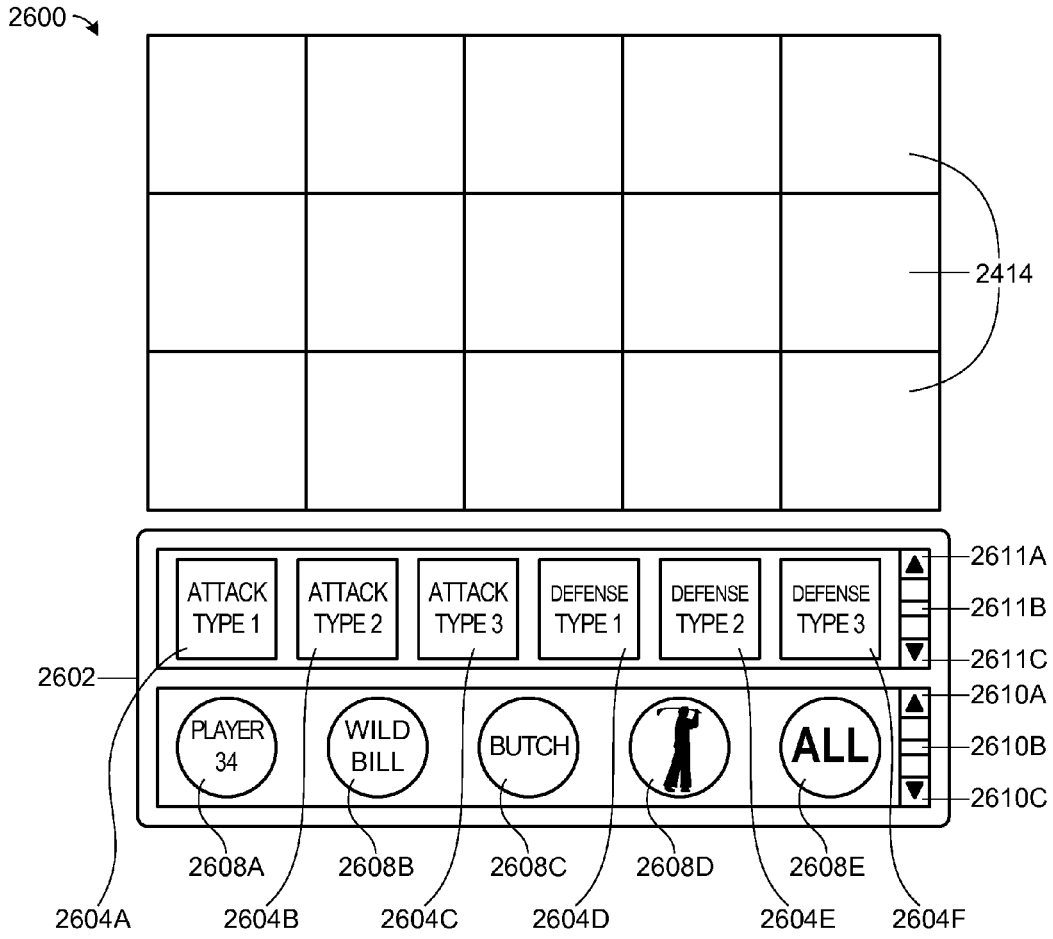
FIG. 26A is another illustration of tournament game play, according to one embodiment.

FIG. 26A is an illustration of tournament game play, according to one embodiment. FIG. 26A may show a screen image 2600 for electronic gaming device 100 and/or electronic gaming system 200 on display 318. Screen image 2600 may include a power-up card selection area 2602, a first power-up card selection 2604A, a second power-up card selection 2604B, a third power-up card selection 2604C, a fourth power-up card selection 2604D, a fifth power-up card selection 2604E, a sixth power-up card selection 2604F, a first player selection 2608A, a second player selection 2608B, a third player selection 2608C, a fourth player selection 2608D, a fifth player selection 2608E, a player selection scroll up button 2610A, a player selection scroll bar 2610B, a player selection scroll down button 2610C, a power-up card selection scroll up button 2611A, a power-up card selection scroll bar 2611B, a power-up card selection scroll down button 2611C, and a payline display area 2614.

Power-up card area 2602 may include information necessary for the use of power-up cards in game play. Power-up card area 2602 may include a list of players currently playing. Power-up card area 2602 may include the ability to select from the list of players currently playing. For example, first player selection 2608A, second player selection 2608B, third player selection 2608C, fourth player selection 2608D, and fifth player selection 2608E may be those players currently playing at another electronic game device 100 and/or electronic gaming system 200, which may be selected for use of power-up cards.

Power-up card area 2602 may include a list of power-up cards available for use. For example, first power-up card selection 2604A, second power-up card selection 2604B, third power-up card selection 2604C, fourth power-up card selection 2604D, fifth power-up card selection 2604E, and sixth power-up card selection 2604F may be those power-up cards which are available for the player and which now may be selected for implementation. In another example, power-up card selection scroll up button 2610A, power-up card selection scroll bar 2610B, and power-up card selection scroll down button 2610C may be utilized to access other power-up cards (e.g., attack type 4, attack type 5, special skill card 1, special skill card 2, defense type 4, defense type 5, another attack type 1, another defense type 1, etc.).

Figure 26B:
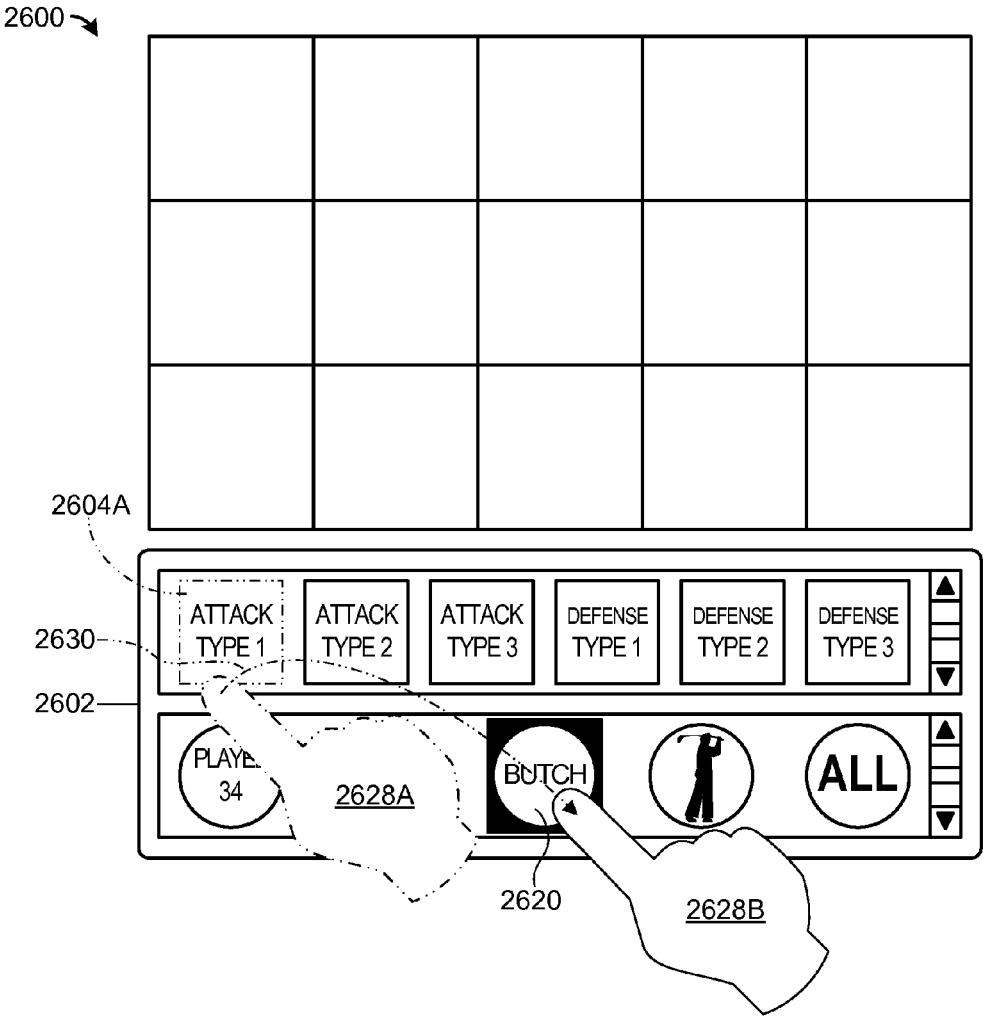
FIG. 26B is another illustration of tournament game play, according to one embodiment.

FIG. 26B is an illustration of tournament game play, according to one embodiment. FIG. 26B may show a screen image 2600A for electronic gaming device 100 and/or electronic gaming system 200 on display 318. Screen image 2600A may include power-up card area 2602, first power-up card selection 2604A, second power-up card selection 2604B, third power-up card selection 2604C, fourth power-up card selection 2604D, fifth power-up card selection 2604E, sixth power-up card selection 2604F, a player selection 2620, a power-up card selection input 2628A, and a player selection input 2628B.

In this embodiment, first power-up card selection 2604A may be selected using power-up card selection input 2628A. Second power-up card selection 2604B may be selected using power-up card selection input 2628A. Third power-up card selection 2604C may be selected using power-up card selection input 2628A. Fourth power-up card selection 2604D may be selected using power-up card selection input 2628A. Fifth power-up card selection 2604E may be selected using power-up card selection input 2628A. Sixth power-up card selection 2604F may be selected using power-up card selection input 2628A. Additionally in this embodiment, player selection 2620 may be selected using player selection input 2628B. The player may utilize any input device (e.g., touch screen, joystick, etc.).

For example, for first power-up card selection 2604A, the player using power-up card selection input 2628A may be select, "Steal Wins Next 5 Spins". The player may then select a target player 2620 ("Butch"), for use of first power-up card selection 2604A by using player selection input 2628B. In one example, by moving power-up card selection input 2628A over first power-up card selection 2604C implements one or more power-up cards. In the event the targeted player wins anything during the next five spins, first power-up card selection 2604A will take the winnings and apply them to the player who implemented first power-up card 2604A. However, if the correct defensive power-up card is utilized, then the attack power-up card would be stopped.

In another example, for second power-up card selection 2604B, the player using power-up card selection input 2628A may select, "Freeze Play 10 Spins". The player may then select target player 2620 ("Butch"), for use of second power-up card selection 2604B by using player selection input 2628B. The targeted player may then be frozen out for 10 spins. In one example, the freezing of the spins may be represented by electronic gaming device 100 and/or electronic gaming system 200 reducing credits available for wagering by an amount of credits representing 10 spins (e.g., 10 credits at 1 credit per spin, 20 credits at 2 credits per spin, etc.). The freezing of the spins may be represented by electronic gaming device 100 and/or electronic gaming system 200 halting the player's ability to play for an amount of time equal to 10 spins (e.g., 1 second per spin, 5 seconds per spin, etc.). The freezing of the spins may be represented by any negative impact to the player.

In another example, for third power-up card selection 2604C, the player using power-up card selection input 2628A may select, "Block Wins Next 5 Spins". The player may then select target player 2620 ("Butch"), for use of third power-up card selection 2604C, by using player selection input 2628B. In the event the targeted player wins anything during the next five spins, third power-up card selection 2604C will take the winnings and/or eliminates the winnings.

In another example, for fourth power-up card selection 2604D the player using power-up card selection input 2628A may select 2604D, "Shield Self from Credit Attack". The player may then select target player 2620 ("Butch"), for use of fourth power-up card selection 2604D, by using player selection input 2628B. In the event the targeted player tries to the credit attack the player who implemented fourth power-up card selection 2604D, the credit attack will have no effect on the player for some amount of time (e.g., 1 minute, 5 minutes, 10 minutes, etc.). This power-up shield may work for a number of spins, an amount of time, and/or any other method of tracking usage. This power-up shield may work to protect the player from specific players, from multiple selected players, from some sub-set of players (e.g., opposing team), and/or from all players.

Figure 26C:
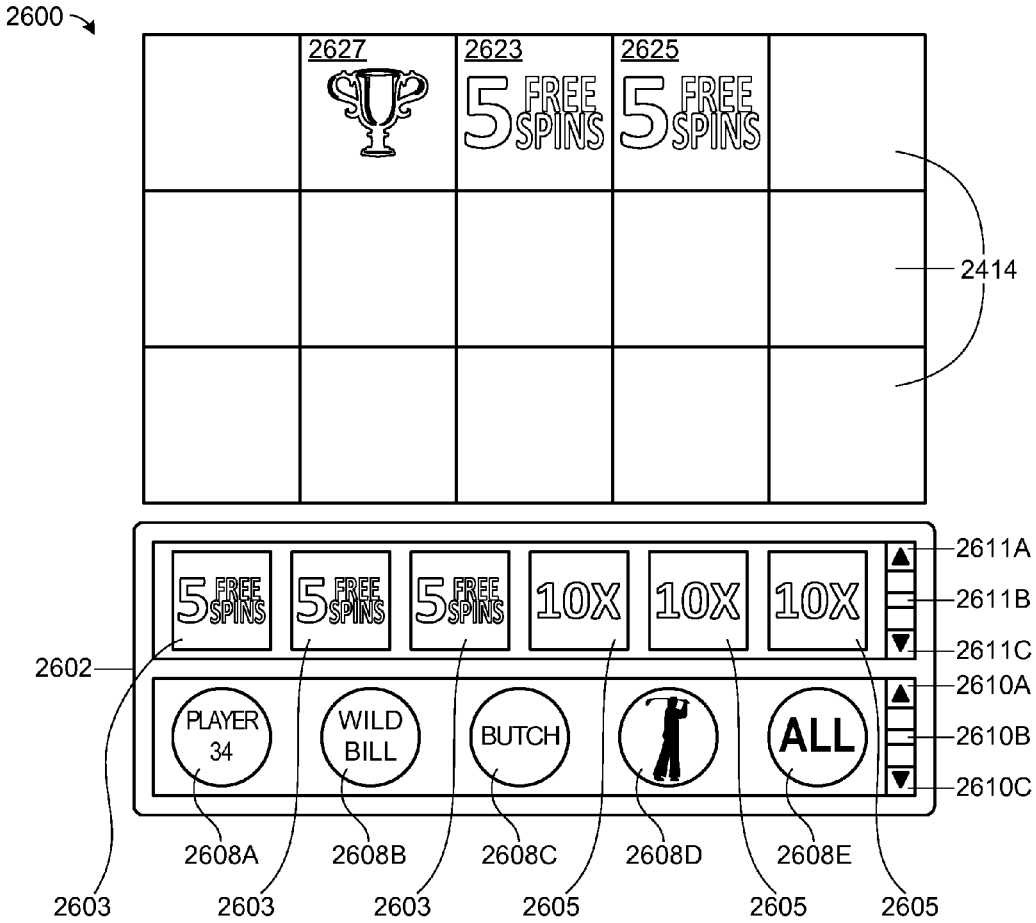
FIG. 26C is another illustration of tournament game play, according to one embodiment.
Figure 26D:
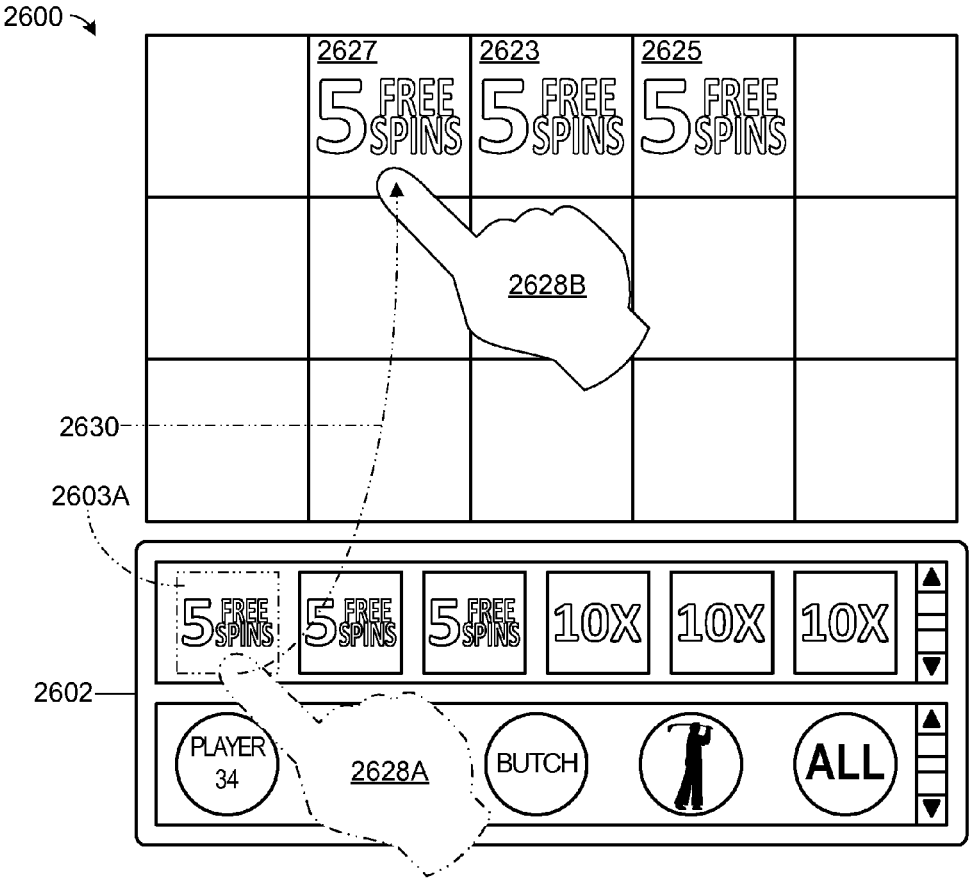
FIG. 26D is another illustration of tournament game play, according to one embodiment.
Figure 26E:
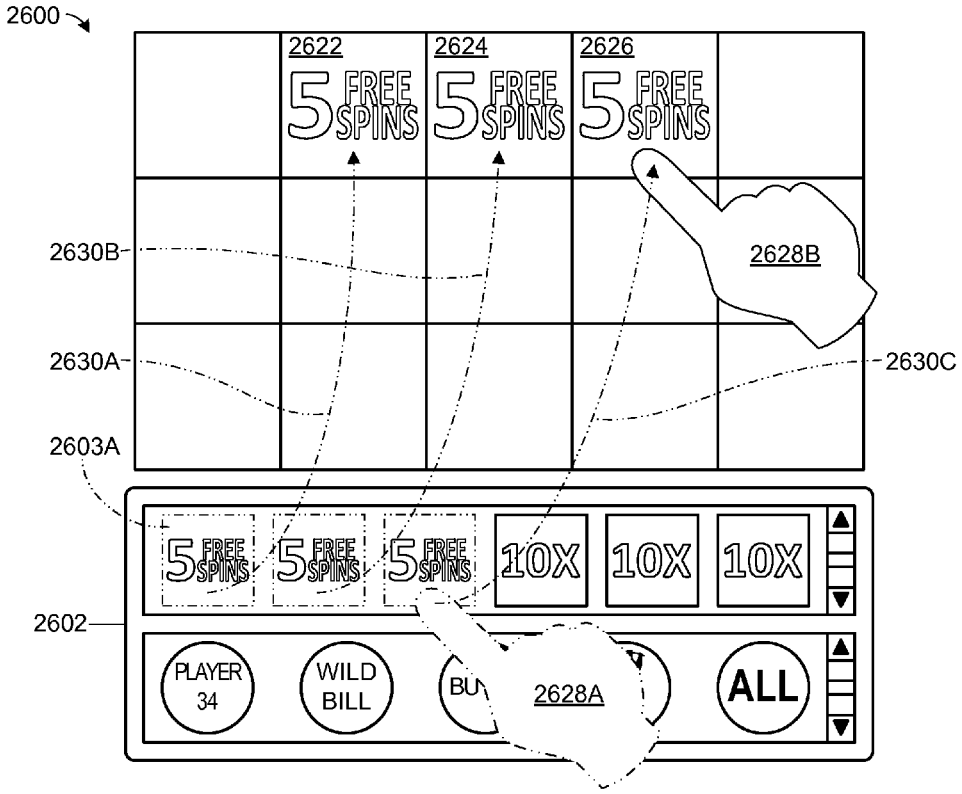
FIG. 26E is another illustration of tournament game play, according to one embodiment.
Figure 26F:
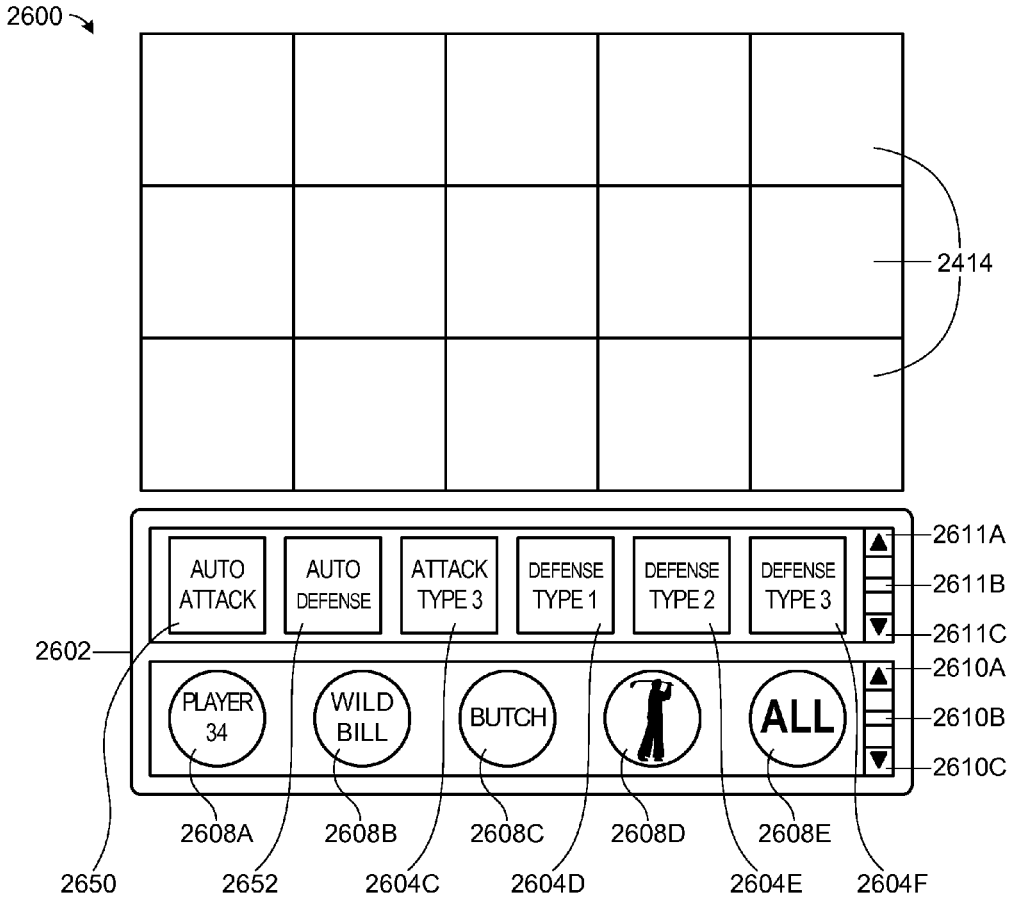
FIG. 26F is another illustration of tournament game play, according to one embodiment.

FIG. 26C is another illustration of power-up game play, according to one embodiment. Screen image 2600 may include a first non-winning symbol 2627, a first 5 free spins symbol 2623, a second 5 free spins symbol 2625, one or more first replacement symbols 2603, and one or more second replacement symbols 2605. There may be any number (e.g., 1-N) of symbols and/or replacement symbols. In this example, there is no winning outcome because only two 5 free spins symbols (e.g., first 5 free spins symbol 2623 and second 5 free spins symbol 2625 landed on plurality of reels 2614) were shown when the gaming structure required three 5 free spins symbols to be displayed for a winning outcome. In one example, the player via power-up card selection input 2628A may select (e.g., 2630, 2603A, 2628A, and/or 26288) one or more of the one or more first replacement symbols 2603 to replace first non-winning symbol 2627 with a 5 free spins symbol to complete a winning outcome (see FIG. 26D). In another example, one or more second replacement symbols 2605 may be utilized to create a multiplier winning outcome. Further, any symbol, such as, credit symbols, free spin symbols, scatter symbols, wild symbols, multiplier symbols, and/or any other symbols may be utilized to complete a winning combination. In another example, one, a few, a plurality, and/or all of the replacement symbols may be utilized at the same time to create a winning combination. In one example, all of first replacement symbols 2603 are selected (e.g., 2603A, 2630A, 2630B, 2630C, 2628A, and/or 26288) to replace a first symbol area 2622, a second symbol area 2624, and a third symbol area 2626 (see FIG. 26E). In another example, an auto attack 2650 and/or an auto defense 2652 may be utilized (see FIG. 26F). For example, auto attack 2650 may be utilized to automatically use one or more selected (e.g., randomly, predetermined pattern, pre-selected pattern, pre-selected card formation, etc.) cards against one or more selected (e.g., randomly, predetermined pattern, pre-selected players, pre-selected pattern, etc.) players. This may occur at random intervals during game play. This may occur on a predetermined pattern and/or a player selected pattern. In another example, auto defense 2652 may be utilized to automatically use one or more selected (e.g., randomly, predetermined pattern, pre-selected pattern, pre-selected card formation, etc.) cards against one or more determined and/or anticipated attacks. In this example, auto defense 2652 may utilize the best card to defend against a specific attack automatically.

Figure 27A:
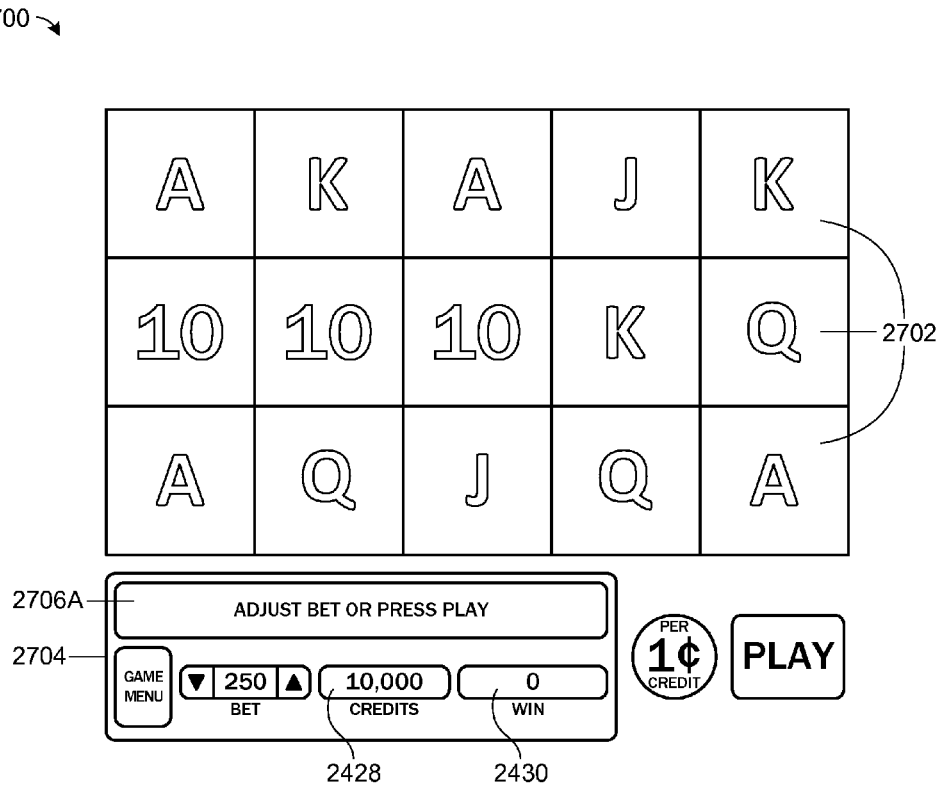
FIG. 27A is another illustration of tournament game play, according to one embodiment.

FIG. 27A is an illustration of tournament game play, according to one embodiment. FIG. 27A may show a screen image 2700 for electronic gaming device 100 and/or electronic gaming system 200 on display 318. Screen image 2700 may include one or more paylines 2702, a game data area 2704, a game communication area 2706A, credit amount image 2728, and win amount area 2730.

Payline 2702 may display the outcome of the wagering event. Game data area 2704 may include additional data relating to the game. For example, game data area 2704 may include game communication area 2706A, game menu button, bet reducer button, bet increaser button, bet amount image, credit amount image 2728, and win amount area 2730, and/or any combination thereof.

Game communication area 2706A may display message(s) to the player. In FIG. 27A, game communication area 2706A states, "ADJUST BET OR PRESS PLAY". Game communication area 2706A may display this and/or any message.

Figure 27B:
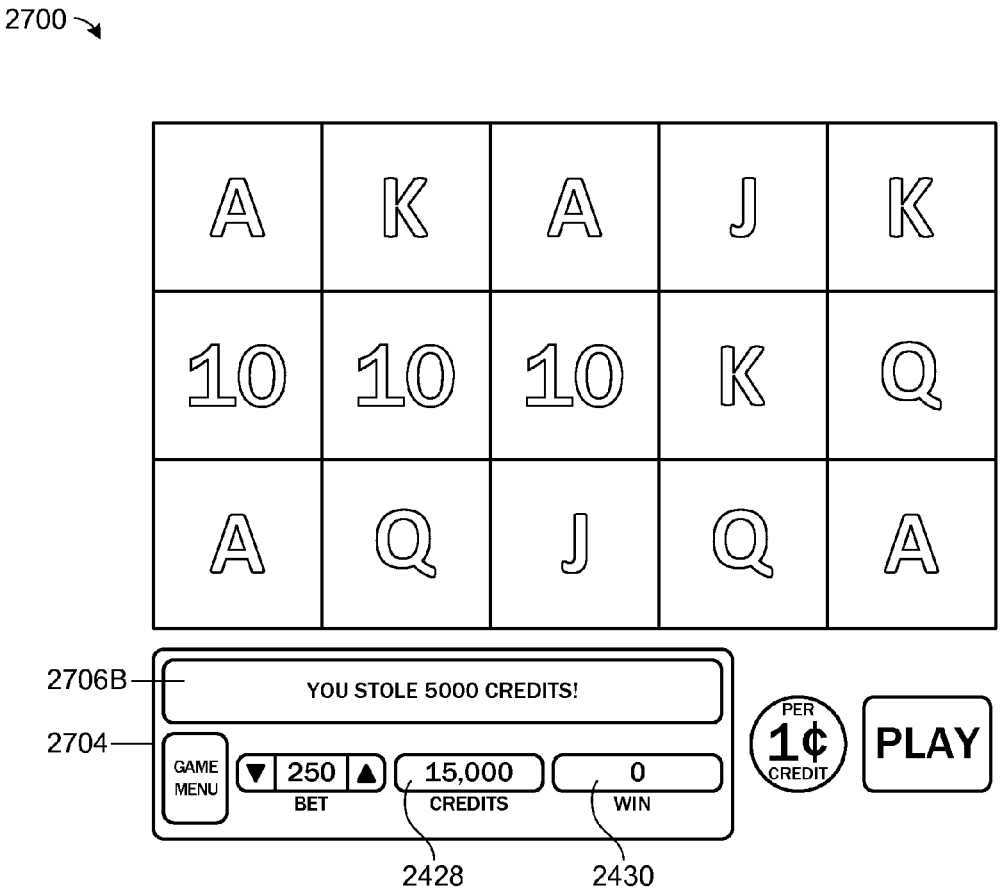
FIG. 27B is another illustration of tournament game play, according to one embodiment.

FIG. 27B is an illustration of tournament game play, according to one embodiment. FIG. 27B may show screen image 2700 for electronic gaming device 100 and/or electronic gaming device 200 on display 318. Screen image 2700 may include game data area 2704, a modified game communication area 2706B, credit amount image, and win amount area.

Modified game communication area 2706B may display a message to the player. In FIG. 27B, modified game communication area 2706B states, "YOU STOLE 5000 CREDITS". Modified game communication area 2706B may display this and/or any message.

For example, modified game communication area 2706B may display the outcome of a power-up card being played to attack another player. On screen image 2700, the message on 2706B is telling the player that their power-up card was successful in stealing 5,000 credits from another player in the tournament. Credit amount image has been modified to show 15,000 credits now available, which is different than 10,000 credits shown in FIG. 27A.

Figure 27C:
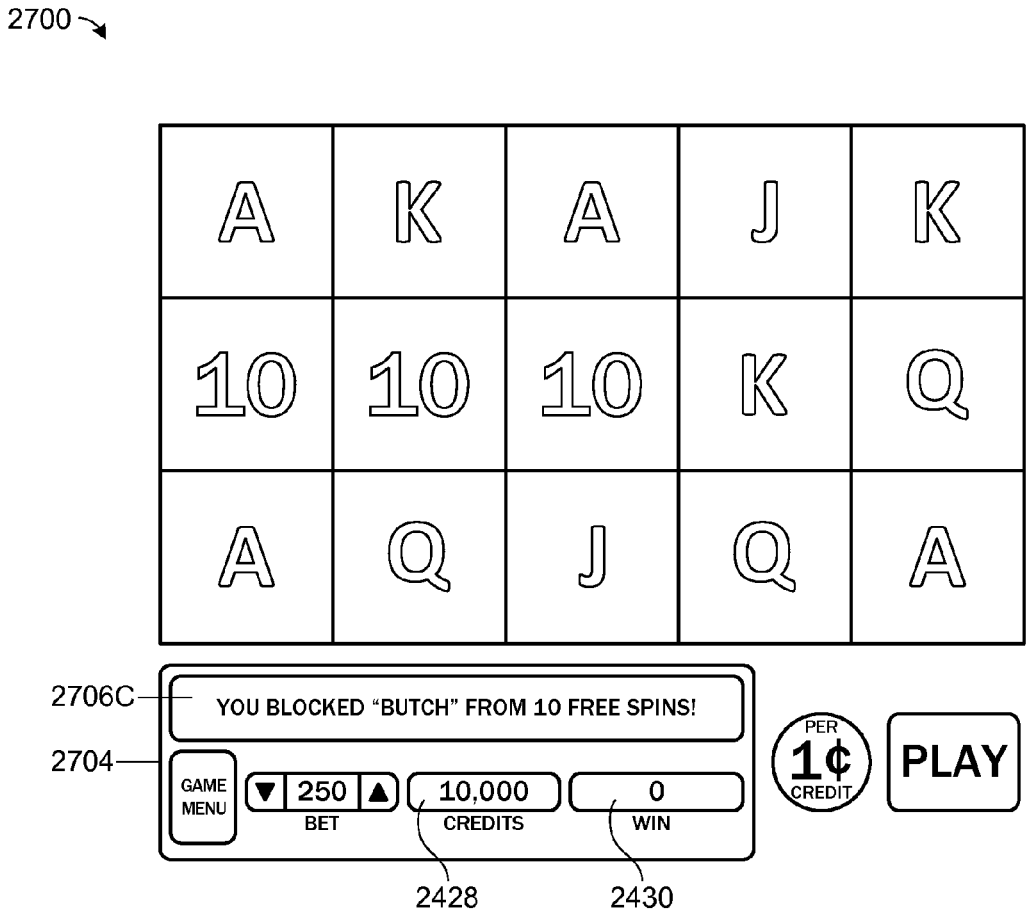
FIG. 27C is another illustration of tournament game play, according to one embodiment.

FIG. 27C is an illustration of tournament game play, according to one embodiment. FIG. 27C shows a screen image 2700 for electronic gaming device 100 and/or electronic gaming device 200 on display 318. Screen image 2700 may include game data area 2704, a modified game communication area 2706C, credit amount image, and win amount area.

Modified game communication area 2706C may display message(s) to the player. In FIG. 27C, modified game communication area 2706C states, "YOU BLOCKED "BUTCH" FROM 10 FREE SPINS".

For example, modified game communication area 2706C may display the outcome of a power-up card being played to attack another player. In FIG. 27C, the message on modified game communication area 2706C is telling the player that their power-up card was successful in blocking Butch from winning 10 free spins in the tournament.

Figure 27D:
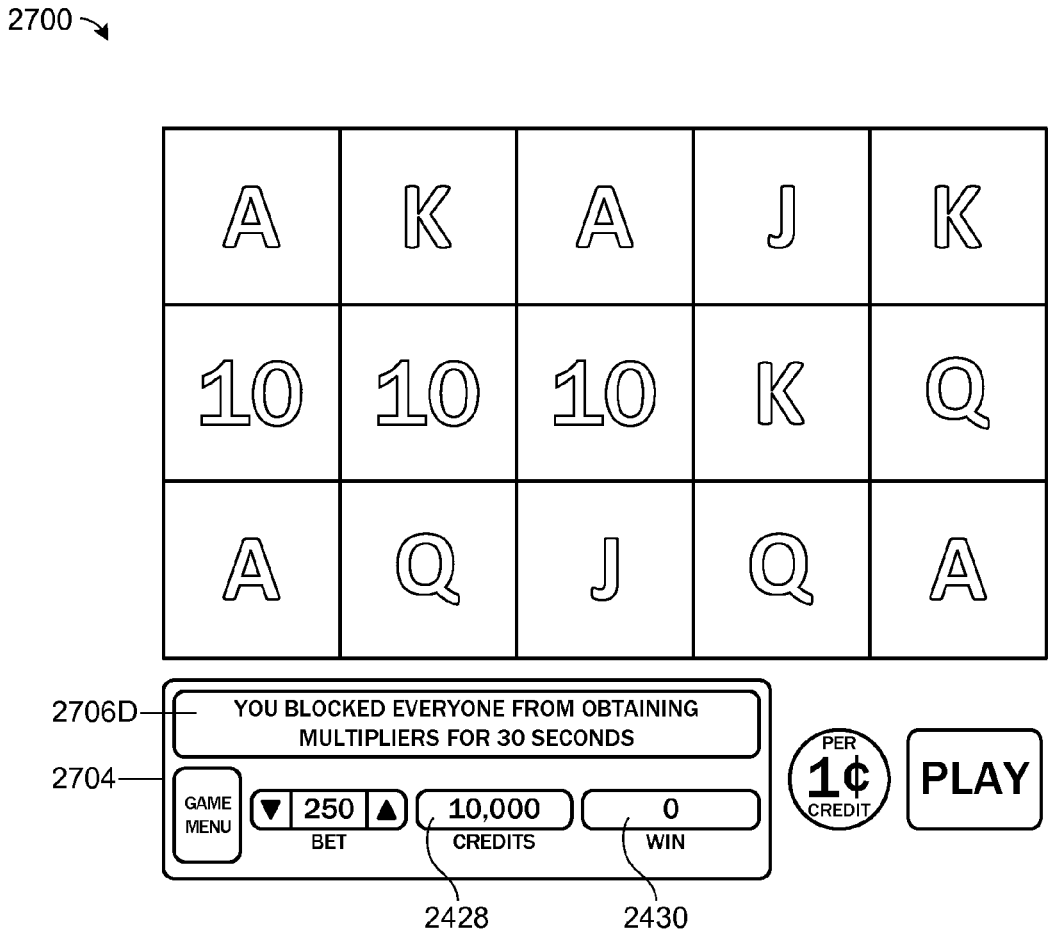
FIG. 27D is another illustration of tournament game play, according to one embodiment.

FIG. 27D is an illustration of tournament game play, according to one embodiment. FIG. 27D may show a screen image 2700 for electronic gaming device 100 and/or electronic gaming device 200 on display 318. Screen image 2700 may include game data area 2704, a modified game communication area 2706D, credit amount image, and win amount area.

Modified game communication area 2706D may display one or more messages to the player. In FIG. 27D, modified game communication area 2706D states, "YOU BLOCKED EVERYONE FROM OBTAINING MULTIPLIERS FOR 30 SECONDS". Modified game communication area 2706D may display this and/or any message.

For example, modified game communication area 2706D may display the outcome of a power-up card being played to attack another player. In FIG. 27D, the message on modified game communication area 2706D is telling the player that their power-up card was successful in blocking everyone from obtaining multipliers for a 30 second period of time during the tournament.

Figure 28:
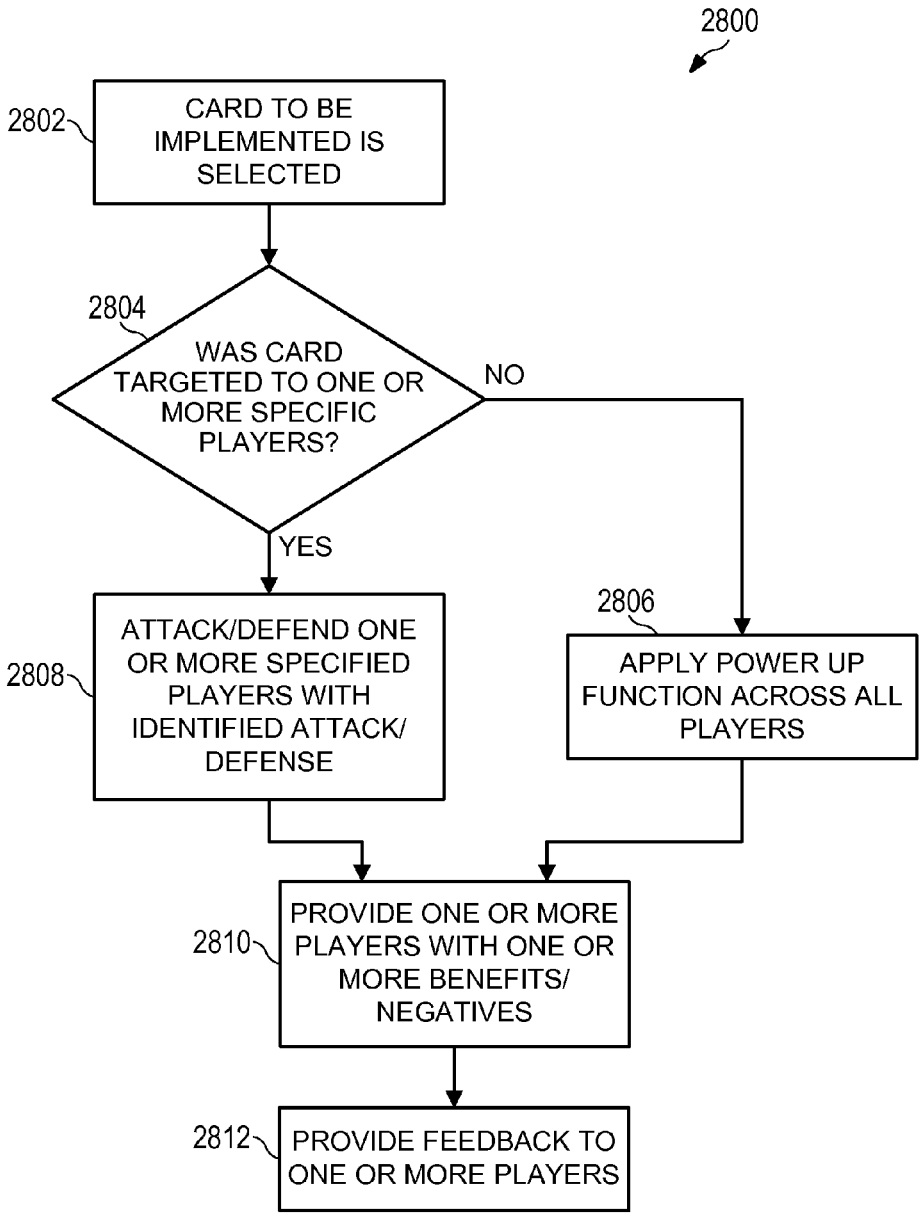
FIG. 28 is a flow diagram illustrating the use of power-up cards in a tournament game play, according to one embodiment.

FIG. 28 is a flow diagram illustrating the use of power-up cards in a tournament game play. The method may include selection of a card to be implemented (step 2802). The method may include determining if the power-up card is targeted to one or more specific players (step 2804). If the power-up card is not targeting to one or more specific players, the method may include applying one or more power-up cards (e.g., attack power-up cards and/or defense power-up cards) across all players (step 2806). If the power-up card is targeted to one or more specific players, the method may include attacking and/or defending the identified players (step 2808). The method may include providing one or more players with one or more benefits and/or damages associated with the implemented power-up card (step 2810). The method may include providing the player who played one or more power-up card(s) with feedback of the attack and/or benefit, and/or the method may include providing the player who was attacked by the power-up card feedback of the results (step 2812).

For example, when the player, "CARMEN" has a power-up card available for use, CARMEN may elect to use a "stop a specific player from playing next 5-spins" power-up card. Then CARMEN may be asked which player to use the power-up card against (e.g., attack). If CARMEN elected to use it against "SCOTT", SCOTT may then receive a notification that he was attacked by a power-up card from CARMEN and CARMEN may receive notification of the success of his attack against SCOTT. In a further example, SCOTT may be notified of the pending attack in advance and given an amount of time (e.g., 1 second, 5 seconds, 10 seconds, etc.) to shield himself if he has a shield power-up card available. In a further example, SCOTT may have implemented a "shield for next 10 plays" card, which would shield SCOTT from CARMEN's (or any other players attack). Both SCOTT and CARMEN may then receive notification of the attack and the shielding. In one example, the notification may inform the player that an attack is coming but not what type of attack. In another example, the notification may inform the attacking player that the target player has a defense up but not what type of defense is in place.

In another example, the tournament may have teams. In this example, rather than the power-up card being used against just one individual, the player may elect to use the "stop a specific player from playing next 5-spins" card against the entire team. By doing so, the entire team would have to halt play, allowing the team which implemented the power-up card to potentially move ahead. The targeted team may then be frozen out for 5-spins. In another example, by utilizing a power-up card on a team, as opposed to an individual, may dilute the functionality of the power-up card. For example, instead of the power-up card stopping one player from spinning for 5 turns, the power-up card may stop an entire team from spinning for 3 turns.

In another example, the tournament may have teams. For example, rather than the power-up card being used to defend just one individual, the player may elect to use the "shield for next 10 plays" card (or next 5 minutes, and/or any other duration), for the benefit of their entire team. By doing so, the entire team may be protected from opponent team power-up card attacks. In another example, by utilizing a power-up card for a team, as opposed to an individual, may dilute the functionality of the power-up card. For example, instead of the power-up card credit attacking one player from spinning for 5 turns, the power-up card may credit attack an entire team from spinning for 3 turns.

Figure 29:
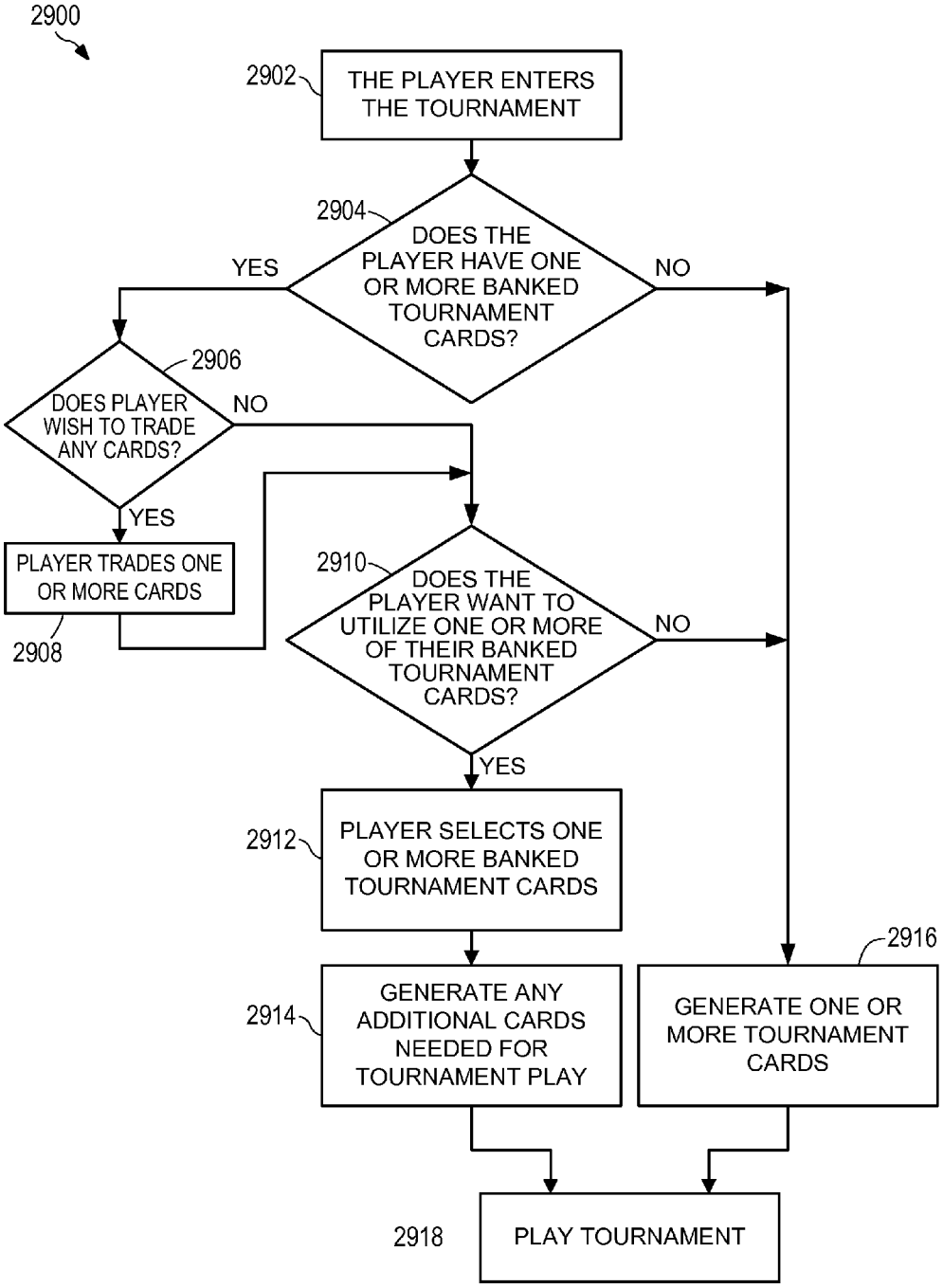
FIG. 29 is another flow diagram illustrating the use of power-up cards in a tournament game play, according to one embodiment.

FIG. 29 is a flow diagram of power-up cards being used in tournament play 2900, according to one embodiment. The method may include the player (and/or team) entering the tournament (step 2902). The method may include a determination if the player account has power-up cards banked (step 2904). The method may include, if the player has banked power-up cards, asking the player if they would like to see what power-up cards are available to trade (step 2906). If the player elects to review trading, the method may include evaluation if the player makes a trade (step 2908). If the player has power-up cards the method may include allowing the player to elect to use banked power-up cards (step 2910). In the event the player elects to use banked power-up cards, the method may include the player selecting one or more banked power-up cards (step 2912). The method may include generating additional power-up cards, if needed for tournament play (step 2914). If the player has no power-up cards and/or elects not to use the banked cards, the method may include generating one or more power-up cards (step 2916). Once the player has necessary power-up cards, the method may include playing in the tournament (step 2918).

For example, in the event the tournament allows for the use of up to five power-up cards and a player only has three power-up cards in their bank of cards, the player may be presented with a list of power-up cards from which they may select two additional power-up cards. The additional power-up cards may be offered to the player for an additional amount of credits, free, offered only to certain players (e.g., player level), offered only to frequent players, and/or any other criteria.

In another example, five power-up cards are necessary for play. If the player chooses to only utilize one of their banked power-up cards, they may be presented with a list of power-up cards from which they may select four additional power-up cards.

In another example, if the player doesn't want to be limited to utilizing their banked power-up cards, the player may elect to go to a power-up card trading bank. In the trading bank, other players may list power-up cards they are willing to trade and/or which power-up cards they would like to receive. For instance, Player A may put a "Steal Wins for Next 5 Spins" power-up card on the available listing. Player B may want Player A's power-up card and will offer "Shield for 5 minutes" power-up card in return. Player A may then receive a message notifying Player A of Player B's desire to trade. Player A may elect to accept or deny the trade.

In another example, card trading module may be automated. Player A may be planning on leaving the casino, but wants to still allow a trade to take place in their absence. Player A may put a "Steal Wins for Next 5 Spins" power-up card on the available listing along with which cards Player A is willing to accept in return (e.g., Player A wants any "Shield" power-up cards and is willing to give a "Steal Wins for Next 5 Spins", Player A wants a "Steal Wins for Next 2 Spins" power-up card and is willing to give any "Shield" power-up cards, etc.). In another example, the list may include one or more cards that would be acceptable to the player to automatically complete one or more trades.

In another example, power-up cards may have a ranking assigned. In this situation Player A may say they will trade the "Steal Wins for Next 5 Spins" power-up card for any card with a rank in excess of a predetermined level (e.g., 1-N). Power-up cards may be ranked by any method of ranking (e.g., point value, school grade (A-F), metal (Gold, Silver, Bronze, Iron, Lead), etc.).

Figure 30A:
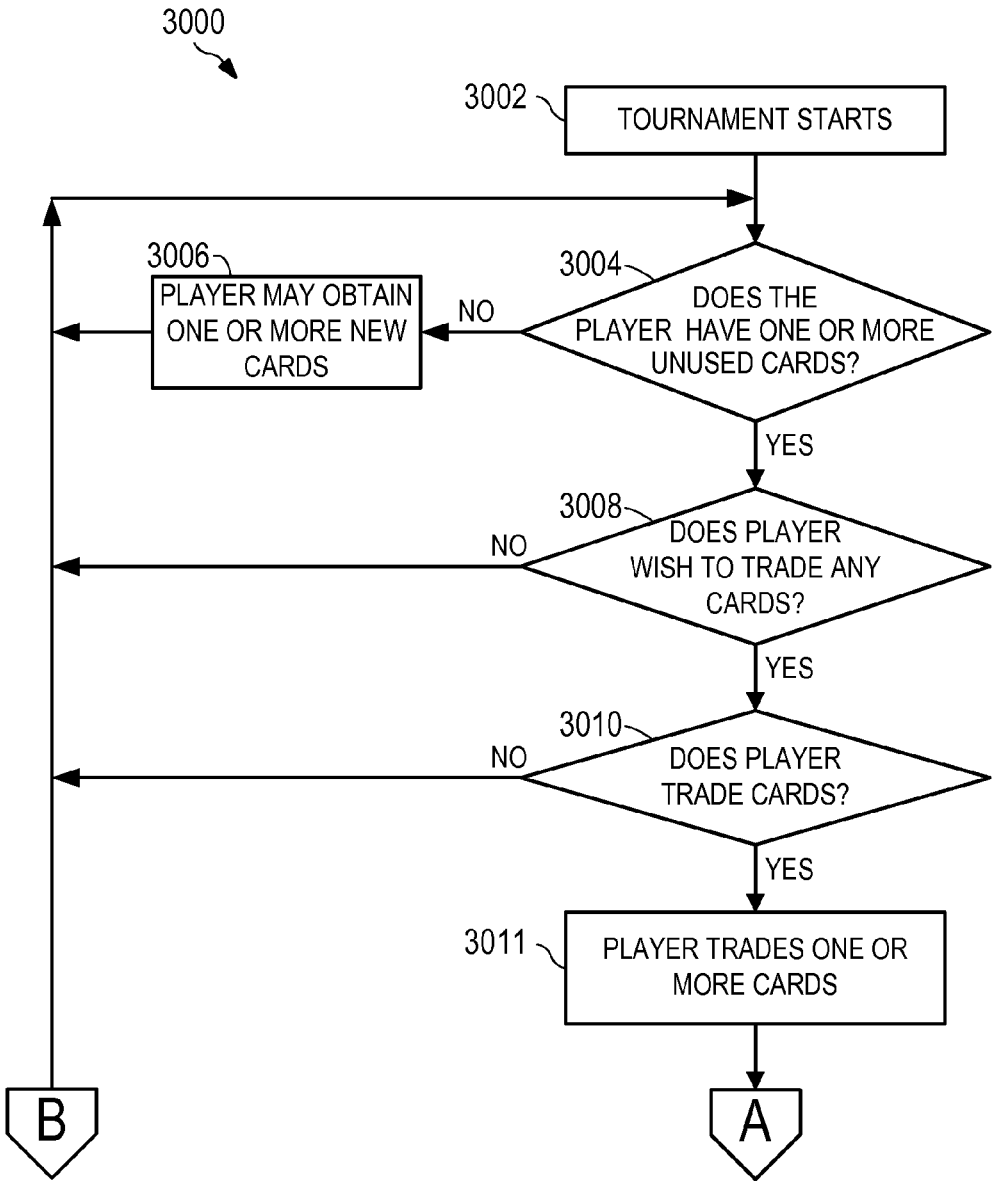
FIG. 30A is another flow diagram illustrating the use of power-up cards in a tournament game play, according to one embodiment.
Figure 30B:
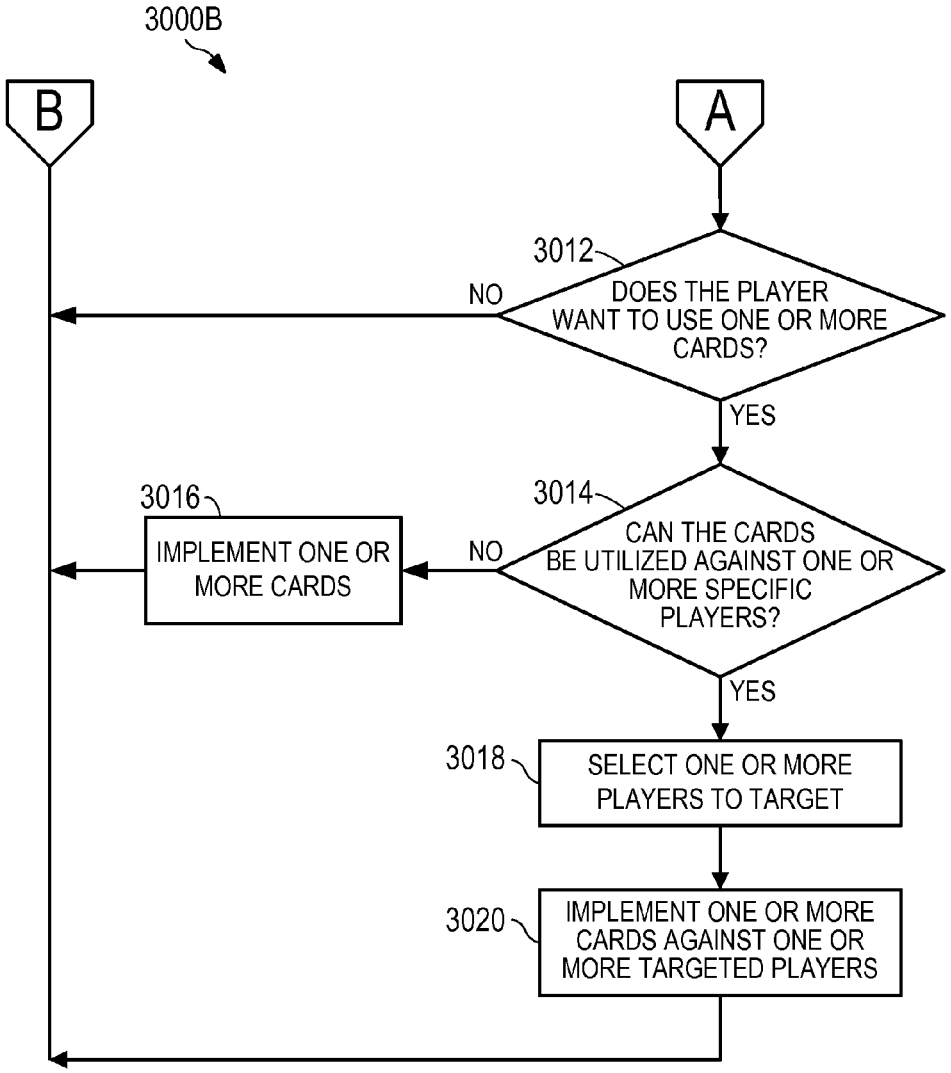
FIG. 30B is another flow diagram illustrating the use of power-up cards in a tournament game play, according to one embodiment.

FIG. 30 is a flow diagram of tournament play with use of power-up cards, according to one embodiment. The method may include the tournament starting (step 3002). The method may include determining if the player has one or more unused power-up cards (step 3004). if the player does not have one or more unused power-up cards, the player may be asked to get a power-up card (step 3006). The method may include if the player has banked power-up cards, asking the player if they would like to see what power-up cards are available to trade (step 3008). If the player elects to review trading, the method may include evaluation if the player makes a trade (step 3010). If the player does have available power-up cards, the method may include asking the player if they want to use one or more of their power-up cards (step 3012). If the player chooses to use one or more of their banked power-up cards, the method may include determining if the power-up card can be utilized against one or more specific players (step 3014). If the power-up card cannot be used against specific players, it may be applied to all the players (step 3016). If the power-up card may be utilized against one or more specific players, the player may be asked to select a player or players to target (step 3018). The method may then include implementing one or more cards against one or more targeted players (step 3020). The method may return to step 3004.

For example, if the player does not have one or more unused cards the player may be directed by electronic gaming device 100 and/or electronic gaming device 200 and/or any other source of direction, to the location where they may obtain power-up cards for use in the tournament. The player may be directed to any source for obtaining cards (e.g., bartender, tournament host/hostess, a location within the casino, and/or any other location where a power-up card could be distributed to players).

In another example, when the player has a power-up card available for use, the player may elect to use a "steal one spin from all players" power-up card. The player would then receive one spin from each player who has not utilized an "all shield" and/or spin shield power-up card.

In another example, when the player has a power-up card available for use, the player may elect to use a "shield from other player spin attack" power-up card. The player in the example above would then not receive one spin from the player who has utilized the spin shield power-up card because they were protected against a spin attack. The player could have also utilized an all shield power-up card.

In another example, a tournament structure may be enhanced by having an energy drink branded (e.g., Red Drink Bull, etc.) exciter card, which may let the player's spin rate double for a specific amount of time (e.g., 3 seconds, five seconds, 1 minute, etc.).

In another embodiment, the method of providing gaming options via an electronic gaming device may include receiving one or more primary wagers on one or more paylines, starting a bonus game, determining one or more values, and/or selecting one or more presentations based on the one or more values.

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on one or more paylines. The processor may receive one or more secondary wagers on one or more selected paylines (e.g., repeat paylines, patterns, scenarios, etc.). The selected paylines may be based on data received from a player. The processor may determine a selected payline's payout based on the one or more selected paylines (e.g., repeat paylines, patterns, scenarios, etc.).

In another embodiment, the processor may determine a payout based on the primary wagers. The electronic gaming device may include a network interface, which may receive data from at least one of a server and one or more gaming devices. The electronic gaming device may include a display, which may display one or more selected paylines.

In another example, the display may shade one or more non-selected paylines. The electronic gaming device may include a player preference input device. The player preference input device may modify a game configuration based on data from an identification device. The processor may multiply a prize value based on a selected payline occurrence.

In another example, the method may include displaying a game status image. The method may also include shading one or more completed objectives (e.g., tournament level selecting any element, obtaining a repeat payline, etc.).

In another embodiment, the electronic gaming system may include a server. The server may include a server memory, a server processor, and a signage server. The server memory may include historical gaming data. The server processor may generate a gaming message based on the historical gaming data. The signage server may transmit the gaming message.

In another example, the gaming message may be transmitted to an internal display of a gaming entity. The internal display may be a non-gaming device display. The gaming message may be transmitted to an external display of a gaming entity. The external display may be located outside of a gaming entity. The gaming message may be transmitted to at least one of a top display, a main display, and a side display.

The plurality of reels may form a 5-by-5 matrix, a 3-by-5 matrix, a 4-by-5 matrix, a 4-by-3 matrix, a 5-by-3 matrix, or any number-by-any number matrix. The symbols may be an image of a card, an image, and/or other objects. For example, it could be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

The disclosed features may be part of the base game, a bonus game, and/or tournament game play. In addition, the disclosed features may be part of a base bet and/or may require an additional side bet (e.g., ante bet).

In one embodiment, the electronic gaming device may include a plurality of reels. One or more paylines may be formed on at least a portion of the plurality of reels. The electronic gaming device may include a memory and one or more processors. The memory may include one or more tournament game structures. The one or more processors may initiate one or more tournaments based on one or more tournament game structures.

In one example, the tournament management system implements a smooth transition from the tournament play session back to standard play on the same slot machine. The tournament management system may allow for near instant and automatic transition of the game from tournament mode to standard play mode. In another example, a switch may be manually controlled to allow either the player or the casino operator to delay the change of mode from tournament to standard. Upon completion of a tournament, the main game screen may display the tournament results, one or more advertisements, and/or one or more sponsor information. In another example, a full screen advertisement may be shown immediately afterwards before moving on to the standard play mode. In another example, upon tournament completion, the management system may print a result ticket for the player, showing their final position in the tournament. This ticket may include a barcode or a QR code from the advertiser for use on a mobile device, PC, and/or kiosk giving the player some consolation prize, coupon, and/or merchandize claim ID. Further, a second ticket after the results ticket could be used in lieu of having both the tournament result and the advertiser code on the same ticket. These prizes may be given out to all players, or just the winning player, or just the losing players, depending on the type of promotion used.

In one embodiment, an electronic gaming device may include a memory, one or more processors, and a plurality of reels. One or more paylines may be formed on at least a portion of the plurality of reels. The memory may include one or more tournament game structures. The memory may also include one or more advertisement structures. The one or more processors may initiate one or more tournaments based on one or more tournament game structures. The one or more processors may initiate one or more advertisements based on at least one of the one or more advertisement structures and one or more triggering events.

In another example, the one or more processors may initiate a first advertisement based on a first tournament time. In one example, the one or more processors may initiate a second advertisement based on a second tournament time. In an example, a first tournament of the one or more tournaments is an asynchronous tournament. In another example, a second tournament of the one or more tournaments is a synchronous tournament.

In one example, the one or more processors may initiate one or more modified advertisements where the one or more modified advertisements are modified based on one or more player data. In an example, the one or more modified advertisements are further modified based on a tournament time period. In another example, the one or more processors may initiate a first advertisement based on a first tournament time, wherein the first tournament time is an intermission time period for the tournament. In another example, the one or more processors may initiate one or more sponsor presentations.

In another embodiment, a method of providing tournament gaming options via an electronic gaming device may include: starting one or more tournaments and initiating one or more advertisements during an implementation of the one or more tournaments.

In various examples, the method may include: initiating a first advertisement based on a first tournament time; initiating a second advertisement based on a second tournament time; and/or initiating one or more modified advertisements where the one or more modified advertisements are modified based on one or more player data.

In another example, a first tournament of the one or more tournaments is an asynchronous tournament. In one example, a second tournament of the one or more tournaments is a synchronous tournament.

In another embodiment, an electronic gaming system may include a server, which includes a server memory and a server processor. The server memory may include one or more tournament game structures. The server memory may also include one or more advertisement structures. The server processor may initiate the one or more tournaments based on one or more tournament game structures. The server processor may initiate one or more advertisements based on at least one of the one or more advertisement structures and one or more triggering events.

In another example, the server processor may initiate a first advertisement based on a first tournament time. In one example, the server processor may initiate a second advertisement based on a second tournament time. In another example, a first tournament of the one or more tournaments is an asynchronous tournament. In one example, a second tournament of the one or more tournaments is a synchronous tournament.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methods and/or methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

a plurality of display areas;

one or more paylines formed on at least a portion of the plurality of display areas;

a memory, the memory including one or more tournament game structures, the memory further including one or more advertisement structures; and one or more processors configured to initiate one or more tournaments based on one or more tournament game structures, the one or more processors configured to initiate one or more advertisements based on at least one of the one or more advertisement structures and one or more triggering events;

wherein the one or more processors are configured to initiate a first advertisement based on a first tournament time where the first tournament time is an intermission time period for a first tournament;

wherein the one or more paylines are utilized in game play during the first tournament.

2. The electronic gaming device of claim 1, wherein the one or more processors are further configured to initiate a second advertisement based on a second tournament time.

3. The electronic gaming device of claim 1, wherein the first tournament of the one or more tournaments is an asynchronous tournament.

4. The electronic gaming device of claim 1, wherein a second tournament of the one or more tournaments is a synchronous tournament.

5. The electronic gaming device of claim 1, wherein the one or more processors are further configured to initiate one or more modified advertisements where the one or more modified advertisements are modified based on one or more player data.

6. The electronic gaming device of claim 1, wherein the one or more processors are further configured to initiate one or more modified advertisements where the one or more modified advertisements are modified based on a tournament time period.

7. The electronic gaming device of claim 1, wherein the one or more processors are further configured to initiate one or more sponsor presentations.

8. A method of providing tournament gaming options via an electronic gaming device where the electronic gaming device includes a plurality of display areas and one or more paylines formed on at least a portion of the plurality of display areas, the method comprising:

starting via one or more processors a first tournament initiating via the one or more processors one or more advertisements during an implementation of the first tournament; and initiating via the one or more processors a first advertisement based on a first tournament time where the first tournament time is an intermission time period for the first tournament; wherein the one or more paylines are utilized in game play during the first tournament.

9. The method of claim 8, further comprising initiating a second advertisement based on a second tournament time.

10. The method of claim 8, wherein the first tournament of the one or more tournaments is an asynchronous tournament.

11. The method of claim 8, wherein a second tournament of the one or more tournaments is a synchronous tournament.

12. The method of claim 8, further comprising initiating one or more modified advertisements where the one or more modified advertisements are modified based on one or more player data.

13. An electronic gaming system comprising:

a server including a server memory and a server processor, the server memory including one or more tournament game structures, the server memory further including one or more advertisement structures; and the server processor configured to initiate the one or more tournaments based on one or more tournament game structures on an electronic gaming device where the electronic gaming device includes a plurality of display areas and one or more paylines formed on at least a portion of the plurality of display areas, the server processor configured to initiate one or more advertisements based on at least one of the one or more advertisement structures and one or more triggering events;

wherein the server processor is configured to initiate a first advertisement based on a first tournament time where the first tournament time is an intermission time period for a first tournament; wherein the one or more paylines are utilized in game play during the first tournament.

14. The electronic gaming system of claim 13, wherein the server processor is further configured to initiate a second advertisement based on a second tournament time.

15. The electronic gaming system of claim 14, wherein the first tournament of the one or more tournaments is an asynchronous tournament.

16. The electronic gaming system of claim 15, wherein a second tournament of the one or more tournaments is a synchronous tournament.

* * * * *